US006138816A

United States Patent [19]

Sato et al.

[11] Patent Number: 6,138,816

[45] Date of Patent: Oct. 31, 2000

[54] VARIABLE-SPEED PASSENGER CONVEYER AND HANDRAIL DEVICE THEREOF

[75] Inventors: Tomoaki Sato; Katsumi Ikizawa, both of Yokohama; Shinichiro Aoe, Kawasaki; Ryuichi Okuno, Yokohama, all of Japan

[73] Assignee: NKK Corporation, Tokyo, Japan

[21] Appl. No.: 09/099,907

[22] Filed: Jun. 19, 1998

[51] Int. Cl.[7] ..... B66B 21/12

[52] U.S. Cl. ..... 198/334; 198/792

[58] Field of Search ..... 198/334, 792

[56] References Cited

U.S. PATENT DOCUMENTS

| | | | |
|---|---|---|---|
| 3,218,986 | 11/1965 | Goedkoop | 198/792 |
| 3,601,246 | 8/1971 | Dubois | 198/334 |
| 3,672,484 | 6/1972 | Angioletti et al. | 198/334 |
| 3,709,150 | 1/1973 | Colombot | 198/334 |
| 3,793,961 | 2/1974 | Salvadorini | 198/334 |
| 3,834,520 | 9/1974 | Patin . | |
| 3,842,961 | 10/1974 | Burson | 198/334 |
| 3,903,806 | 9/1975 | Ayres et al. | 198/334 |
| 4,240,537 | 12/1980 | Dunstan . | |
| 4,732,257 | 3/1988 | Mathis et al. | 198/334 |

FOREIGN PATENT DOCUMENTS

| | | |
|---|---|---|
| 0015581 A2 | 9/1980 | European Pat. Off. . |
| 0074197 A2 | 3/1983 | European Pat. Off. . |
| 0079438 A2 | 5/1983 | European Pat. Off. . |
| 0646538 A2 | 4/1995 | European Pat. Off. . |
| 2123111 | 9/1972 | France . |
| 49-31470 | 8/1974 | Japan . |
| 50-6081 | 1/1975 | Japan . |
| 50-26277 | 3/1975 | Japan . |
| 50-132677 | 10/1975 | Japan . |
| 55-11978 | 1/1980 | Japan . |
| 57-98481 | 6/1986 | Japan . |
| 49-43371 | 4/1994 | Japan . |
| 492715 | 1/1939 | United Kingdom . |
| 1256364 | 12/1971 | United Kingdom . |
| 1286453 | 8/1972 | United Kingdom . |
| 1364270 | 8/1974 | United Kingdom . |
| 1383785 | 2/1975 | United Kingdom . |
| 1455586 | 11/1976 | United Kingdom . |
| 2264686 | 9/1993 | United Kingdom . |

*Primary Examiner*—Joseph E. Valenza
*Attorney, Agent, or Firm*—Frishauf, Holtz, Goodman, Langer & Chick, P.C.

[57] ABSTRACT

A variable-speed passenger conveyer comprises: endless driving chains which disengage the pallets at an acceleration zone and high-speed zone; a screw shaft which has a pitch that changes step by step so as to accelerate or decelerate the palettes; high-speed driving chains which engage the palettes at the high-speed zone to transport the palettes at high speed; and a driving system. Also, a handrail device for a variable-speed passenger conveyer comprises: a running rail formed in a loop; a plurality of handrail pieces which move following the running rail; a standard guide rail formed in a loop; a side guide rail provided along the standard guide rail, of which the spacing with the standard guide rail changes within a plane at acceleration/deceleration zones; a plurality of links rotatably linking a respective shafts of the standard guide rollers and side guide rollers, the links make continuous V formations within a plane; and a driving chain provided with protrusions for engaging the engaging pieces of the handrail pieces so as to drive the handrail pieces.

16 Claims, 45 Drawing Sheets

VARIABLE-SPEED PASSENGER CONVEYER AND HANDRAIL DEVICE THEREOF

BACKGROUND OF THE INVENTION

1. Field of the Invention

The present invention relates to a passenger conveyer such as a moving sidewalk or an escalator, and particularly to a variable-speed passenger conveyer and the handrail device thereof wherein the movement speed of the palettes serving as the running board is changed between the boarding and disembarking ends.

2. Description of the Related Art

Passenger conveyers which transport passengers without causing the passengers to walk have recently been widely installed in airports, train stations, tourist areas, and so forth.

The majority of such known passenger conveyers is such wherein the speed is constant from the boarding end to the disembarking end. The speed at the boarding end to the disembarking end needs to be set at 40 meters per minute or slower in order to maintain safety, and the speed remains constant from the boarding end to the disembarking end.

However, there are passenger conveyers which have been installed for access to urban mass transit facilities, some of which are long, and there is strong demand for an increase in the speed thereof at the intermediate area thereof.

Variable-speed passenger conveyers wherein the movement speed of the palettes which serve as the running board is changed between the boarding and disembarking ends are known from the following Patent Publications:

The "Slow-speed transporting device" disclosed in Japanese Patent Publication 49-31470 involves an arrangement wherein a group of comb-shaped palettes each entering and exiting each other are in the forward direction linked with a plurality of link-type supporting legs, providing a difference in height in the rails guiding the bottom portion of the supporting legs of the palettes, so that the overlap amount in a low speed zone is increased by lowering the rail and so that the overlap amount in a high speed zone is decreased by raising the rail, thereby changing the speed of the running board.

The "Moving sidewalk having an acceleration/deceleration mechanism" disclosed in Japanese Unexamined Patent Publication 50-6081 moves the supporting running boards linking the main running boards in the height direction so as to change the length of the link, thereby changing the speed of the running board.

Also, the "Variable-speed moving sidewalk and escalator" disclosed in Japanese Unexamined Patent Publication 50-132677 involves an arrangement wherein a continuously formed screw shaft is rotated wherein the screw pitch changes from small to large from the low-speed zone which is the boarding end to the high-speed zone, and which changes from large to small from the high-speed zone to the low-speed zone which is the disembarking end, thereby changing the speed of the running boards guided by the screw shaft.

However, the art disclosed in the Patent Publications have the following problems as known art:

The "Slow-speed transporting device" disclosed in Japanese Patent Publication 49-31470 is problematic in that the palettes expand and shrink even if the passenger is in the middle of the pallet when boarding, and thus the meshing of the palettes may cause discomfort for the passengers due to the surface moving upon which they are standing.

The "Moving sidewalk having an acceleration/deceleration mechanism" disclosed in Japanese Unexamined Patent Publication 50-6081 is problematic in that the addition of supporting running boards increases the cost of the device. Also, the supporting structure is complex due to the intersection of the main running boards and the supporting running boards, and further, the main structure including the supporting rollers is markedly restricted, space-wise.

Also, the "Variable-speed moving sidewalk and escalator" disclosed in Japanese Unexamined Patent Publication 50-132677 is problematic in application to a long-distance passenger transporting conveyer in that manufacturing a variable-pitch screw shaft over a long distance and at high precision is extremely difficult, and that manufacturing costs markedly increase. Also, a long screw shaft necessitates intermediate bearings, and thus is rather impractical.

Also, there have been proposed variable-speed passenger conveyers arranged such that the speed at the boarding end is a certain speed, the speed then gradually accelerating to a higher speed at the intermediate area, and then gradually decelerating to the same speed at the disembarking end, thereby maintaining the safety of passengers boarding and disembarking, but the majority of such variable-speed passenger conveyers has involved an arrangement of changing the spacing of the palettes to change the speed.

A proposal for a variable-speed passenger conveyer is disclosed in Japanese Unexamined Patent Publication No. 49-43371 as a "variable-speed driving apparatus", wherein the rail height of a triangular belt link linked to a carriage and two palettes running along a rail changes in height in the direction of progression, thereby changing the palette spacing.

However, the art disclosed in the above Patent Publication has the following problems.

(1) The rail height rapidly changes and the acceleration of the palettes temporarily becomes extremely great, giving the passengers on the palettes a sense of discomfort while riding thereon.

(2) The structure is complex, the space occupied by the structure underneath the palettes is great, and facility costs are high.

(3) The belt link is flexible, so it is difficult to precisely set the palette spacing, and belt stretching occurs during operation, deteriorating comfort in riding.

(4) The belt link is flexible, so operation must perpetually be made with a pulling load applied thereto, and in the event that the traction force is small or a compression load occurs, the link does not operate.

On the other hand, there is the need to make the movement speed of the handrails variable, in addition to making the pallets variable in speed.

A proposal to make the handrails variable in speed is known in Japanese Unexamined Patent Publication No. 57-98481.

The structure of the handrail described in the aforementioned Patent Publication involves loop-shaped guide rails provided on the outer side and inner side within a vertical plane, wherein the spacing of the aforementioned outer and inner guide rails is narrowed at the high speed zone and widened at the boarding and disembarking ends. Provided on the aforementioned outer guide rail is a handrail piece stretchably linked in the direction of transportation via the outer guide roller, and provided on the inner guide rail is an inner guide roller which is moved by means of being engaged with claws on a high-speed driving chain.

Further, the front and back of the aforementioned handrail piece and an inner guide roller are linked by a V-shaped link provided within a vertical plane.

In the above construction, at the point that the inner guide roller is driven by the driving chain, the angle of the link is an acute angle at the boarding and disembarking ends, due to the spacing between the outer and inner guide rails being large, thus narrowing the spacing between the handrail pieces and creating a state of low speed for the handrails.

Also, the angle of the link is an obtuse angle at the intermediate high-speed zone, due to the narrow spacing between the outer and inner guide rails, thus widening the spacing between the handrail pieces and creating a high speed state for the handrails.

However, the aforementioned known art has the following problems:

(1) The link is provided in a V-shape within a vertical plane, so transmission of force is difficult at the handrail inversion portion, and there is the problem of interference between the inner rail guide roller and handrail and link.

(2) There are two factors operating on the opening angle of the link at the high-speed zone, namely, the opening operation due to the claw spacing of the driving chain, and the opening operation due to change in the inner and outer guide rail spacing, so there is the problem that both operations interfere with one another and smooth movement of the handrail pieces cannot be obtained.

(3) There are no means for adjusting the circumference of the link (the length in the transporting direction), so mounting and adjusting the link is difficult, and further, it is difficult to engage the claws of the driving chain with the upper and lower portions of the inner rail guide roller.

(4) The structure is such that the shafts of the link linkage portions, the inner rail guides roller, etc., are axially borne by the outer/inner guide rail, so the shaft bearing structure is unstable.

Also, regarding variable-speed handrails, the invention disclosed in Japanese Unexamined Patent Publication 50-26277 is an arrangement wherein a plurality of independent handrail devices with differing speeds are each linearly arrayed.

Also, as a structure of variable-speed handrails, the invention disclosed in Japanese Unexamined Patent Publication 55-11978 is an arrangement wherein the handrails are overlapped in the driving direction.

However, the invention disclosed in Japanese Unexamined Patent Publication 50-26277 is problematic in that the handrail devices are independent, the structure is complicated and expensive, and further, the passengers are inconvenienced in that there is the need to re-grasp the handrail at each joint, making for passenger discomfort while riding thereon. Further, the speed cycle of the running boards and the handrails is not matched, and thus is inconvenient in that there is the need to re-grasp the handrail even while holding the same handrail.

Also, the invention disclosed in Japanese Unexamined Patent Publication 55-11978 as a variable-speed handrail configuration is problematic in that there is the danger of the fingers of the passenger becoming pinched when the handrail unit shrinks.

OBJECTS AND SUMMARY OF THE INVENTION

Accordingly, it is an object of the present invention to provide a variable-speed passenger and handrail device thereof which reduces the acceleration of the palettes as much as possible, is simple in structure, and wherein adjustment can be made automatically. The following are aspects of the present invention to be carried out as preferred embodiments.

A first variable-speed passenger conveyer which changes the transporting speed between the boarding end and disembarking end by changing the transporting speed of palettes to transport passengers comprises: endless driving chains which engage the pallets at the boarding end and disembarking end and cause rotation thereof, and which disengage the pallets at an acceleration zone and high-speed zone; a screw shaft which engages the palettes at the acceleration zone and deceleration zone, and which has a pitch that changes step by step so as to accelerate or decelerate the palettes; high-speed driving chains which engage the palettes at the high-speed zone between the acceleration zone and deceleration zone, so as to transport the palettes at high speed; and A driving system which mechanically links the driving chain, screw shaft, and high-speed driving chain.

A second variable-speed passenger conveyer which changes the transporting speed between the boarding end and disembarking end by changing the transporting speed of palettes to transport passengers comprises: a pair of guide rails provided in loop fashion to the transporting line so that the width spacing is gradually reduced from the boarding end to the beginning of the high-speed zone and gradually increased from the end of the high-speed zone to the disembarking end; a chain which engages the palettes at the high-speed zone and drives at high speed; palettes provided with engaging metal pieces for engaging the chain and a spline shaft for sliding the guide roller in a right-angle direction with the transporting direction below; a pair of slide blocks engaged with the spline shaft and moving in a right-angle direction with the transporting direction; a guide roller attached to the slide blocks and guided by the pair of guide rails; and a plurality of link members linking two pairs of slide blocks adjacent in the transporting direction, and intermediate rotary joints positioned on a center line of the pair of guide rails, these link members form a planar rhombic form.

A first handrail device for a variable-speed passenger conveyer comprises: a plurality of variable-speed handrail pieces positioned in the transporting direction, the cross-sectional form thereof being trapezoid; a stretching linking member for linking the plurality of handrail pieces and closing the slit of the cover through which the shaft of the handrail pieces passes; and a cover with a radius having a center differing from the center of the inverse radius of the handrail pieces, so that the upper plane of the handrail pieces is embedded within the cover plane at the rotating portion of the transporting path.

A second handrail device for a variable-speed passenger conveyer comprises: a running rail comprised of a passenger transporting line and a return line formed in a loop; a plurality of handrail pieces which move following the running rail; a standard guide rail formed in a loop in the same manner as the running rail; a side guide rail provided along the standard guide rail, the space between the standard guide rail and the side guide rail changes within a plane at acceleration/deceleration zones; a plurality of links provided between the standard guide rail and the side guide rail in the transporting direction within a plane rotatably link the respectively engaging plurality of standard guide rollers and plurality of side guide rollers, these links are in continuous V-formations; and a driving chain provided with protrusions for engaging the engaging pieces of the handrail pieces so as to drive the handrail pieces, the driving chains being arranged in the high-speed zone of the transport line and high-speed zone of the return line.

DESCRIPTION OF THE PREFERRED EMBODIMENTS

First, an embodiment of the first variable-speed passenger conveyer according to the present invention will be described with reference to the drawings.

Figure 1:
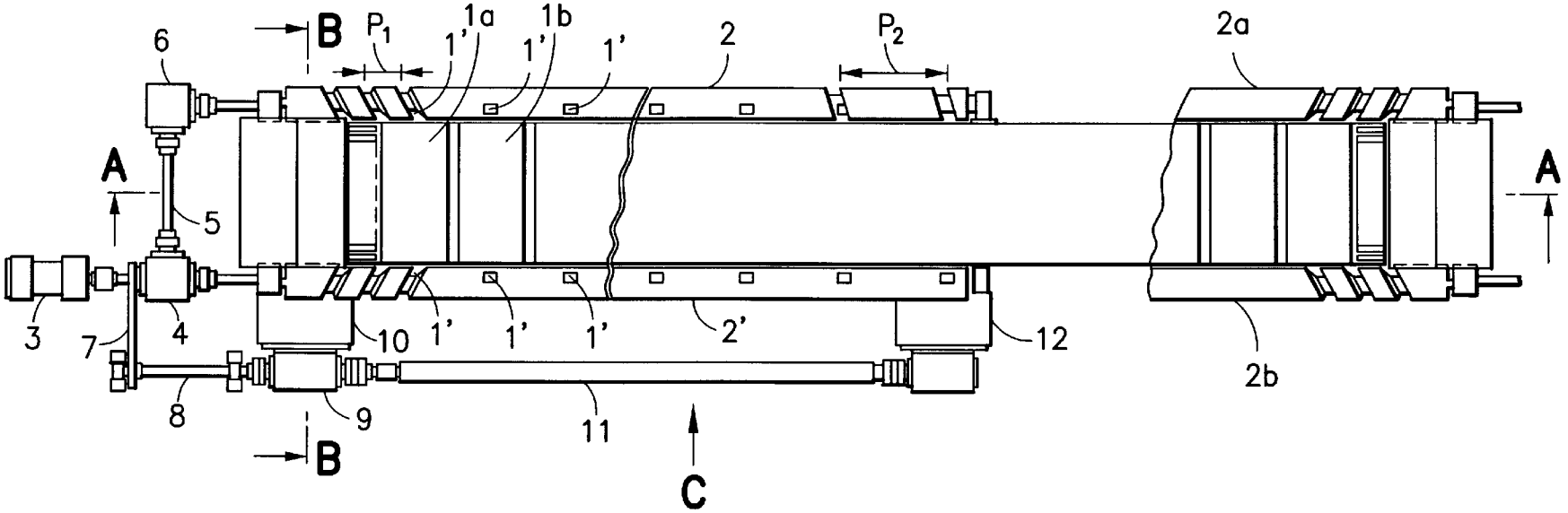
FIG. 1 is a plan view of the variable-speed passenger conveyer according to the present invention.

FIG. 1 is a plan view of a variable-speed passenger conveyer according to the present invention, reference numeral 1 denoting a passenger conveyer comprised of a plurality of palettes 1*a,* 1*b,* and so forth. 2 and 2' are screw shafts (helical shafts) provided from the boarding end (left side) to the disembarking end (right side). The pitch of the screw shafts 2 and 2' is small at the boarding end and increases step by step while approaching the high-speed zone. Protrusions formed to the side of the aforementioned palettes 1*a,* 1*b,* and so forth are engaged with the screw grooves of the screw shafts 2 and 2' so that the palettes 1*a,* 1*b,* . . . , are transported by means of rotating the screw shafts 2 and 2', the speed of the palettes 1*a,* 1*b,* . . . , increasing with the gradual increase in pitch.

Figure 5:
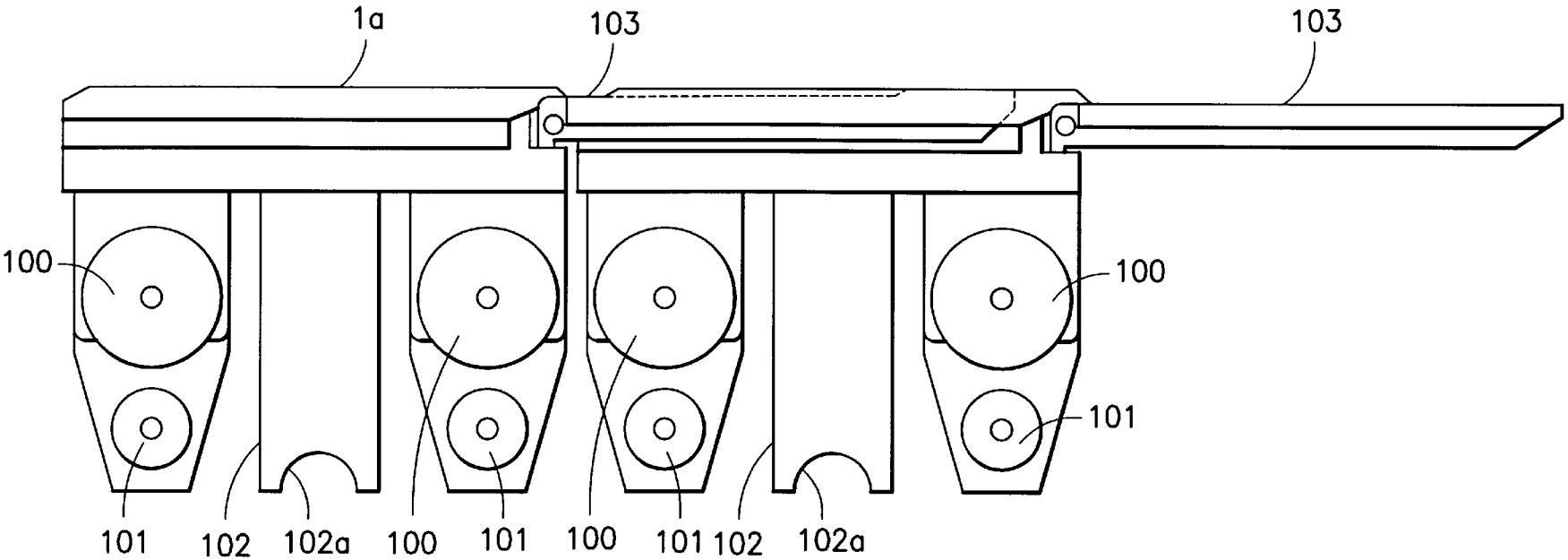
FIG. 5 is a side view of the palettes in a shrunk state according to the present invention.
Figure 6:
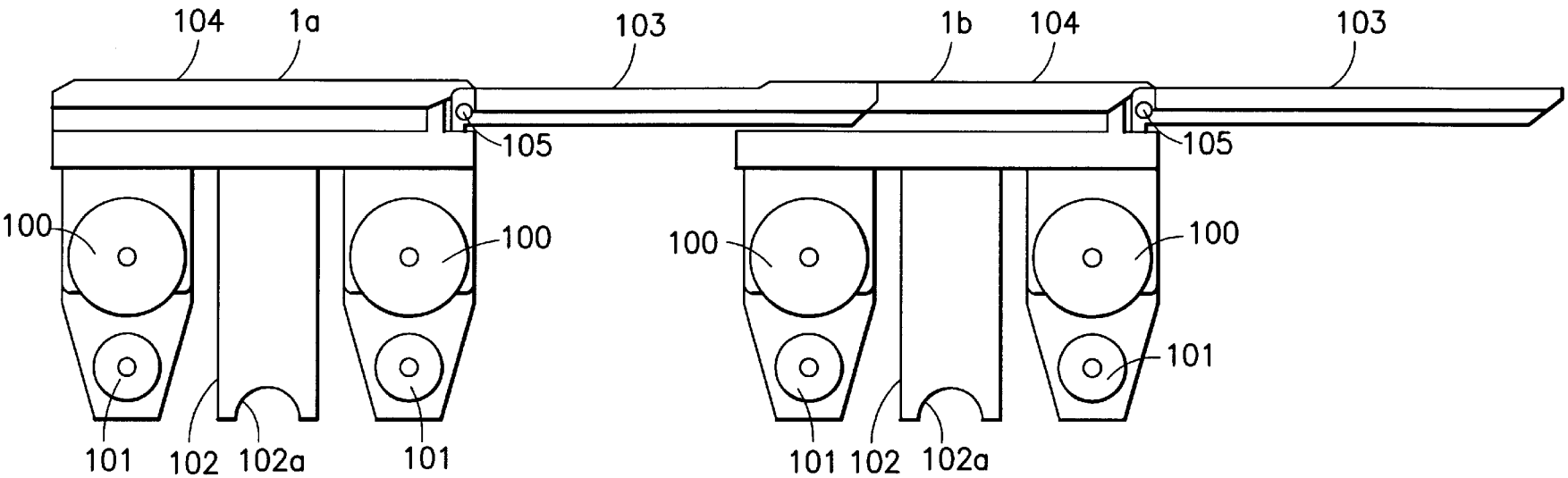
FIG. 6 is a side view of the palettes in a unfolded state according to the present invention.

FIGS. 5 and 6 are side views illustrating the change in the spacing of the palettes 1*a,* 1*b,* . . . , FIG. 5 illustrating the state in which the palettes 1*a,* 1*b* . . . , are in the closest proximity one another in the low-speed zone, and FIG. 6 illustrating the state in which the palettes 1*a,* 1*b* are farthest removed one another in the high-speed zone.

Figure 2:
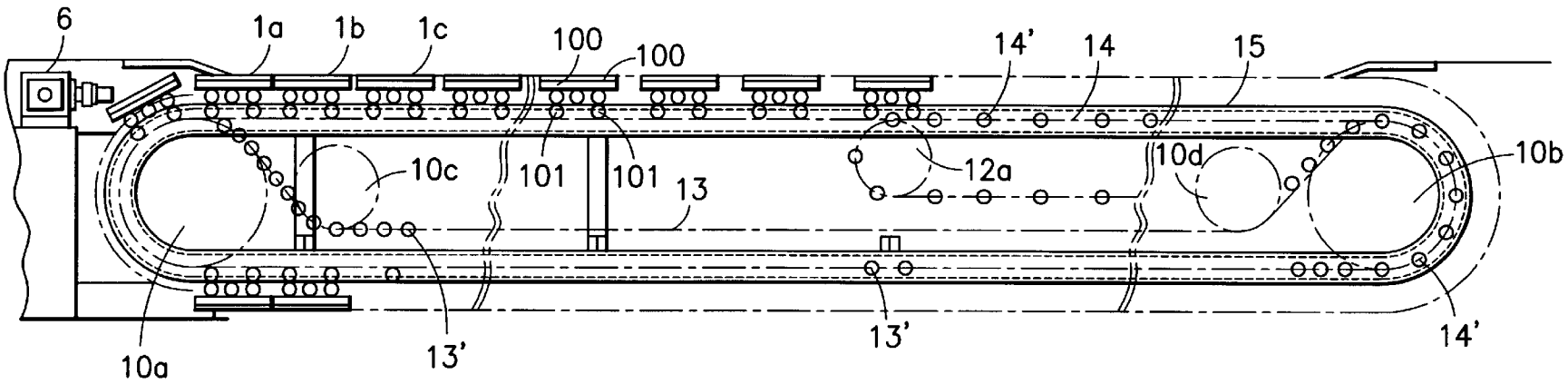
FIG. 2 is a cross sectional view taken along line A—A in FIG. 1.

In the event that there is a gap formed between the palettes 1*a,* 1*b* . . . , a plurality of comb teeth 103 having rigidity bridge the palette with the neighboring palette by being capable of entering therein, thus forming a running board. The comb teeth 103 are formed so as to have an upper surface lower than the running board surface 104 of the palettes 1, and are attached in one example to the palette proper with a hinge portion 105 so as to rotate at an appropriate bending angle at rotating portions such as at the sprocket 10*a* and so forth, as shown in FIG. 2.

Returning to FIG. 1, reference numeral 3 denotes a motor, the motive force of the motor 3 driving the aforementioned screw shaft 2' via a speed changing gear 4, and also driving the other screw shaft 2 via a transmitting shaft 5 and speed changing gear 6.

Further, the motive force of the motor 3 drives a driving sprocket mechanism 10 via a chain 7, transmitting shaft 8 and speed changing gear 9.

2*a* and 2*b* at the disembarking end on the right in FIG. 1 is of the same structure as that of the screw shafts 2 and 2' of the boarding end described above, i.e., screw shafts for driving the palettes 1*a,* 1*b,* and so forth, such being provided from the high-speed zone which is the intermediate portion to the low-speed zone at the disembarking end, differing in that the pitch gradually changes from great to small, and also being synchronously driven with the aforementioned motor 3 by a another and not shown driving system.

Reference numeral 11 denotes a transmitting shaft for causing high-speed transportation of the palettes 1*a,* 1*b,* . . . , and is linked from the aforementioned transmitting shaft 8 via a speed changing gear 9.

FIG. 2 is a cross sectional view taken along line A—A in FIG. 1, wherein reference numeral 13 denotes a driving chain for driving the palettes 1*a,* 1*b,* . . . , being provided doubly to the left and right as to the driving direction, and being endlessly wound to the driving sprocket 10*a* and slave sprocket 10*b*. Reference numerals 10*c* and 10*d* denote sprockets which provide the aforementioned driving chain 13 with tension and also change direction so as to disengage the engagement with the palettes 1*a,* 1*b,* . . . , . Reference numeral 13' is a linking shaft connecting the aforementioned two-fold chain 13 in the width direction thereof.

Further, reference numeral 12*a* is a high-speed driving sprocket which drives the driving chain 14, driving the two-fold high-speed driving chain 14 (partially shown). Reference numeral 14' is a linking shaft connecting the two-fold high-speed driving chain 14 in the width direction thereof. The pitch of the linking shaft 14' is approximately the same as the terminal pitch of the aforementioned screw shafts 2 and 2', thus enabling a smooth shift from transportation due to the screw shafts 2 and 2' engaging the protrusions 1' of the guide rollers (later-described) of the palettes 1*a,* 1*b,* . . . , to transportation due to engagement of a later-described engaging piece with the linking shaft 14'.

Also, reference numeral 15 denotes an endless guide rail provided from the boarding end to the disembarking end which constitutes the transportation range of the palettes 1, the guide rail 15 guiding the guide rollers 100, 101, and so forth of the palettes 1*a,* 1*b* , . . . , .

Figure 3:
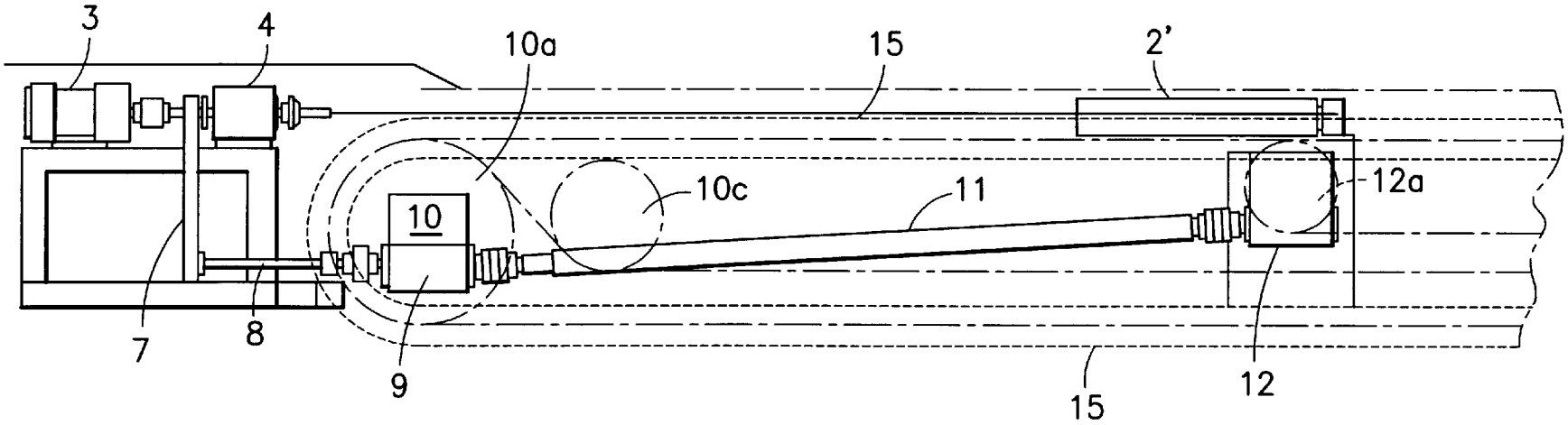
FIG. 3 is a side view from an arrow C in FIG. 1.

FIG. 3 is a side view from an arrow C in FIG. 1, wherein, as described above, the screw shaft 2' is driven via the motor 3 and speed changing gear 4, the sprocket 10*a* is driving via the chain 7, transmitting shaft 8, and speed changing gear 9, and the high-speed driving sprocket 12*a* being driven via the transmitting shaft 11.

Figure 4:
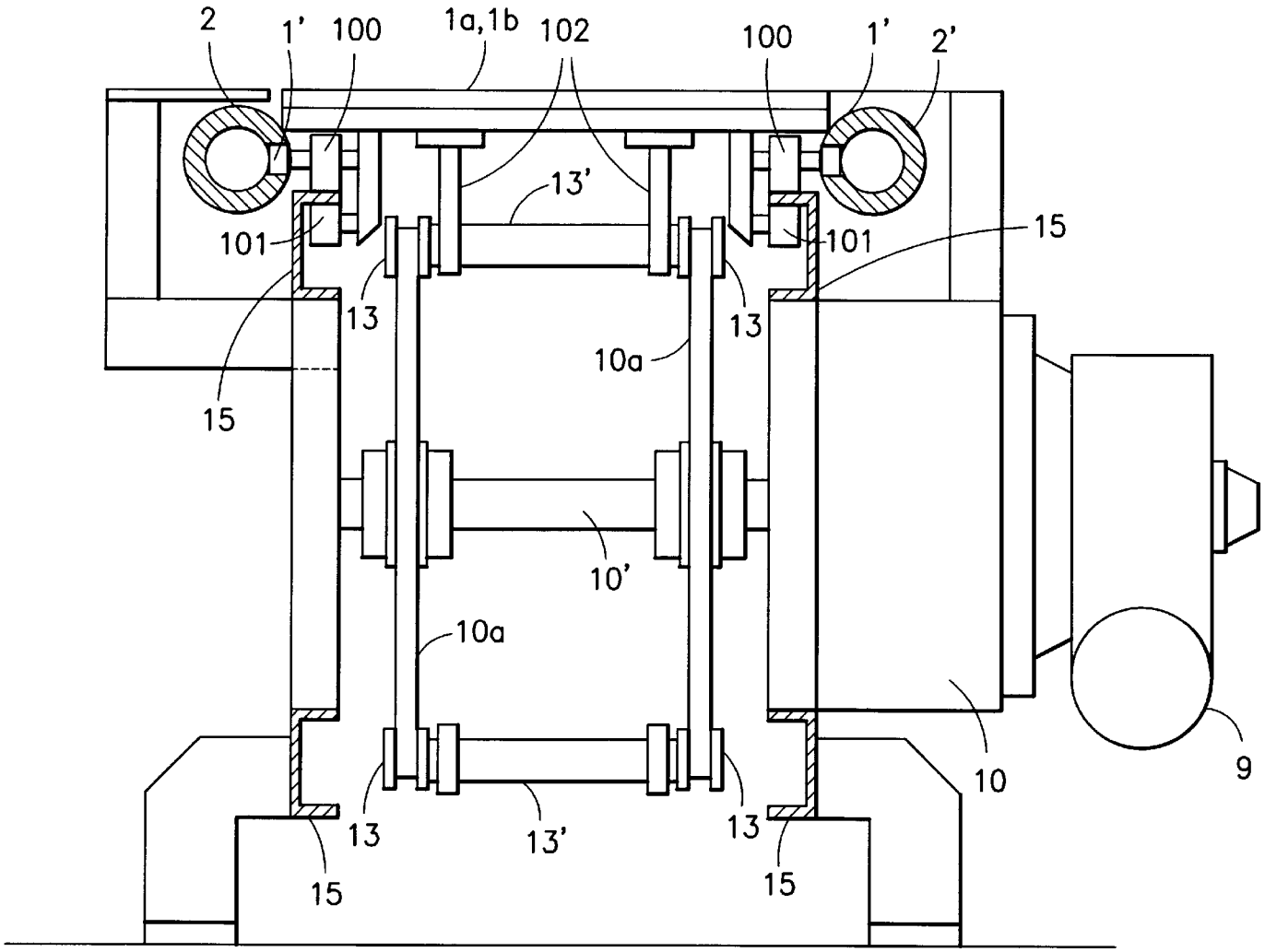
FIG. 4 is a cross sectional view taken along line B—B in FIG. 1.

FIG. 4 is a cross sectional view taken along line B—B in FIG. 1, wherein the protrusion 1' of the guide roller 100 provided to the rear side of the palettes 1*a,* 1*b,* . . . , are fitted into the screw grooves of the screw shafts 2 and 2'. The guide rollers 100 and 101 are in contact with the guide rail 15.

Also, as shown in FIG. 5 and FIG. 6 (side views), engaging pieces 102 for engaging the linking shaft 13' of the driving chain 13 are provided to the rear side of the palettes 1*a,* 1*b,* . . . , the tip of the engaging piece 102 forming a receiving portion 102*a* of an involute curve. This is a curve formed for facilitating ease of the receiving portion 102*a* fitting with and disengaging from the linking shaft 13' or 14'.

This curve is such that in the event that the driving sprocket 10*a* rotates at the position of the driving sprocket 10*a* and the slave sprocket 10*b* being as shown in FIG. 2, the receiving portion 102*a* of the aforementioned engaging piece 102 engages the linking shaft 13' of the driving chain 13, thereby performing rotational driving of the palettes 1*a,* 1*b,* and so forth, but at the boarding end the aforementioned driving chain 13 moves downwards so that the linking shaft 13' moves downwards away from the receiving portion 102*a,* and also, at the disembarking end the linking shaft 13' engages the receiving portion 102*a* of the engaging piece 102 so as to transport the palettes 1*a,* 1*b,* and so forth.

This state is the same for the position of the high-speed driving chain 14, as well.

Describing the driving of the palettes 1*a,* 1*b,* . . . , of the present invention with reference to FIGS. 1, 2, 4, and 5, driving the motor 3 and driving the driving sprocket, screw shafts 2 and 2' and also driving the high-speed sprocket 12*a* causes the driving chain 13 to be driven, the engaging pieces 102 of the palettes 1*a,* 1*b,* . . . , engage the linking shaft 13' of the driving chain, and at the boarding end the linking shaft 13' moves away from the engaging pieces 102.

At that position, the protrusions 1' of the guide rollers 100 on the rear of the palettes 1*a,* 1*b,* . . . , engage the grooves of the aforementioned screw shafts 2 and 2' and head toward the high-speed zone, and accordingly widen the spacing of the palettes 1*a,* 1*b,* . . . , equally with the screw pitch, thereby entering the high-speed zone.

The high-speed zone has a linking shaft 14' of the high-speed driving chain 14 with spacing equal to that of the terminal screw pitch, the linking shaft 14' engaging the engaging pieces 102 of the palettes 1*a,* 1*b,* . . . , again, thereby moving the palettes 1*a,* 1*b,* . . . , at high speed. Screw shafts 2*a* and 2*b* with a reverse pitch to that of the aforementioned screw shafts 2 and 2' are provided at the end position of the high-speed zone, the protrusions 1' of the guide rollers 100 on the rear of the palettes 1*a,* 1*b,* . . . , engage the grooves of the screw shafts 2*a* and 2*b,* and the palettes 1*a,* 1*b,* . . . , gradually decelerate and reach the disembarking end.

The driving chain 13 engaged with the slave sprocket 10*b* is moving at the disembarking end, and the engaging pieces of the palettes 1*a* and 1*b* engage the linking shaft 13' of the driving chain 13 and rotate, and move along the underside to reach the driving sprocket 10*a*. During that time, other palettes are moving by engaging with the screw shafts 2 and 2', high-speed driving chain 14, and screw shafts 2*a* and 2*b*.

The present invention constructed as described above is comprised of a driving system wherein the driving chains, screw shafts, and high-speed driving chain are a mechanically linked driving system, thereby facilitating ease of adjusting synchronization of the palette transporting speed of each part of the driving system.

Also, the comb teeth fit into the neighboring palette have an upper plane lower than that of the fixed running board, and the passengers ride on the top of the palettes, so there is no contact between the passengers and the comb teeth being inserted and extracted, and as a result, the passengers do not lose balance, i.e., the movement in the running board does not cause discomfort in riding.

The screw shafts can be short since they are only provided to the acceleration/deceleration zones, meaning that the precision thereof can be raised, and the manufacturing costs can be lowered.

Next, an embodiment of the second variable-speed passenger conveyer according to the present invention will be described with reference to the drawings.

Figure 7:
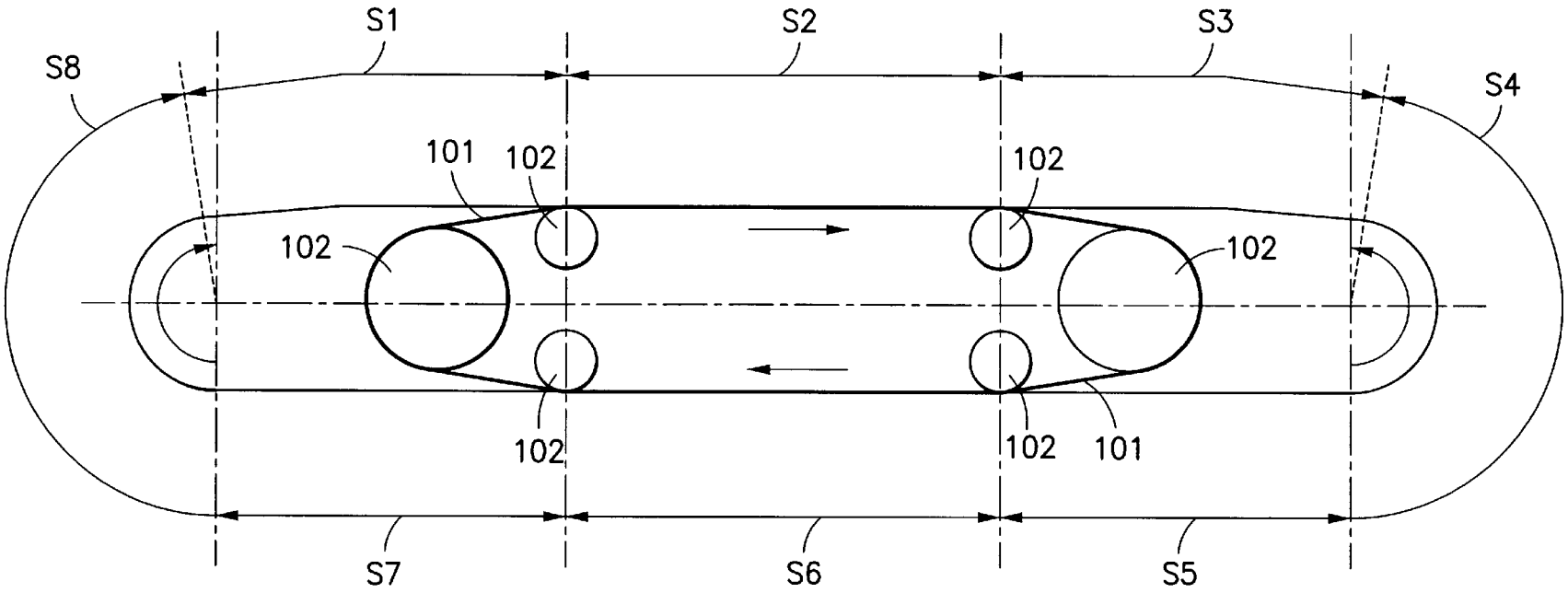
FIG. 7 is a schematic side view of a transportation state of the variable-speed passenger conveyer according to the present invention.

FIG. 7 is a schematic side view of a transportation state of the variable-speed passenger conveyer according to the present invention.

In FIG. 7, S1 is an acceleration zone from the boarding end to the high-speed zone, S2 is a high-speed zone, S3 is a deceleration zone from the high-speed zone to the disembarking end, and further, in the return line, S4 is an inversion portion, S5 is an acceleration zone, S6 is a high-speed line the same as the above, S7 is a deceleration zone, and S8 is an inversion portion.

A pair of later-described guide rails of which the width spacing changes is provided to the aforementioned acceleration zones S1 and S5 and the deceleration zones S3 and S7. Incidentally, the width spacing in the inversion portions S4 and S8 is constant.

Also, the guide rails are not provided to the high-speed zones S2 and S6, but a chain 101 is provided for obtaining driving force. The driving mechanism of the palettes is comprised of the aforementioned chain 101 and a plurality of chain sprockets 102 for driving the chain 101, and force is transmitted to one of the chain sprockets 102 from a motor (not shown).

Figure 8:
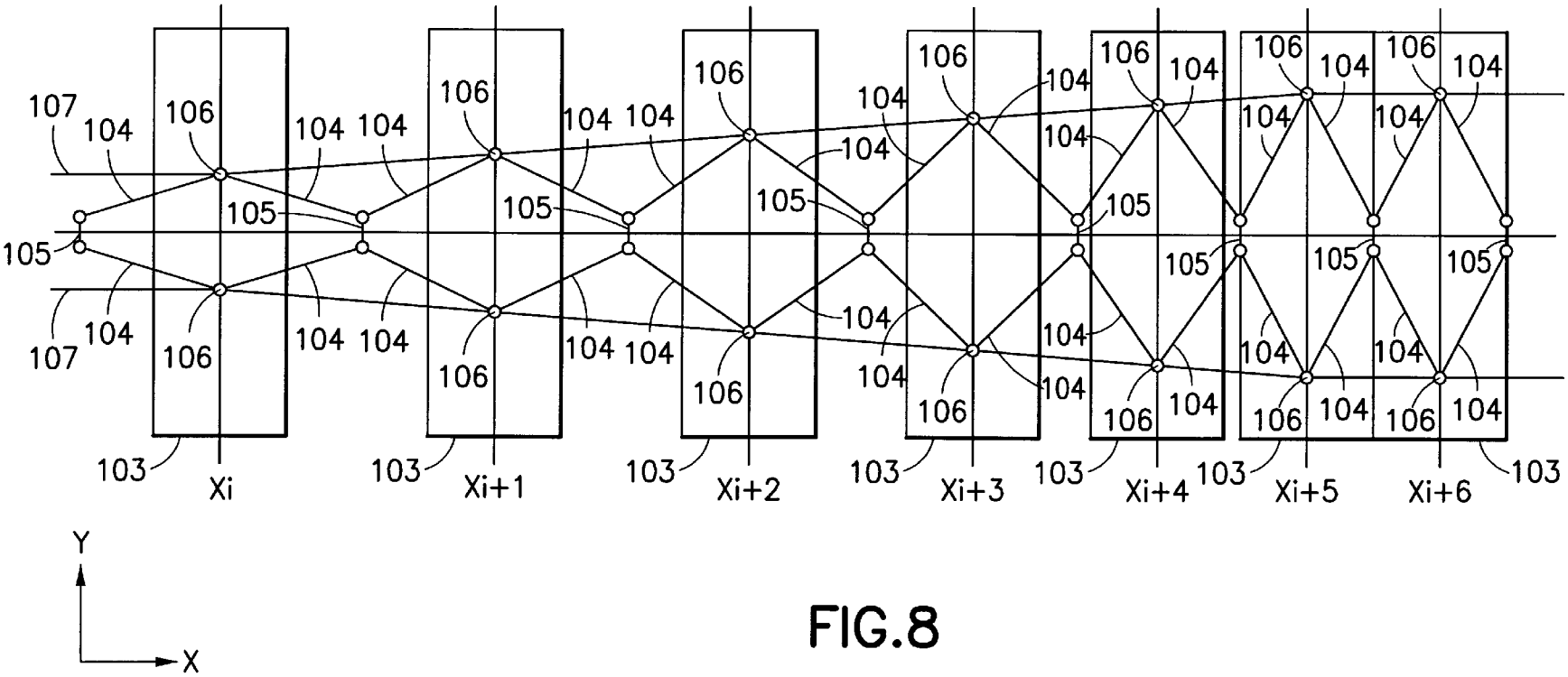
FIG. 8 is a schematic plan view illustrating a deceleration state of the variable-speed passenger conveyer in the deceleration zone S3 according to the present invention.

FIG. 8 is a schematic plan view illustrating a deceleration state of the variable-speed passenger conveyer according to the present invention.

In FIG. 8, 103 denotes a palette, and the palette 103 is linked with the adjacent palette by four links 4 mutually joined in a rhombic form. 105 denotes an intermediate joint joining the links 104 from the preceding and succeeding palettes 103 and 103, and the joints 106 and 106 on the both sides are structured to follow the change in width of the guide rails 107 and 107.

Accordingly, the width of the guide rail 107 and 107 is formed so as to be gradually wider in the deceleration zone S3 from the high-speed zone S2 to the disembarking end or the deceleration zone S7 in the return line from the high-speed zone S6 to the inversion portion S4, so that the links 104 are moved toward the outer direction of the joints 106 and 106 such that the links 104 take on a rhombic form elongated in the Y-axial direction, and the spacing of the palettes 103 and 103 narrows as shown in the Figure, thus creating a state of deceleration.

Also, a pair of guide rails 107 and 107 are provided to the acceleration zone S1 from the boarding end to the high-speed zone or the acceleration zone S5 in the return line, and the guide rails 107 and 107 in the acceleration zones S1 and S5 are formed to narrow, opposite to the above description, so that the links 104 are moved toward the inner direction of the joints 106 and 106 such that the links 104 take on a rhombic form elongated in the X-axial direction, and the spacing of the palettes 103 and 103 spreads, thus creating a state of acceleration.

Variable-speed passenger conveyers are different from conventional constant-speed passenger conveyers in that the speed at the boarding and disembarking ends is low, and the speed at the intermediate portion is high. Accordingly, acceleration occurs as a matter of course at the acceleration/deceleration zones at which the speed changes from low speed to high speed, or from high speed to low speed. This acceleration affects the ease of ride of the passengers on the conveyer, and the greater the acceleration is, the greater the discomfort in ride of the passengers is. It is desirable that the acceleration generated at the acceleration/deceleration zones be as small as possible, i.e., that the acceleration in the acceleration/deceleration zones be a constant acceleration.

According to the variable-speed passenger conveyer according to the present invention, the factor controlling the acceleration is the form of the guide rail 107. Accordingly, analyzing the change in acceleration of the palettes upon change of the form of the guide rail 107 is extremely important in optimal design of the acceleration of the palettes.

Let us now consider the speed and acceleration of the palettes 103 as to the guide rail 107.

In FIG. 8 which illustrates the state of deceleration of the palettes 103 in the deceleration zone S3 of the variable-speed passenger conveyer according to the present invention, 103 is a palette, 104 is a link, 105 is an intermediate link, 106 is a joint on the guide rail 107, and 107 and 107 are guide rails.

As shown in FIG. 8, a coordinates system (X, Y) is placed on the plane formed of the guide rails 107 and 107 with X as the transportation direction of the conveyer and Y as the width direction of the conveyer.

With the center line of the guide rails 107 and 107 as zero, the function of a value obtained by subtracting half of the width of the intermediate link 105 of the guide rail 107 from the value of the width orthogonal with the joint 106 from the center line in the Y direction (i.e., guide form function) is set as G (X).

Considering the link guide rail system shown in FIG. 8 to be a fluid system, the following relational Expression (1) holds:

$$\frac{v_L}{\sqrt{L^2 - G_L^2} + K/2} = \frac{v_H}{\sqrt{L^2 - G_H^2} + K/2} \quad (1)$$

wherein;

$V_L$, $V_H$: speed of palette 3 in low speed and high speed zones $G_L$, $G_H$: value of guide shape function G (X) in low speed and high speed zones L: length of the link 4

K; width of the joint link 106

The driving system for the palettes shown in FIG. 7 pulls the palettes by means of a chain in the high-speed zones S2 and S6, so the speed $V_H$ of the palettes in the high-speed zone is constant. Using the palette speed $V_H$ as a standard, generalizing the aforementioned Expression (1) for application to all zones yields the following Expression (2) which is an approximate expression for the speed V(x) of the palettes 3.

$$v(x) = \frac{\sqrt{L^2 - G(x)^2} + K/2}{\sqrt{L^2 - G_H^2} + K/2} v_H \quad (2)$$

Also, an approximate expression for the acceleration a(x) can be obtained by time-differentiation of Expression (2), yielding the following Expression (3).

$$a(x) = -\frac{v_H^2}{\left(\sqrt{L^2 - G_H^2} + K/2\right)} \frac{\sqrt{L^2 - G(x)^2} + K/2}{\sqrt{L^2 - G(x)^2}} G(x) \frac{dG(x)}{dx} \quad (3)$$

In the event that the certain speed change ratio (=speed of high-speed zone/speed of low-speed zone) has been obtained using Expression (1), a relational expression can be obtained for the form design variables L, K, $G_L$, and $G_H$ of the link guide system of the palettes, and an approximate value for the speed and acceleration of the palettes 3 can be obtained using Expression (2) and Expression (3).

The speed and acceleration of the palette 103 obtained using Expression (2) and Expression (3) are only approximate values, and it is necessary to obtain the speed and acceleration of the palettes using a model which is closer to the actual link guide system of the palettes.

With the X coordinate (palette position) of the center of the palette 103 as $X_i$, the following Expression (4) holds between the i+1-th palette position $X_{i+1}$ and the i-th palette position $X_i$:

$$x_{i+1} = x_i + K + 2\sqrt{L^2 - G((x_{i+1} + x_i)/2)^2} = x_i + K + 2\sqrt{L^2 - G_{ij+1}^2} \quad (4)$$

In Expression (4), $G_{i,j+1}$ represents $G((X_{i+1}+X_i)/2)$. Time-differentiation of Expression (4) yields the following Expression (5):

$$v_{i+1} = \frac{\sqrt{L^2 - G_{ij+1}^2} - G_{ij+1}\frac{dG_{ij+1}}{dx}}{\sqrt{L^2 - G_{ij+1}^2} + G_{ij+1}\frac{dG_{ij+1}}{dx}} v_i \quad (5)$$

In Expression (5), $V_i$ represents the i-th palette speed. Time-differentiation of Expression (5) yields the following Expression (6):

$$\left(\sqrt{L^2 - G_{ij+1}^2} + G_{ij+1}\frac{dG_{ij+1}}{dx}\right)a_{i+1} = \left(\sqrt{L^2 - G_{ij+1}^2} - G_{ij+1}\frac{dG_{ij+1}}{dx}\right)a_i - \frac{1}{2}(v_{i+1} - v_i)^2 - \left\{\left(\frac{dG_{ij+1}}{dx}\right)^2 + G_{ij+1}\frac{d^2G_{ij+1}}{dx^2}\right\}\frac{1}{2}(v_{i+1} + v_i)^2 \quad (6)$$

In Expression (6), $a_i$ represents the i-th roller speed. Expression (4) is used to asymptotically obtain the palette position $X_i$. Expression (5) and the palette position $X_i$ is used to asymptotically obtain the palette speed $V_i$.

Expression (6), palette position $X_i$, and palette speed $V_i$ are used to asymptotically obtain the palette acceleration $a_i$.

Since there is the component $d^2G(X)/dX^2$ in the Expression (6) representing the palette acceleration, the guide form function G(X) must be a function which has at least a second-order derivative value of the guide form function G(X), i.e., at least a $C^1$ class continuous function.

Figure 9:
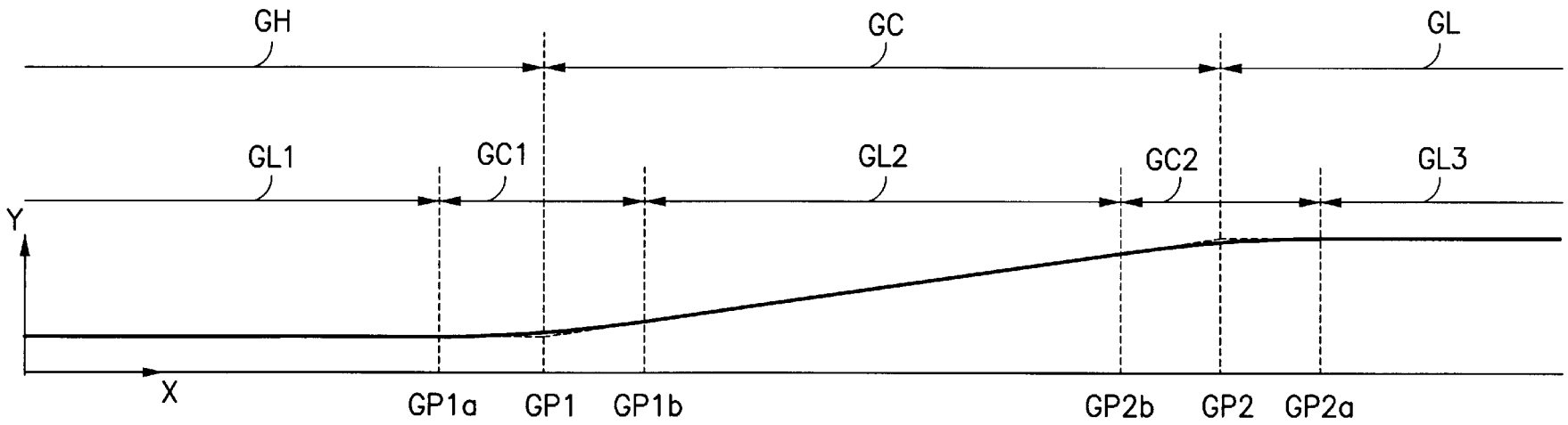
FIG. 9 is an explanatory diagram of the guide form function relating to the present invention.

FIG. 9 is an explanatory diagram of the guide form function relating to the present invention, and shows a $C^1$ class continuous guide form function. The broken line is the basic design line of the guide comprised of line segments, and the solid line is the guide form function G(X). The GH area is the high-speed zone of the design line, the GC area is the acceleration/deceleration zone of the design line, and the GL area is the low-speed zone of the design line.

Inserting arcs with a certain curvature radius to area boundary points GP1 and GP2 in the basic design line of the guide forms the guide form function G(X). In the areas GL1, GL2, and GL3, the guide form function G(X) is a straight line, and in the areas GC1 and GC2 the guide form function G(X) is an arc with a radius R.

Figure 10:
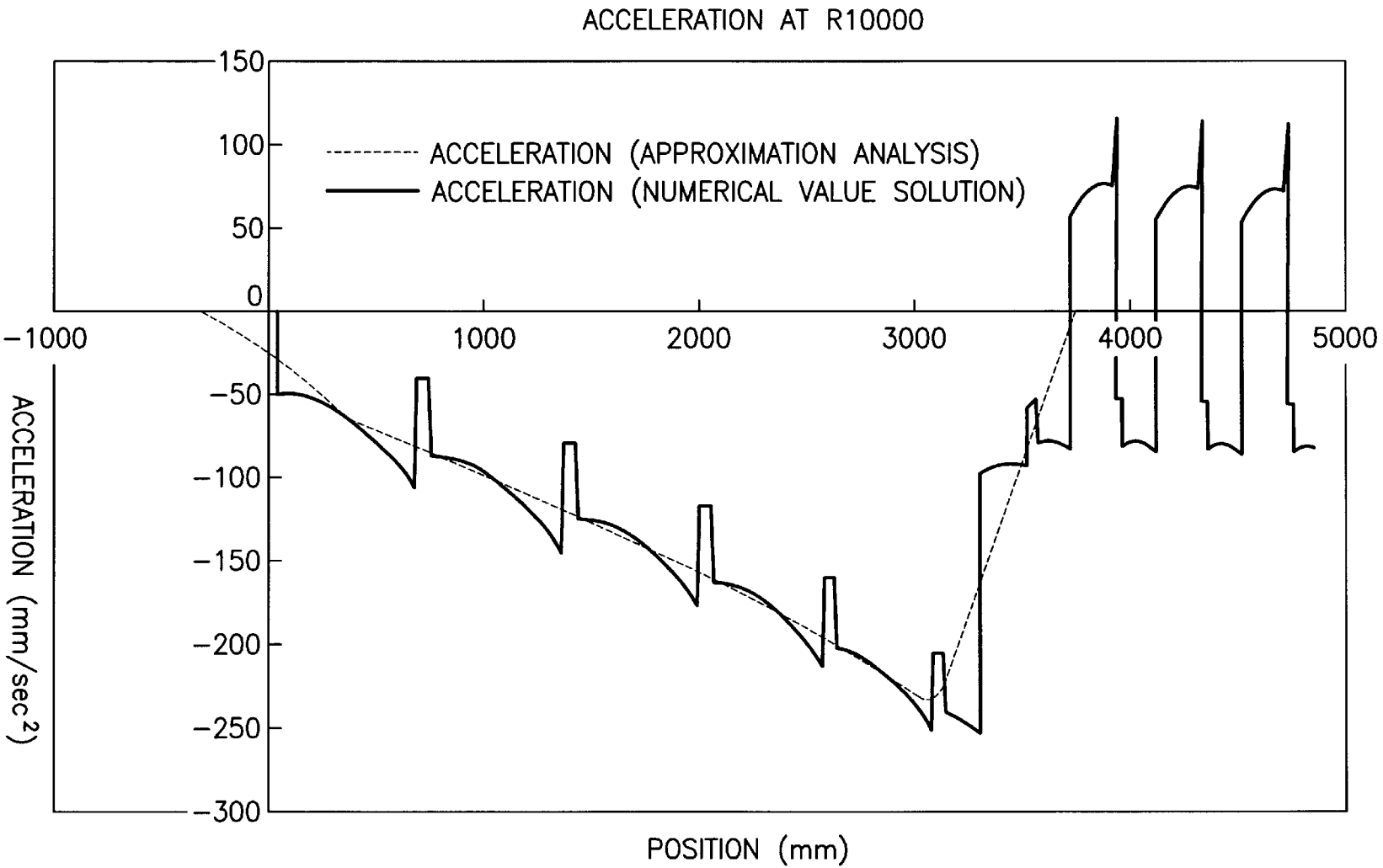
FIG. 10 is a graph of the acceleration of the palette relating to the present invention (R10000)
Figure 11:
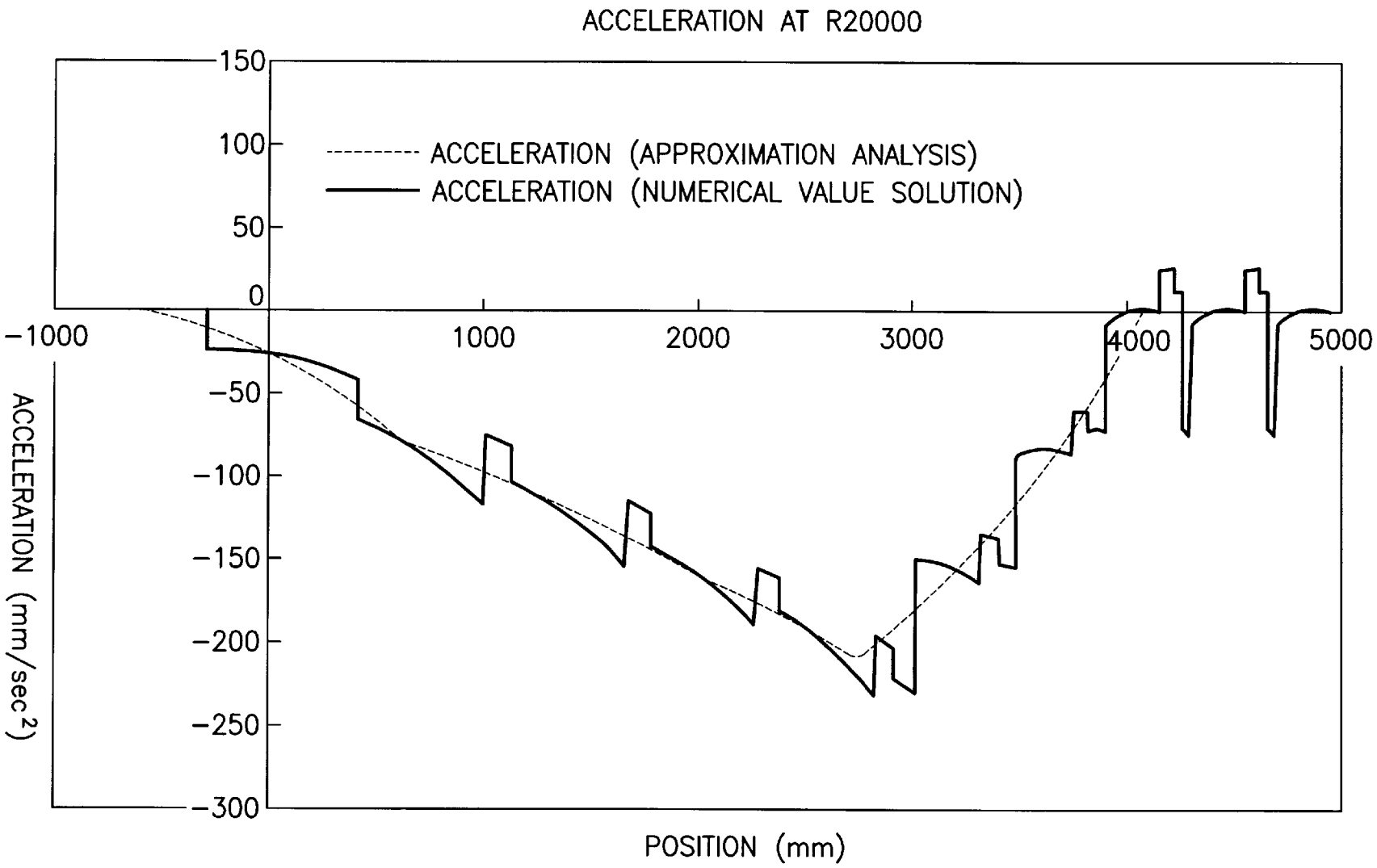
FIG. 11 is a graph of the acceleration of the palette relating to the present Invention (R20000)
Figure 12:
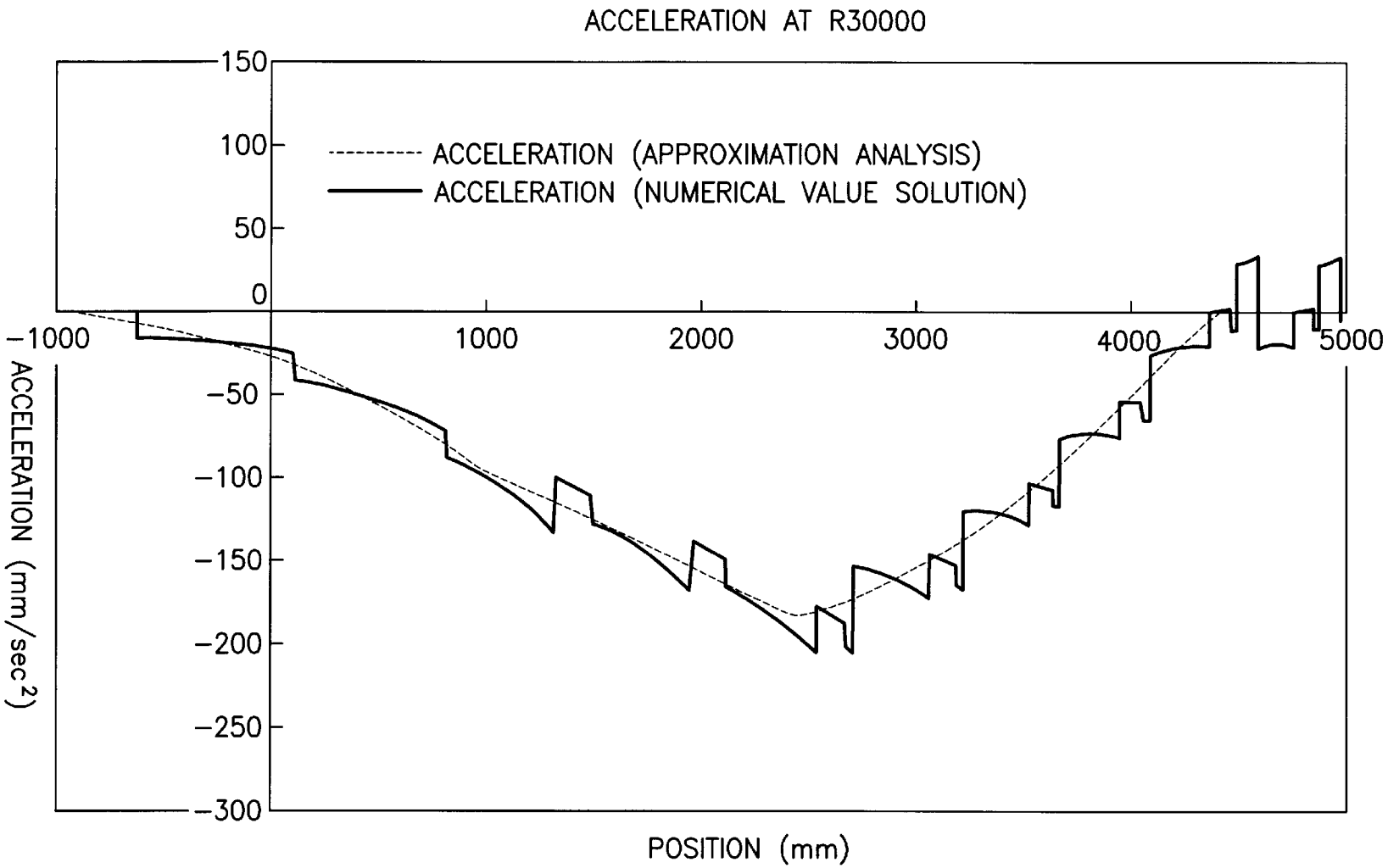
FIG. 12 is a graph of the acceleration of the palette relating to the present invention (R30000)

FIG. 10, FIG. 11, and FIG. 12 are graphs of the acceleration of the palettes. The speed $V_H$ of the palette in the high-speed zone is 1200 mm/s.

The solid line represents the acceleration (numerical value solution) of the palette obtained using Expression (6), and the broken line represents the acceleration (approximation analysis) of the palette obtained using Expression (3).

The dimensions of the guide link system are as follows: length GC of the acceleration/deceleration zone=3400 mm; guide form function value $G_H$ at the high-speed zone=54.3 mm; guide form function value $G_L$ at the low-speed zone=275.5 mm; and link length L=312.5 mm.

In FIG. 10, FIG. 11, and FIG. 12, R represents the acceleration of the palette at 10000 mm, 20000 mm, and 30000 mm. The numerical value solution vibrates (oscillates) with the approximation analysis as the offset thereof. The smaller R is, the greater the oscillation of the numerical value solution is. The greater R is, the smaller the maximum acceleration of the palette is, but the greater R is the greater the manufacturing cost is, so it is appropriate to set R=20000 mm from both perspectives of the maximum acceleration of the palettes and the manufacturing cost thereof.

Taking into consideration the guide optimal form function G*(X) at which the greatest acceleration of the palette is minimal, the guide optimal form function G*(X) is defined as being a guide form function wherein the acceleration of the palette is constant in the acceleration/deceleration zones. This is represented in the differentiation equation of the following Expression (7) and Expression (8), boundary conditions.

$$\frac{d\,a(G*(x))}{d\,x}=0 \tag{7}$$

$$G^*(GP1a)=G_L$$

$$G^*(GP2a)=G_H \tag{8}$$

G*(X) which is obtained from the aforementioned Expression (7) and Expression (8) is connected by $C^0$ class continuation at boundary points GP1*a* and GP2*a* with low-speed zone guide and high-speed zone guide, but is not connected by $C^1$ class continuation. This G*(X) cannot solve the numerical value solution of the acceleration of the palette in Expression (6).

Also, the offset component of the acceleration of the palette is of a matter reduced, but the oscillating component becomes very great, and consequently, the minimum value of the maximum acceleration of the palette becomes extremely great.

Accordingly, using a weak format differentiation equation expression instead of a strong format differentiation equation expression such as Expression (7) and Expression (8) for representing the guide optimal form function G*(X) yields the pan-function minimization problem of the following Expression (9) and Expression (10), boundary conditions.

$$\int_{GP1a}^{GP2a}\left(\frac{d\,a(G*(x))}{d\,x}\right)^2 d\,x \rightarrow \min \tag{9}$$

$$G^*(GP1a)=G_L$$

$$G^*(GP2a)=G_H$$

$$\frac{d}{d\,x}G*(GP1a)=0$$

$$\frac{d}{d\,x}G*(GP2a)=0 \tag{10}$$

Substituting Expression (3) into a(x) in Expression (9) yields the following Expression (11):

$$\frac{v_H^4}{4\left(\sqrt{L^2-G_H^2}+K/2\right)^4}\int_{GP1a}^{GP2a}\left(\frac{d^2}{d\,x^2}\left(G*(x)^2-K\sqrt{L^2-G(x)^2}\right)\right)^2 d\,x \rightarrow \min \tag{11}$$

Expression (11) is a definitive expression the same as a third order spline function, and thus Expression (12) holds, and G*(X) can be obtained:

$$G*(x)^2-K\sqrt{L^2-G(x)^2}=c_1+c_2x+\sum_{i=1}^{N}d_i|x-x^{(i)}|^3 \tag{12}$$

$$\sum_{i=1}^{N}d_i=0$$

$$\sum_{i=1}^{N}d_ix^{(i)}=0$$

In Expression (12), the right side of the first expression represents a third order spline function, $x^{(i)}$ represents the X coordinate of the control point of the guide optimal form function, and N represents the number of control points. Since the number of expression for boundary conditions in Expression (10) is four, four control points N is sufficient, but in order to further minimize the maximum acceleration of the palette the number of control points N will be increased to six, and the conditions of the following Expression (13) added to obtain a third order spline function.

$$\frac{d^2}{d\,x^2}\left(G*(GP1b)^2-K\sqrt{L^2-G*(GP1b)^2}\right)=0 \tag{13}$$

$$\frac{d^2}{d\,x^2}\left(G*(GP2b)^2-K\sqrt{L^2-G*(GP2b)^2}\right)=0$$

Also, the values of the control points are as shown in the following Expression (14):

$$\{x^{(1)}x^{(2)}x^{(3)}x^{(4)}x^{(5)}x^{(6)}\}=\{GP1a\ GP1\ GP1b\ GP2b\ GP2\ GP2a\} \tag{14}$$

Figure 13:
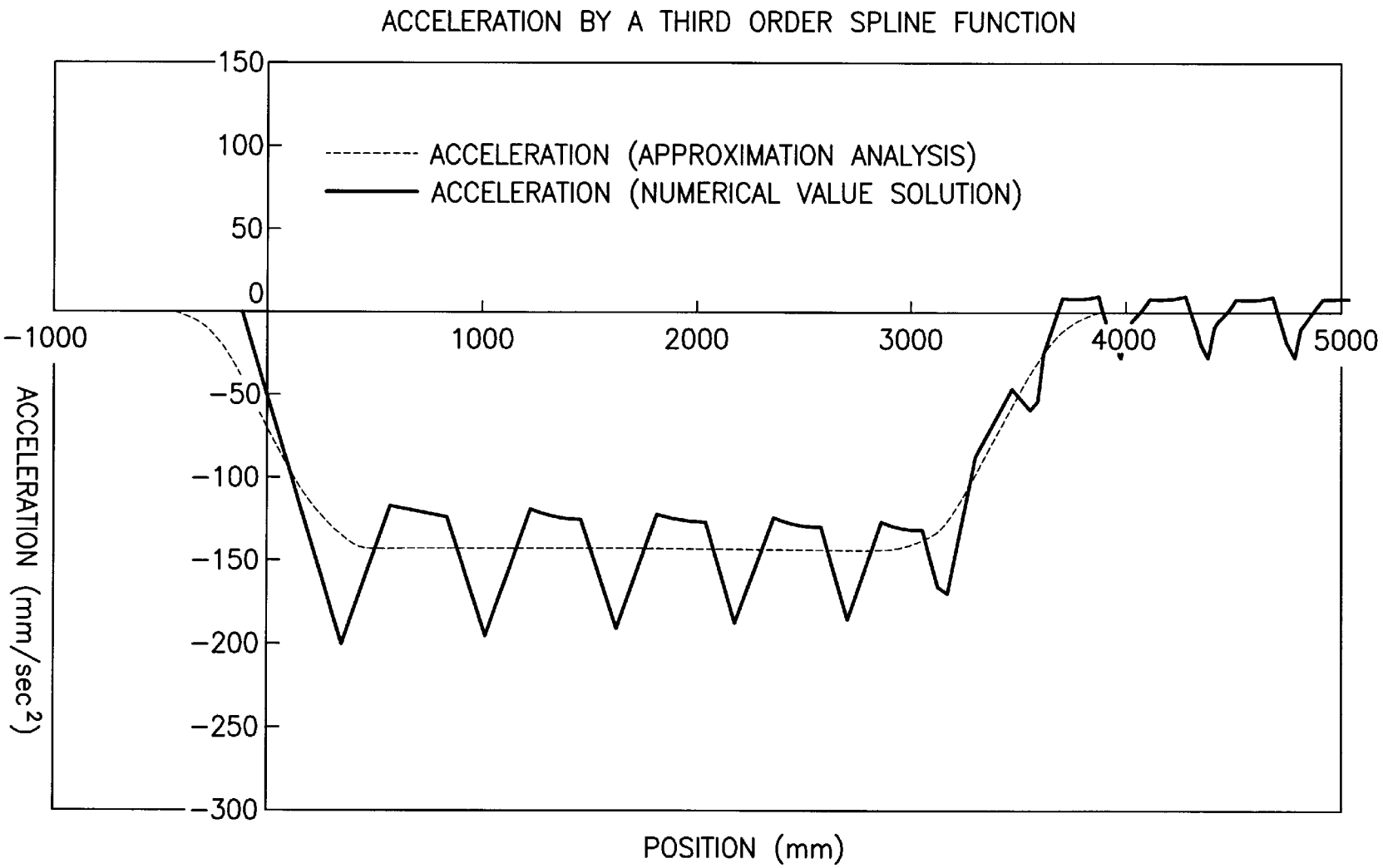
FIG. 13 is a graph of the acceleration of the palette relating to the present invention (third order spline function)

FIG. 13 is a graph representing the acceleration of the palettes. The speed $V_H$ of the palettes in the high-speed zone is 1200 mm/s.

In FIG. 13, the solid line represents the acceleration (numerical value solution) of the palettes obtained using Expression (6), and the broken line represents the acceleration (approximation analysis) of the palettes obtained using Expression (3).

The dimensions of the guide link system are as follows: GPIa=−500; GP1=0, GPIb=500, GP2*b*=2900; GP2=3400;GP2*a*=3900; guide form function value $G_H$ at the high-speed zone=54.3 mm; guide form function value $G_L$ at the low-speed zone=275.5 mm; and link length L=312.75 mm.

The approximation analysis is constant in the intermediate range of the acceleration/deceleration zones. The numerical value solution vibrates (oscillates) above and below the approximation analysis.

Based on the dimensions of the guide form, the one that corresponds with the acceleration graph of the palette in FIG. 13 is the acceleration graph of the palette in FIG. 11 (R 20000), and comparing FIG. 13 and FIG. 11, it can be understood that the acceleration of the palette in FIG. 13 is smaller.

Figure 14:
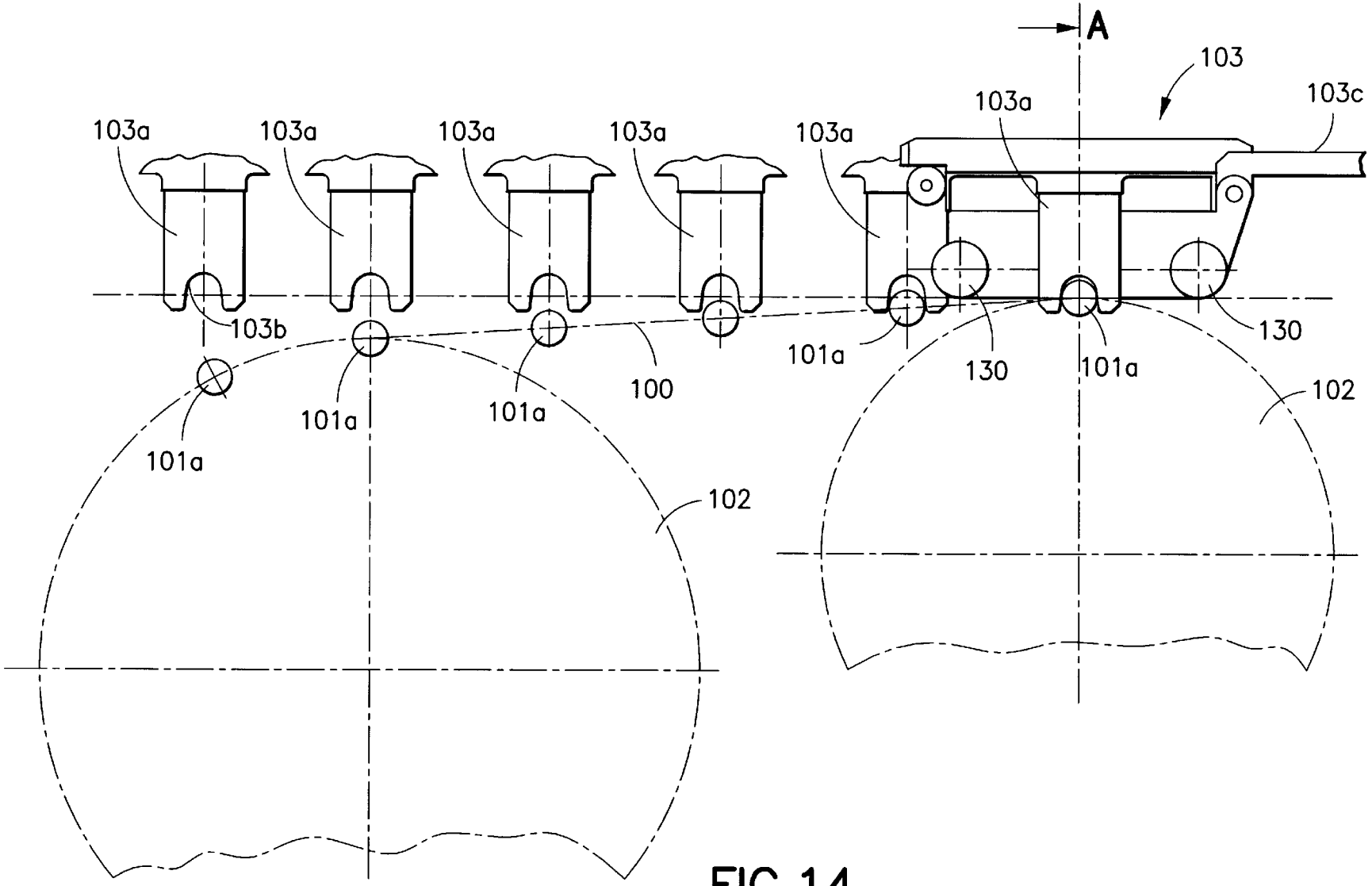
FIG. 14 is a partial enlarged side view illustrating the details of the driving mechanism of the palette in the high-speed zone S2 of the present invention.

FIG. 14 is a partial enlarged side view illustrating the details of the driving mechanism of the palettes 3 in the high-speed zone S2 of the present invention. Only one palette 3 is shown, and the return line high-speed zone S6 is inverted vertically.

In FIG. 14, the metal pieces la of the chain 101 sequentially engage the recessed portion 103*b* provided to the end of the engaging metal pieces 103*a* of the palettes 103 from the bottom, thereby driving the palettes 103 in the transporting direction. Accordingly, the aforementioned guide rails 107 and 107 are not present in the high-speed zones S2 and S6, the spacing in the transporting direction of the palettes 103 (transporting speed) is determined by the spacing of the metal pieces 101*a* of the aforementioned chain, and the driving force of the entire palette 103 is provided at this position.

Incidentally, 103*c* denotes comb teeth joined to the end portion of the palette 103, forming a bridging running board when the spacing of the palettes 103 is open.

Figure 15:
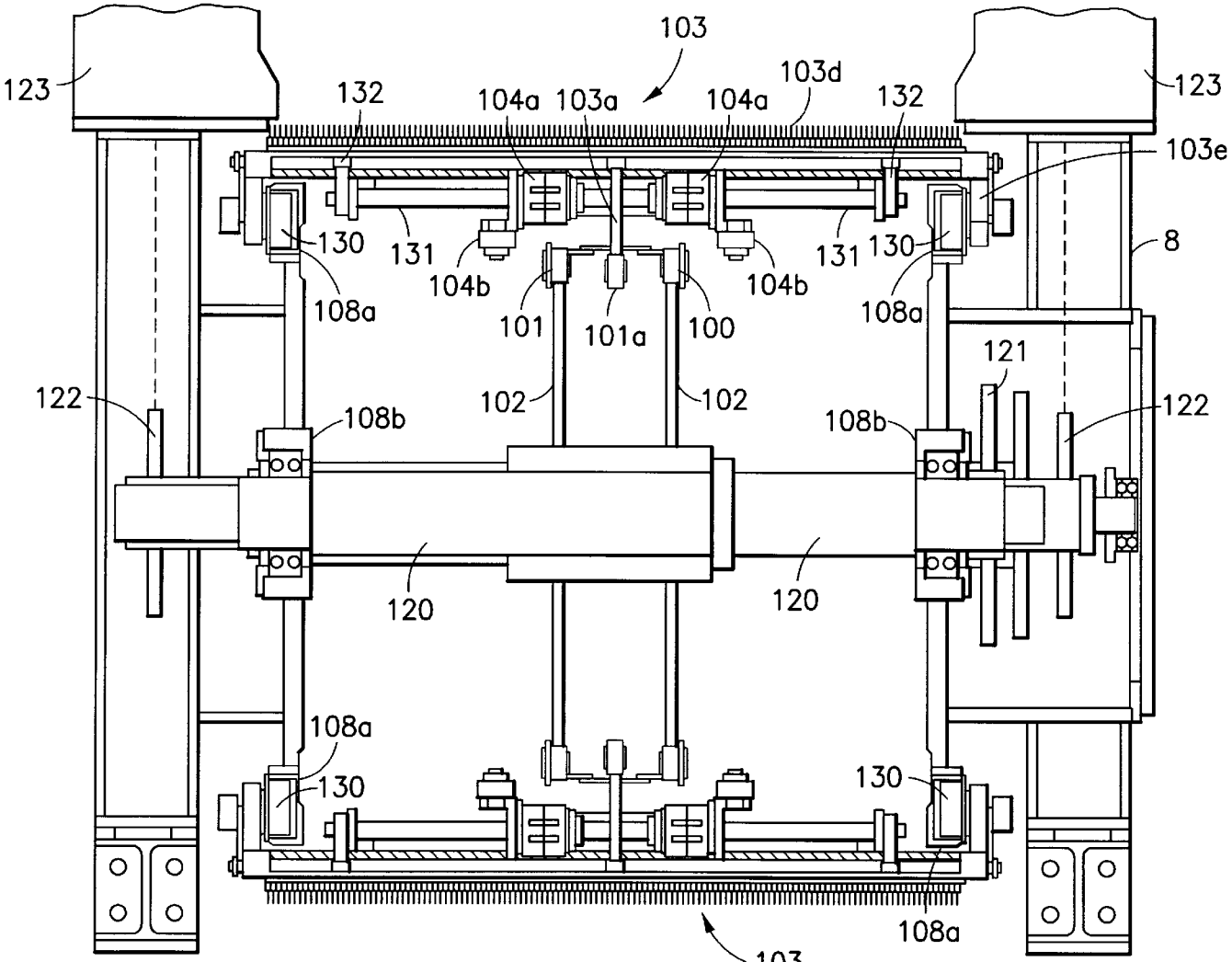
FIG. 15 is a transverse elevation view from an arrow A in FIG. 14.

FIG. 15 is a transverse elevation view from an arrow A in FIG. 14, the palette 103 being comprised of a running board 103*d* and frame 103*e,* with running rollers 130 being provided to both ends of the frame 103*e.*

Also, running rails 108*a* which are formed in a loop over the entire area of the transporting line and the return line are attached to the conveyer frame 108, so that the aforementioned running rollers roll over the running rails 108*a* and support the weight of the passengers and so forth.

A spline shaft 131 is attached to the rear of the palette 103 in the width direction orthogonal to the transporting direction, slide blocks 104*a* and 104*a* comprised of ball bearings and the like for joining the link 104 to the spline shaft 131 are provided, these slide blocks sliding over the spline shaft 131, and changing the opening angle of the links 4.

Provided below the aforementioned slide blocks 104*a* and 104*a* are guide rollers 4*b* and 4*b* which move restricted by the aforementioned guide rails 107 and 107, but these slide blocks move in the high speed zones S2 and S6 without being restricted.

Also, the aforementioned chain sprocket 102 is attached to the shaft 120, and the shaft 120 is supported by the bearings 108*b* and 108*b* of the conveyer frame 108.

Also, 121 is a force transmitting sprocket for transmitting force from a motor (not shown), 122 is a force transmitting sprocket for transmitting force to a variable-speed handrail (not shown) within the railing 123, and the bottom side of FIG. 15 indicates the return side of the palette 103.

Figure 16:
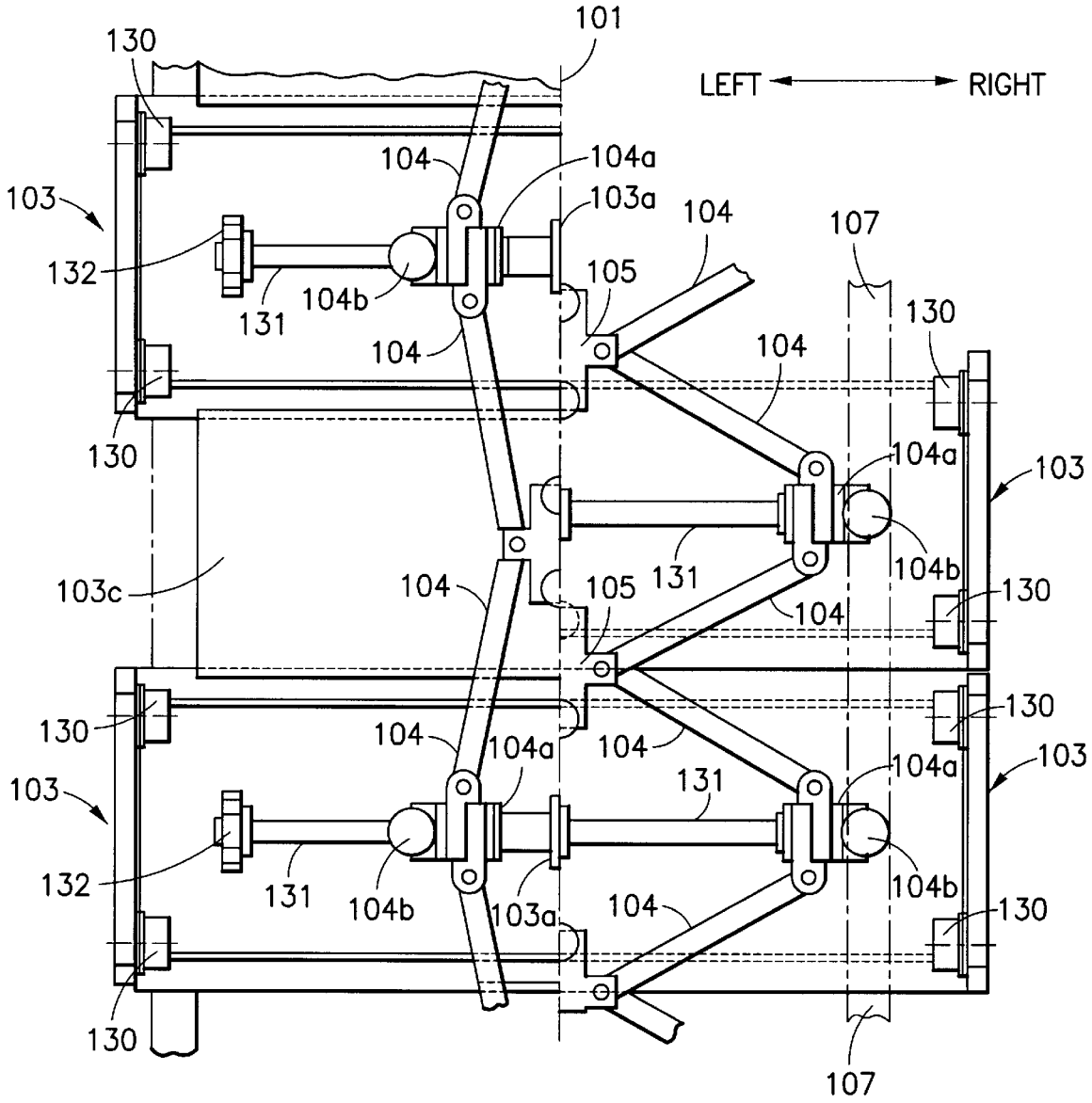
FIG. 16 is a bottom view of the attachment structure of the palette and link of the present invention as viewed from the rear side of the palette.

FIG. 16 is a bottom view of the attachment structure of the aforementioned palette 103 and link 104 of the present invention as viewed from the rear side of the palette 104.

In FIG. 16, 103 denotes palettes and 130 and 130 are running rollers. The right half of the Figure illustrates the state wherein the guide roller 104*b* slides along the spline shaft 131 due to restriction by the guide rail 107 and is moved toward the outside, making the opening angle of the links 104 to be acute, and bringing the palettes 103 into close proximity in the acceleration zones S1 and S5 and the deceleration zones S3 and S7 shown in FIG. 7.

Also, the palettes 103 are driven by the chain 101 and metal pieces 101*a* shown in FIG. 14 while the metal pieces 101*a* engage the recessed portion 103*b* of the engaging metal piece 103*a* of the palettes in the high-speed zones S2 and S6. the left half of the Figures illustrates the state wherein the guide roller 104*b* slides along the spline shaft 131 and is moved toward the inside by means of the palettes being separated, making the opening angle of the links 104 to be obtuse in the high-speed zones S2 and S6.

132 denotes a bearing for the spline shaft 131, and 103*c* denotes comb teeth forming the running board between the palettes 103 and 103.

Also, in the high-speed zones S2 and S6, width determining material (not shown) may be provided separately, in order to prevent margin of error of movement of the guide rollers 104*b* outwards.

Figure 17:
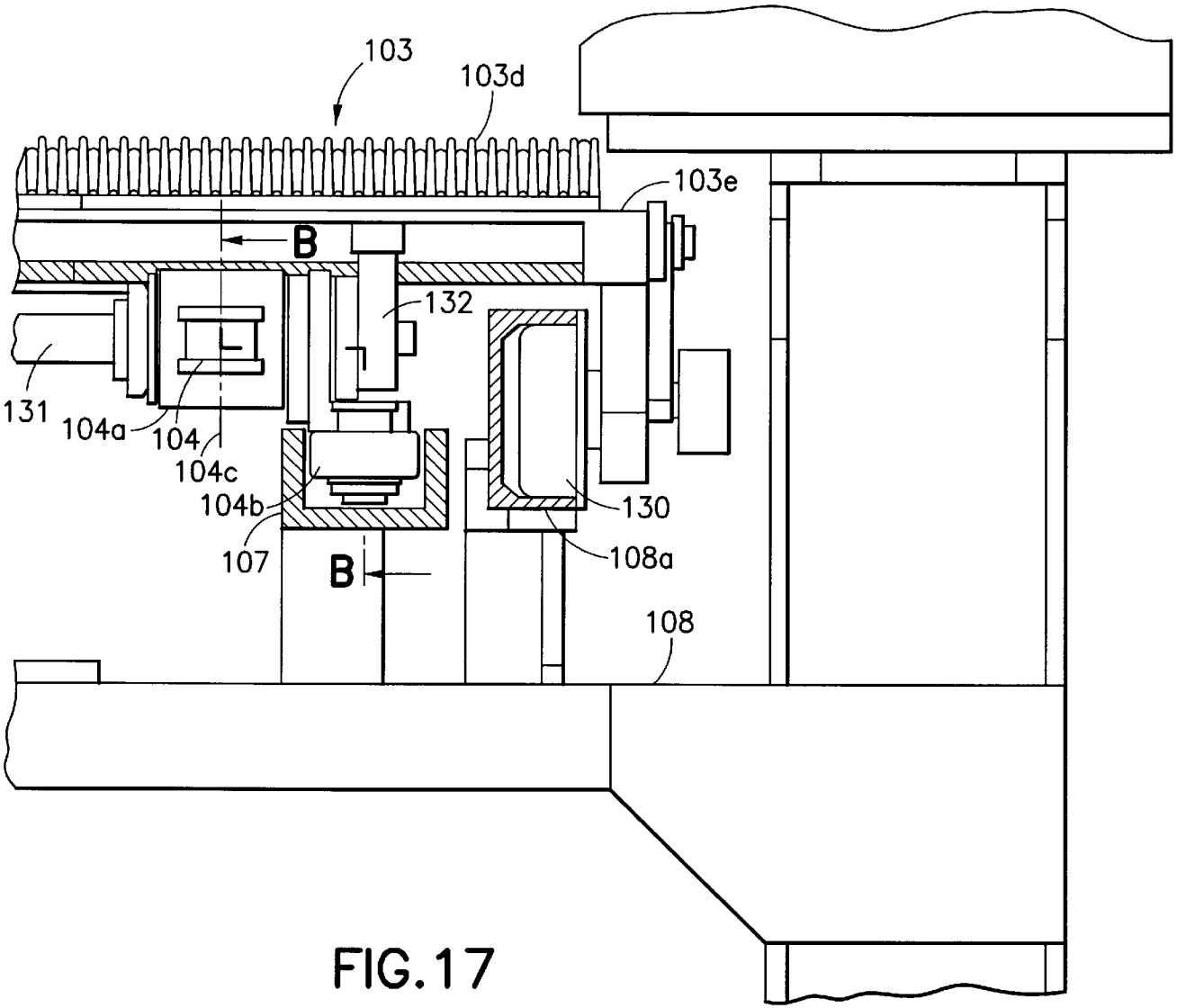
FIG. 17 is a partial cross sectional view of the passenger conveyer in the acceleration zone S1 and deceleration zone S3 of the present invention.

FIG. 17 is a partial cross sectional view of the passenger conveyer in the acceleration zones S1 and S5 and the deceleration zones S3 and S7 in FIG. 7 of the present invention, wherein running rollers 130 provided to the side of the palette 103 comprised of the running board 103*d* and frame 103*e* roll over running rails 108*a* formed on the conveyer frame 108, guide rails 107 provided to the conveyer frame, and guide rollers 104*b* fit into the guide rails 107, so that the guide rollers 104*b* are integral with the slide blocks 104*a* sliding over the spline shaft 131 provided in the width direction of the palette 103.

Incidentally, 132 is a bearing for the spline shaft 131, and is fixed to the frame 103*e* to the rear of the palette 103. 104 denotes a link axially borne by a vertical shaft 104*c*.

Figure 18:
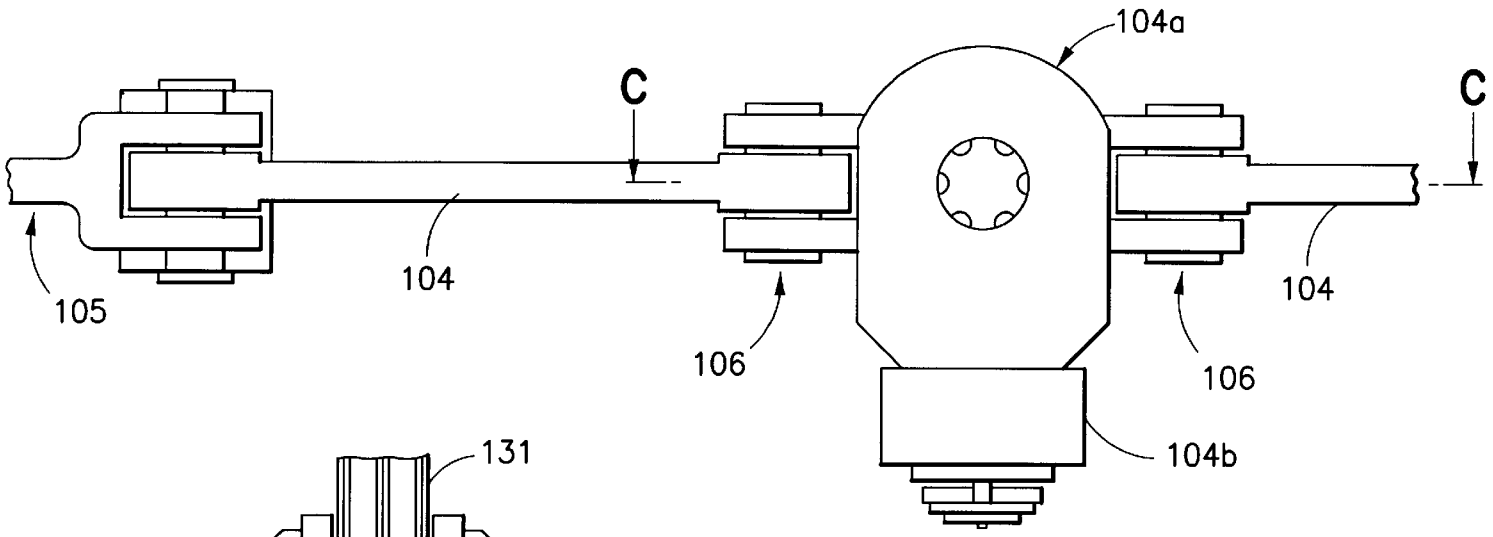
FIG. 18 is a cross sectional view taken along B—B in FIG. 17.

FIG. 18 is a cross-sectional view taken along B—B in FIG. 17, wherein the links 104 and 104 are supported by the joint 106 so as to be horizontally rotatably supported to the side to the slide blocks 104*a,* and the other end of the link 104 is axially supported by the link 104 extending from the neighboring palette 103 and the intermediate link 105.

Incidentally, guide rollers 104*b* are axially supported at the bottom of the slide blocks 104*a*.

Figure 19:
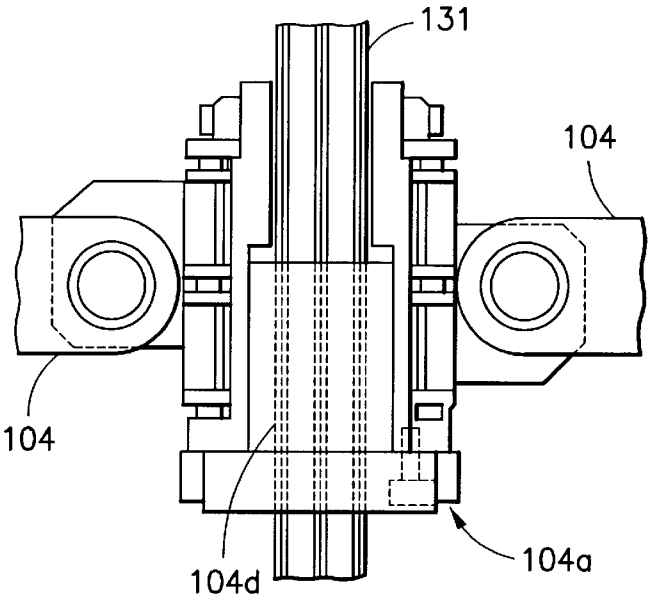
FIG. 19 is a cross sectional view taken along C—C in FIG. 18.

FIG. 19 is a cross sectional view taken along C—C in FIG. 18, showing the structure wherein slide blocks 104*a* are fit to the spline shafts 31 provided in the width direction of the palette 103, and ball bearings 4*d* are provided to the slide blocks 104*a,* so that smooth movement can be carried out to the spline shaft 131.

Figure 20:
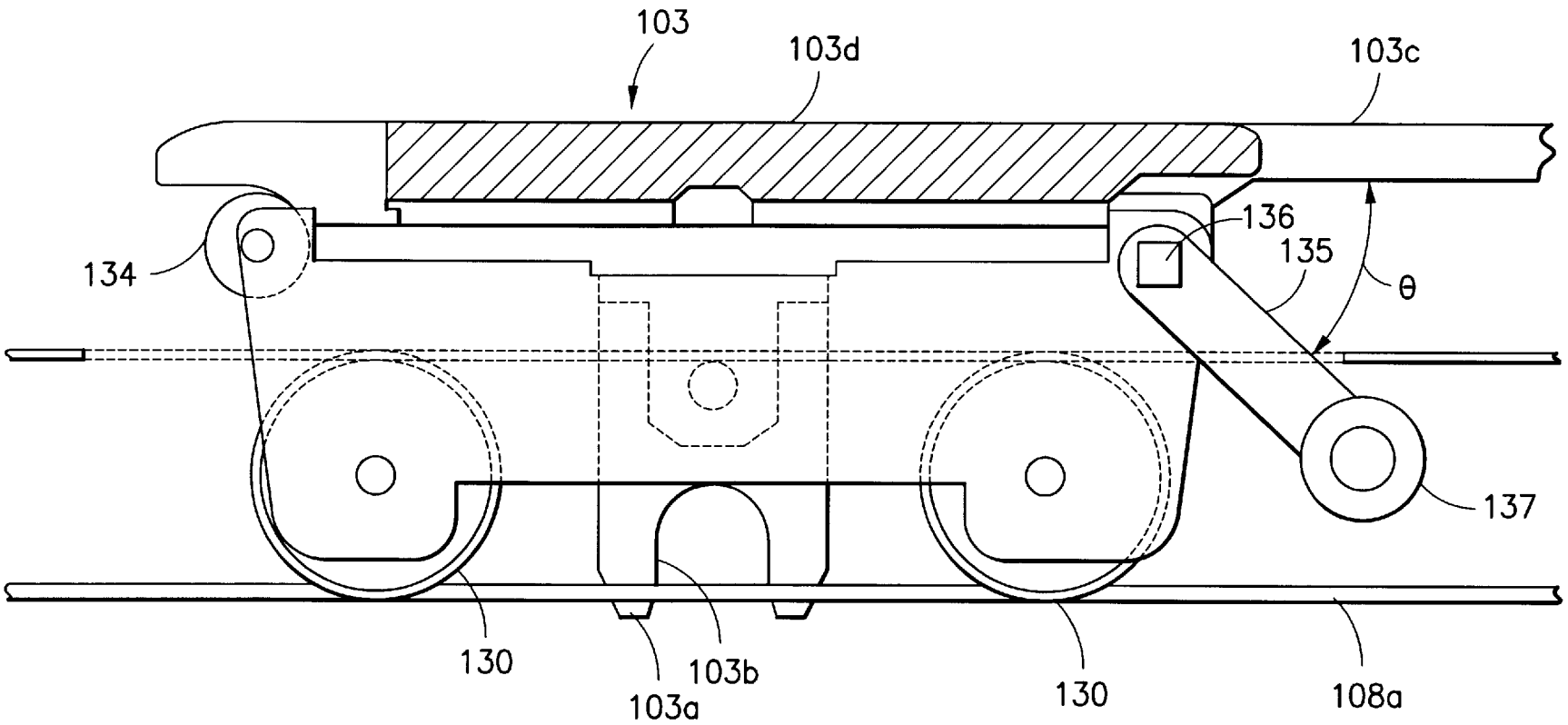
FIG. 20 is a side view of a palette according to the present invention.

FIG. 20 is a partial side view of the palette 103 according to the present invention.

In FIG. 20, 103*c* denotes comb teeth, 103*d* is a running board and running rollers 130 and 130 being provided to both sides of the bottom and the front and rear of the bottom, these running rollers rolling on the running rails 108*a*. Further, a roller 134 is provided to the upper rear portion of the palette 103 so that the comb teeth of the rear adjacent palette smoothly engages the fixed comb teeth of the running board 103*d*.

Also, guide arms 135 are provided integrally to both sides of the aforementioned comb teeth 103*c* with a certain angle θ, so as to rotate the shaft 136 as a central shaft, and further, rollers 137 are provided to the tips of the aforementioned guide arms 135.

The aforementioned guide arms 135 and rollers 137 are for preventing jutting of the comb teeth 103*c* upon inversion of the palette 103.

Figure 21:
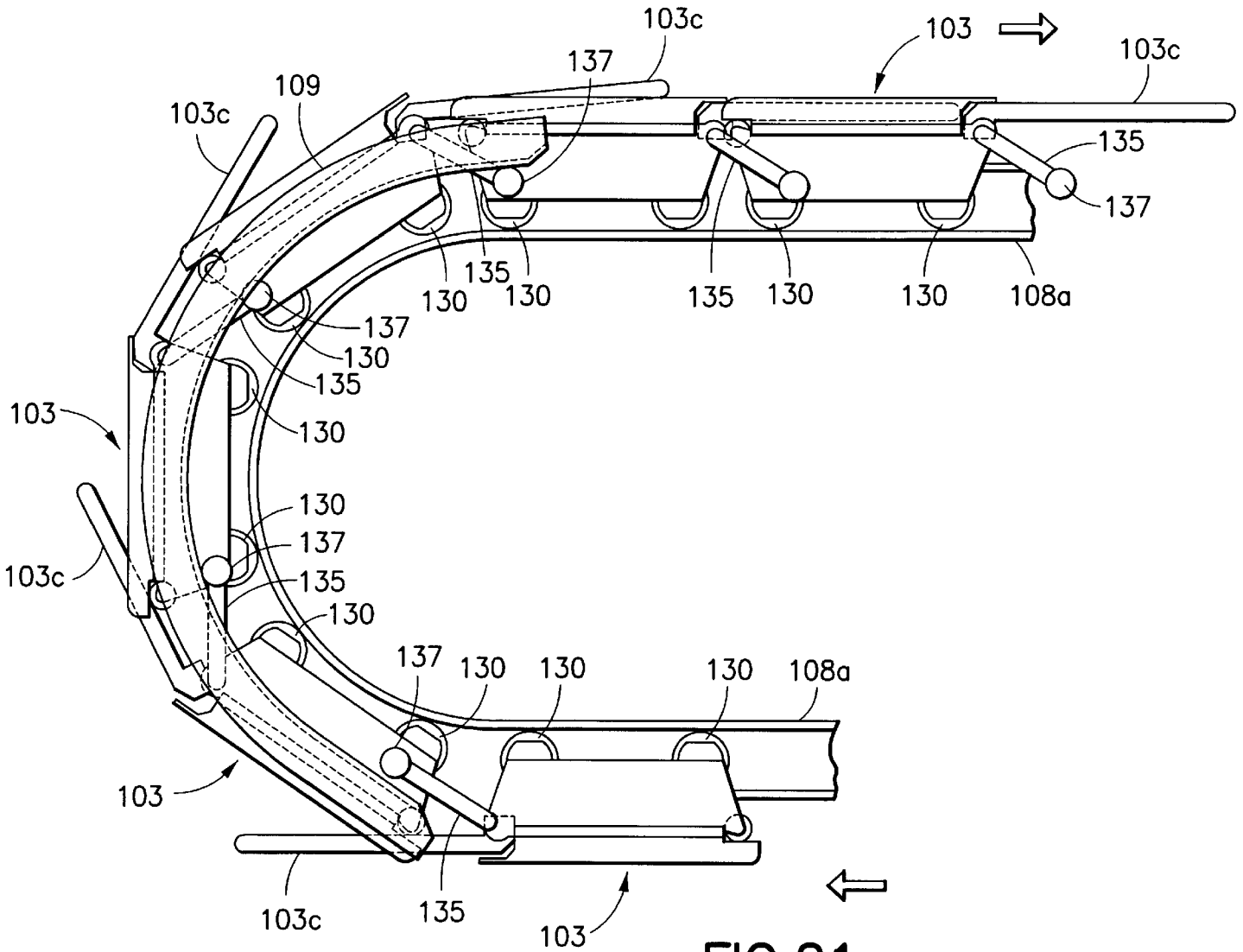
FIG. 21 is a side view illustrating the operation state when the palette according to the present invention is inverted.

FIG. 21 is a side view illustrating the operation state when the palette 103 according to the present invention is inverted.

In FIG. 21, in the event that the palette 103 has moved in the direction shown by the arrow, the comb teeth 103*c* attempt to fly outwards as the lower palette 103 heads upwards, but a guard rail 109 is provided, so the roller 137 at the tip of the aforementioned guide arm 135 comes into contact and is restricted, so that the comb teeth 103*c* do not fly outwards more than a certain amount.

Figure 22:
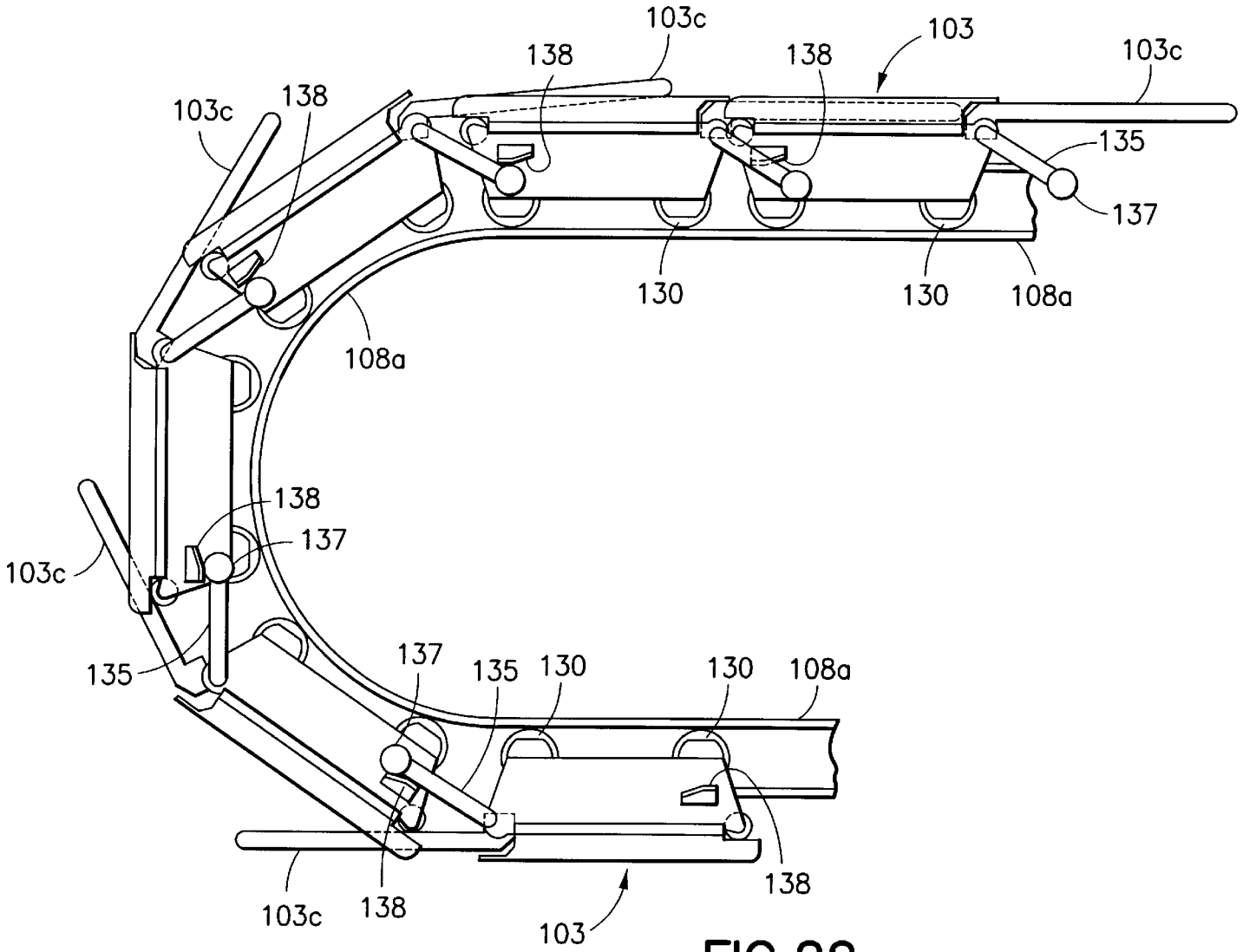
FIG. 22 is a side view showing the operation state of another embodiment according to the present invention of means for preventing comb teeth from flying outwards.

FIG. 22 is a side view showing the operation state of another embodiment of means for preventing comb teeth 103*c* according to the present invention from flying outwards, in which a stopper 138 is provided to the real side of each palette 103, so that the roller 137 at the tip of the aforementioned guide arm 135 formed integrally with the comb teeth 103*c* comes into contact and is restricted, thus preventing the comb teeth 103*c* from flying outwards.

Incidentally, the means for preventing the comb teeth 103*c* of the palette 103 from flying outwards according to the embodiments as shown in FIG. 21 and FIG. 22 are not restricted to variable-speed passenger conveyers, but can also be applied to conventional-type passenger conveyers wherein the conveyer moves from the boarding end to the disembarking end at a constant speed, and also, the driving means is not restricted to the aforementioned embodiment.

Figure 23:
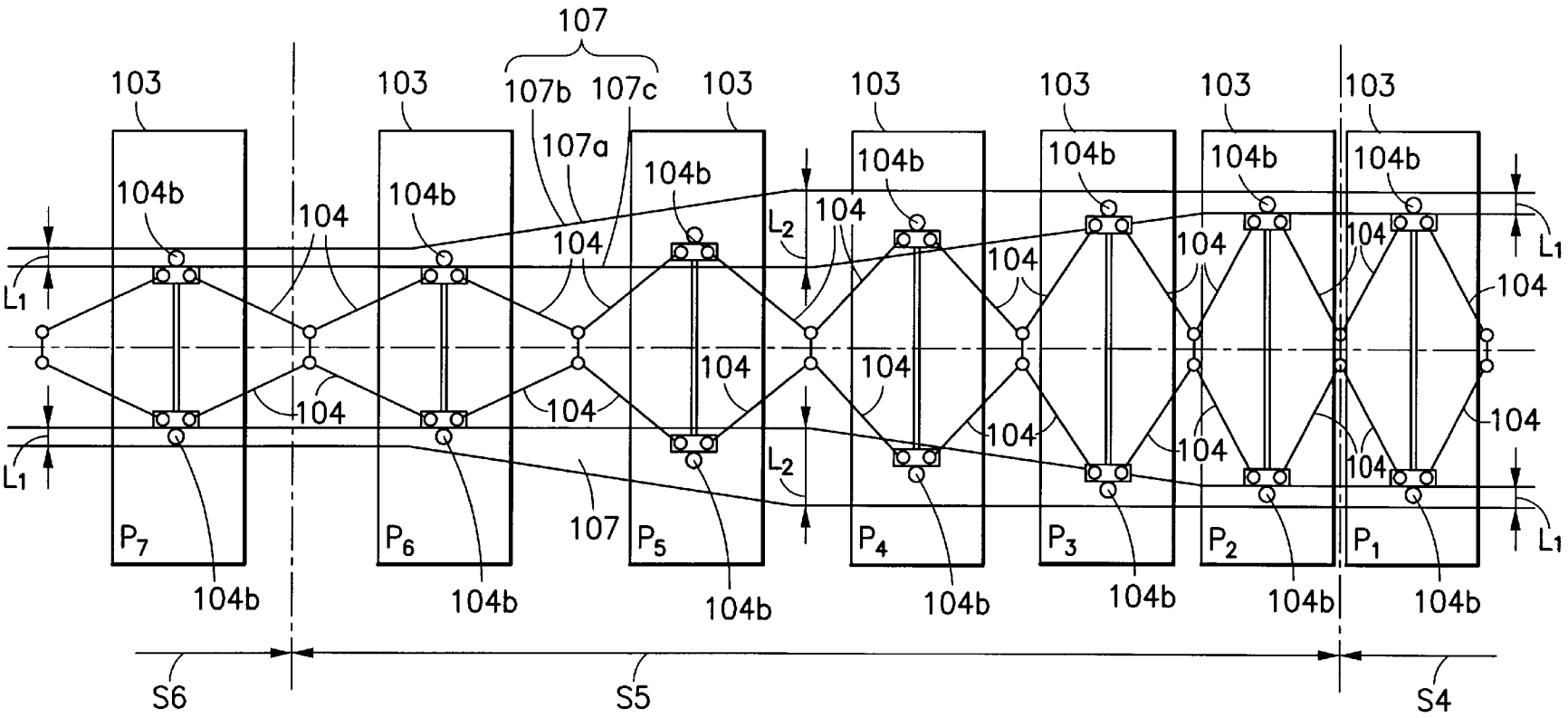
FIG. 23 is a bottom view from the rear of the palette illustrating an embodiment of the link adjusting mechanism according to the present invention.

FIG. 23 shows an embodiment of the link adjusting mechanism according to the present embodiment, and is a bottom view from the rear of the palette 103.

The link adjusting mechanism is provided to S5 (acceleration zone) or S7 (deceleration zone) in FIG. 7, with the Figure showing adjusting means of the link 104 system in S5 (acceleration zone).

That is, "play" is provided in the width direction of the guide roller 104*b* by means of changing the spacing that the guide roller 104*b* moves within the guide rails 107 and 107 from $L_1$ to $L_2$ (the spacing between the side wall 107*b* and side wall 107*c*). Accordingly, the passage path of the guide roller 104*b* within the guide rail 107 changes, i.e., the spacing of the palettes controlled by the positions of the guide rollers 104*b* in the width direction changes, and consequently the link length of the link 104 system is adjusted.

Employing such means facilitates ease of adjusting the engaging timing with the palette 103 in S6 (high-speed zone) as to the pulsating to the link length of the link 104 system in the section from disengaging the chain in S2 (high-speed zone) to re-engaging the chain in S6 (high-speed zone), and also, the link length of the link system during operation is automatically adjusted, so that transporting is performed smoothly.

Also, in the assembly of the variable-speed conveyer according to the present invention, it is possible to absorb the margin of error between the link length of a link system designed based on an ideal guide rail position and a link length determined by the position of the guide rail actually installed when assembling.

As shown in FIG. 23, the channel width of the guide rails 107 forms a "play section" which expands from $L_1$ to $L_2$ in the deceleration zone S5 which extends from the high speed zone S6 to the low-speed zone S4, and the returns to $L_1$.

The length of the section of play $S_a$ is calculated by the full circumference margin of error $\Delta L_{12345678}$ of the palette 103 in each of the zones S1, S2, S3, S4, S5, S6, S7, and S8 (converted as the full-circumference margin of error in the high-speed zone) being obtained by calculating the amount of wobble of the guide roller 104*b* and width $L_1$ of the guide rails 107 and obtain the length of the section of play $S_a$ from this amount of wobble using Expression (4).

A certain length of section of play $S_a$ is decided upon beforehand, and the leeway of adjustment $\Delta L_a$ of the palette 103 generated in each of the play zones S5 and S7 (converted as the leeway of adjustment in the high-speed zone) is obtained by calculating the amount of wobble of the guide roller and width $L_2$ of the guide rails 107 and is obtained from this amount of wobble using Expression (4).

The leeway of adjustment $\Delta L_a$ of the palette 103 is obtained while changing the length of the section of play $S_a$. The full circumference margin of error $\Delta L_{12345678}$ of the palette 103 is multiplied by a safety ratio S to yield the full circumference margin of error $\Delta L$ of the palette 103. If the length of the section of play $S_a$ is such that the following Expression (15) holds, this means that there is sufficient leeway in the play section.

$$\Delta L_a(S_a) \subset \Delta L \tag{15}$$

The present invention is as described above, and has the following advantages:

(1) The structure is simple, and the amount of extraction of the comb teeth to the floor can be reduced at the time of inversion of the palettes, meaning that the space occupied by the under-floor structure can be reduced, and also, the margin of error of the floor surface and the palette surface can be set low, and facility costs are low.

(2) The construction is of rhombic form rigid links, so the palette spacing can be set with good precision even in the event that the degree or direction of load changes, and the comfort of ride is not deteriorated.

(3) The guide rail is a smooth curve, meaning that the acceleration of the palette can be reduced to a low level, and the passengers on the palettes are not subjected to discomfort at the time of acceleration.

(4) Means for adjusting the link length are provided, so initial adjustment of the link system is easy, and even in the event that the link length stretches or shrinks during operation, adjustment is automatically made within the section, so stable operation can be conducted, and special maintenance work is not necessary.

Next, a handrail device for a variable-speed passenger conveyer according to the present invention will be described. Description of an embodiment of the first handrail device will be made with reference to the drawings.

Figure 24:
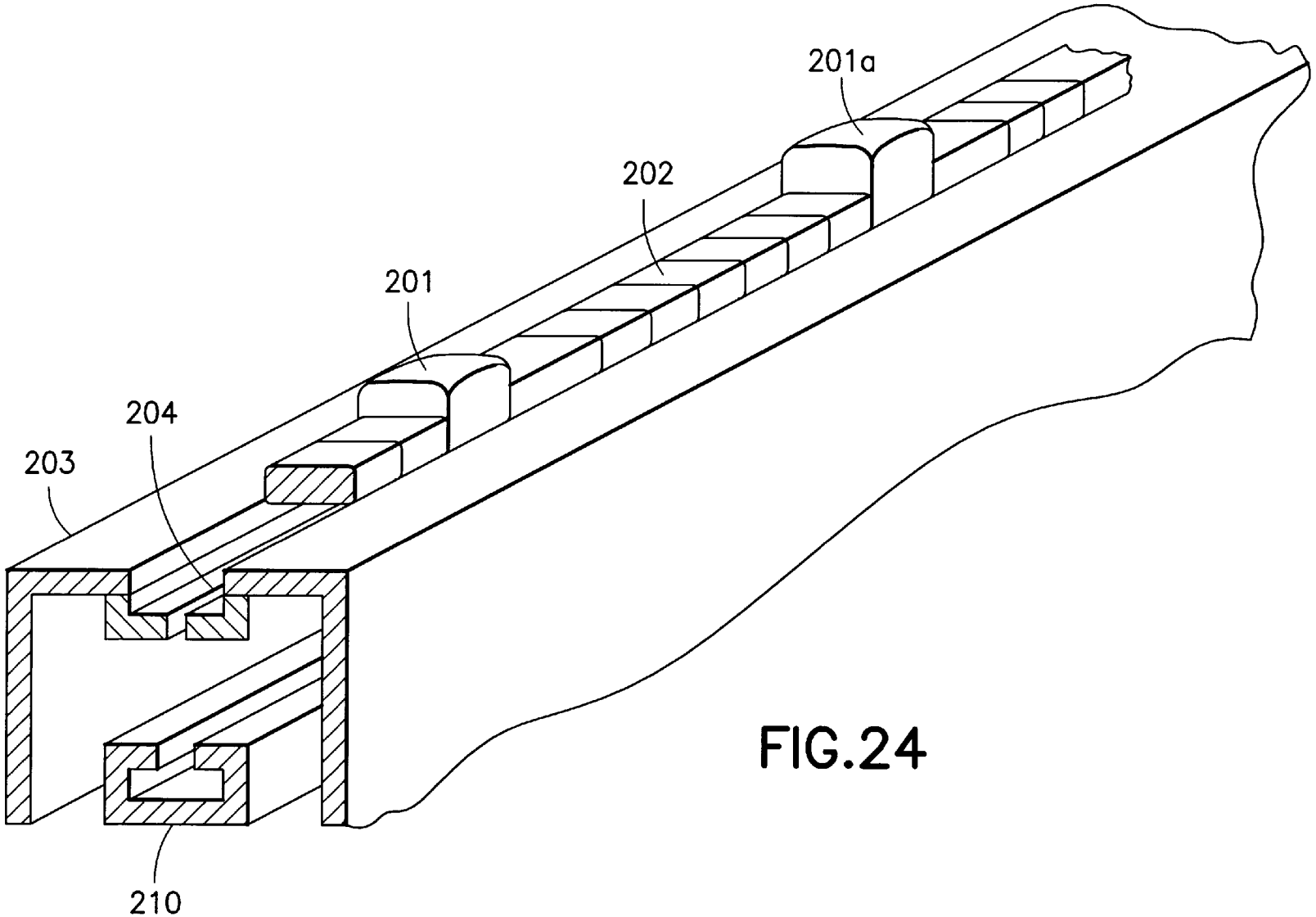
FIG. 24 is a perspective view of the handrail device of the variable-speed passenger conveyer according to the present invention.

FIG. 24 is a perspective view of the handrail device for a variable-speed passenger conveyer according to the present invention, wherein 201 denotes a plurality of handrail pieces, said plurality of handrail pieces 201 moving within a slit 204 between a neighboring handrail piece 201*a* and a cover 203, such that the spacing thereof narrows at low speeds near the boarding and disembarking ends, and such that the spacing thereof widens at high speeds in the high speed zone.

The aforementioned plurality of handrail pieces 201 are mutually connected with a stretching linking member 202 in order to prevent opening of the slit 204.

Figure 25:
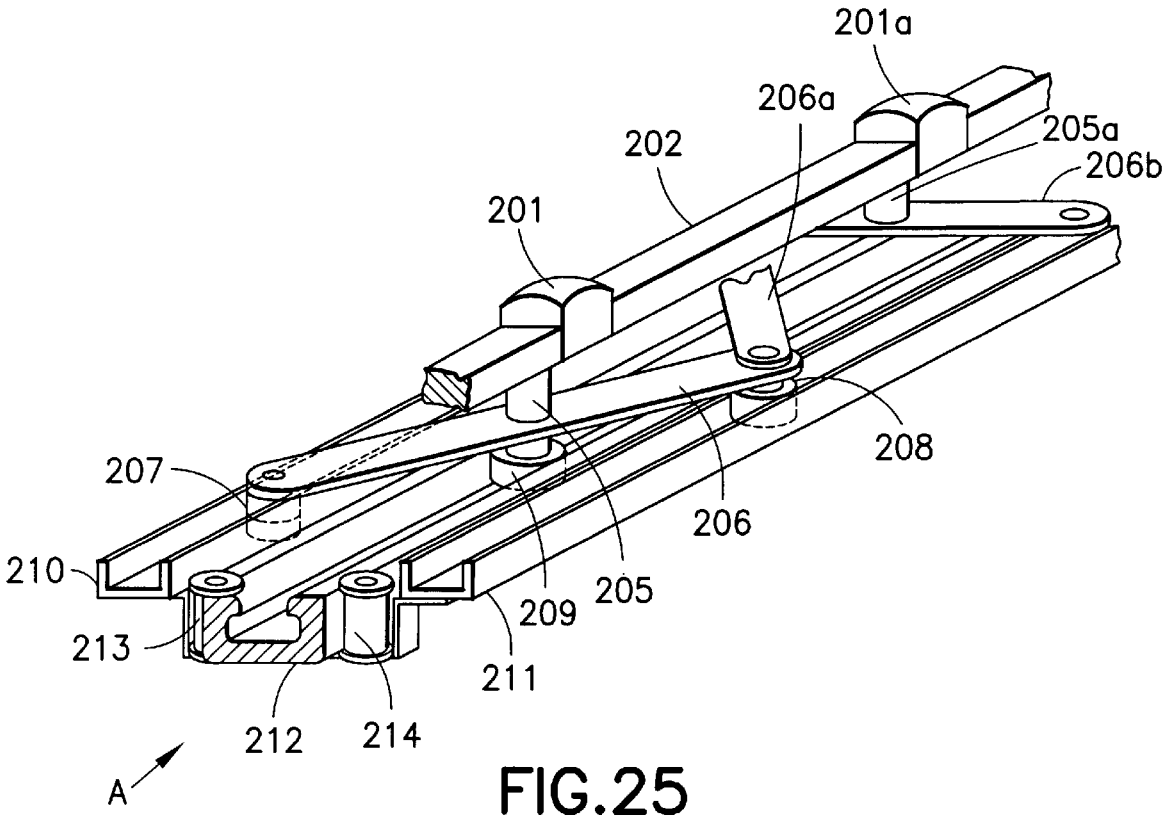
FIG. 25 is a perspective view illustrating the relation between the handrail device of the variable-speed passenger conveyer and the link mechanism according to the present invention.
Figure 26:
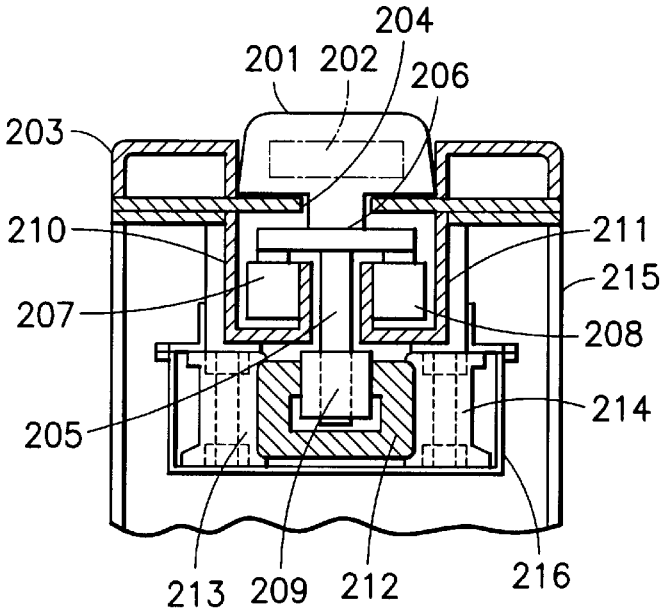
FIG. 26 is a transverse elevation view from an arrow A in FIG. 25.

FIG. 25 is a perspective view illustrating the relation between the handrail device of the variable-speed passenger conveyer and the link mechanism according to the present invention, FIG. 26 being a traverse elevation view from an arrow A in FIG. 25.

In FIG. 25 and FIG. 26, the aforementioned handrail piece 201 is attached to a shaft 205, with a lever 206 fit in an intermediate portion, and guide rollers 207 and 208 being provided to both end of the lever 206. also, a driving roller 209 is axially supported to the lower portion of the aforementioned shaft 205.

The aforementioned lever 206 is pin-linked to a lever 206*b* fit to the shaft 205*a* of the neighboring handrail piece 201*a,* via an intermediate lever 206*a*.

210 and 211 are guide rails for guiding the guide rollers 207 and 208 of the aforementioned lever 206. Incidentally, there are similar guide rollers at the end portions of the neighboring levers 206*a,* 206*b,* and so forth, these being guided by the aforementioned guide rails 210 and 211.

212 denotes a driving belt with a concave cross-section which is either endlessly wound on the transporting path or which is divided and provided separately for the boarding and disembarking ends and the intermediate portion (high-speed zone). The driving rollers 209 of the aforementioned shafts 205*a,* 205*b,* and so forth fitting into the recessed groove of the driving belt 212. Accordingly, when the driving belt is driven in the forward direction, the driving rollers 209 are also moved by the force of friction with the recessed groove of the driving belt 212, thereby moving the handrail pieces 201, 201*a,* and so forth.

213 and 214 are guide rollers for the driving belt 212, and 215 and 216 are frames.

The aforementioned cover 203 is provided with the formation of a slot 204 through which the shaft 205 of the handrail piece 201 passes in the forward direction, and the aforementioned stretching linking member 202 closes off this slit 204 so as to prevent foreign objects from falling through.

Figure 27:
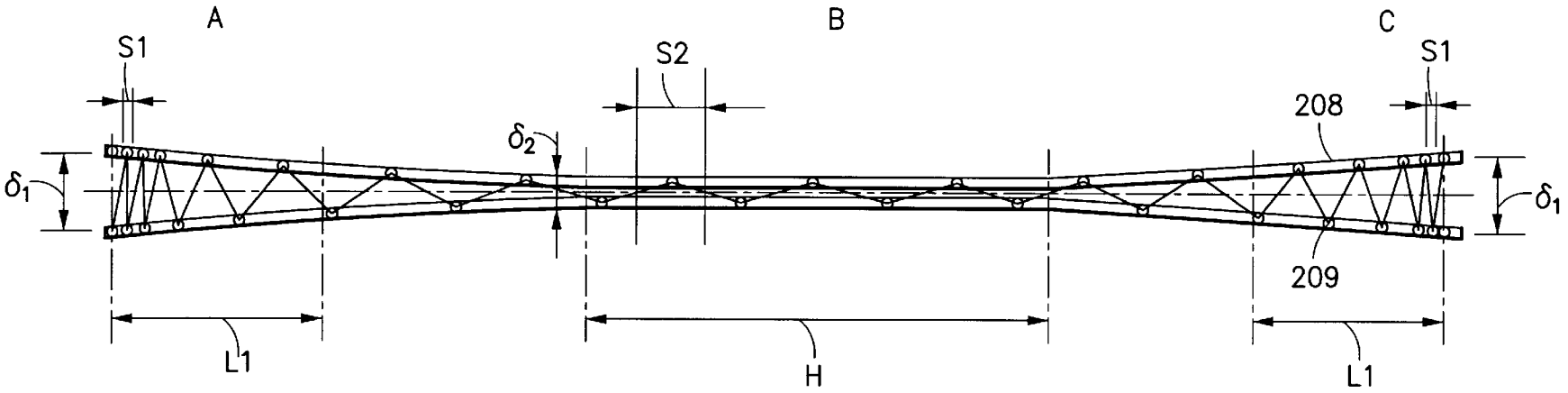
FIG. 27 is a plan view illustrating the relation between the guide rail for acceleration and deceleration of the handrail, and the link mechanism.

FIG. 27 is a plan view illustrating the endless guide rails 210 and 211 for providing the handrail pieces 201 with variable speed, wherein the spacing δ of the guide rails 210 and 211 is set to narrow step by step from $\delta_1$ to $\delta_2$, in order to make the transporting zone such that there is an acceleration zone $L_1$ for accelerating from low speed to high speed, this zone reaching from the boarding end A to the high-speed zone B, so that the spacing δ of the guide rails 210 maintains a constant spacing $\delta_2$ through the high-speed zone H of the intermediate portion B, and wherein the spacing δ of the guide rails 210 and 211 is set to widen step by step to $\delta_1$ in order decelerate from high speed to the disembarking end C.

Accordingly, since the plurality of levers 206 are pin-linked on both ends thereof, the spacing of the shafts changes from S1 to S2 back to S1, along the way of the boarding end A, intermediate portion B, and disembarking end C, according to the change in spacing between the guide rails 210 and 211. This amount of change constitutes the change in transportation speed of the handrail pieces 201.

The means for changing the speed of the handrail pieces 201 needs not be particularly restricted to the above-described; rather, other means may be used instead.

Figure 28:
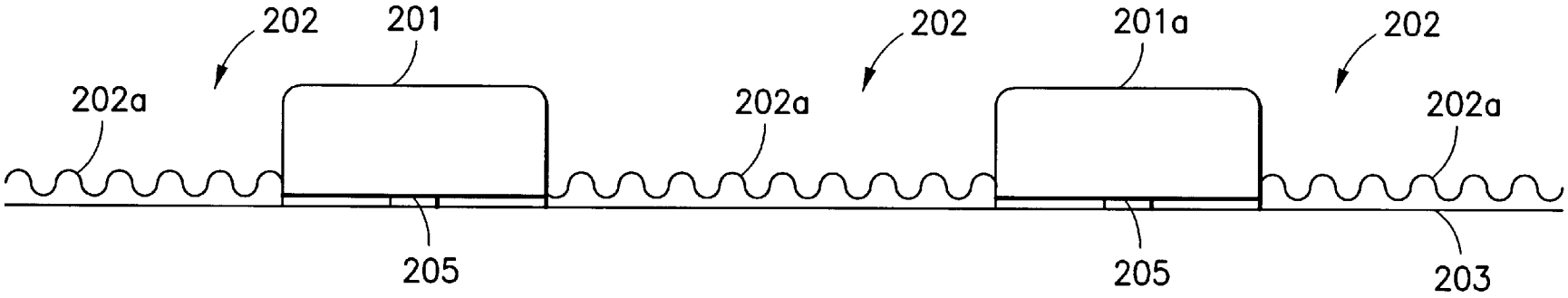
FIG. 28 is a side sectional view of the stretching linking member in the first embodiment according to the present invention, in the low-speed zone.
Figure 29:
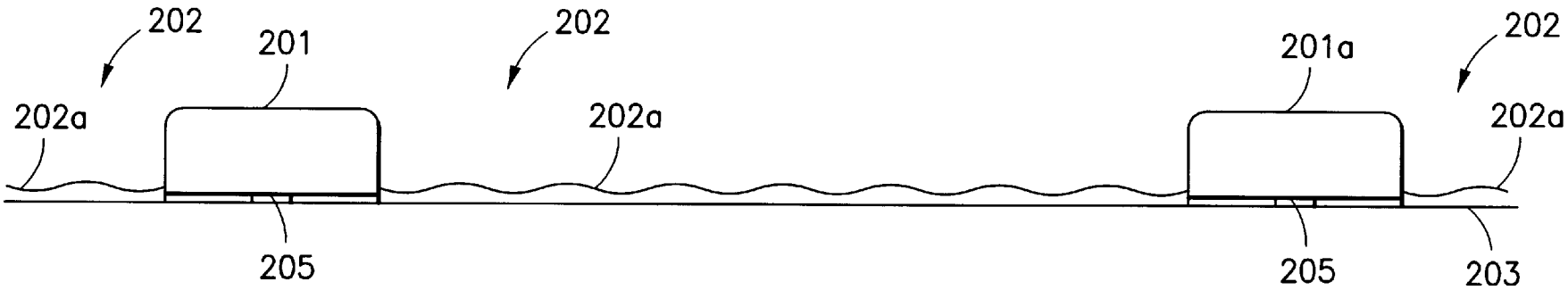
FIG. 29 is a side sectional view of the stretching linking member in the first embodiment according to the present invention, in the high-speed zone.

FIG. 28 and FIG. 29 are side sectional view illustrating a first embodiment of the stretching linking member according to the present embodiment, the form being shown illustrating an arrangement wherein accordion bellows-like formation 202*a* has been used for covering the slit 204 between the aforementioned plurality of handrail pieces 201, FIG. 28 illustrating the state in which the handrails 201 are in close proximity due to a state of being in the low-speed zone and thus compressing the accordion bellows 202*a,* and FIG. 29 illustrating the state in which the handrails 201 are distanced due to a state of being in the high-speed zone, and thus expanding the accordion bellows 202*a.*

Figure 30:
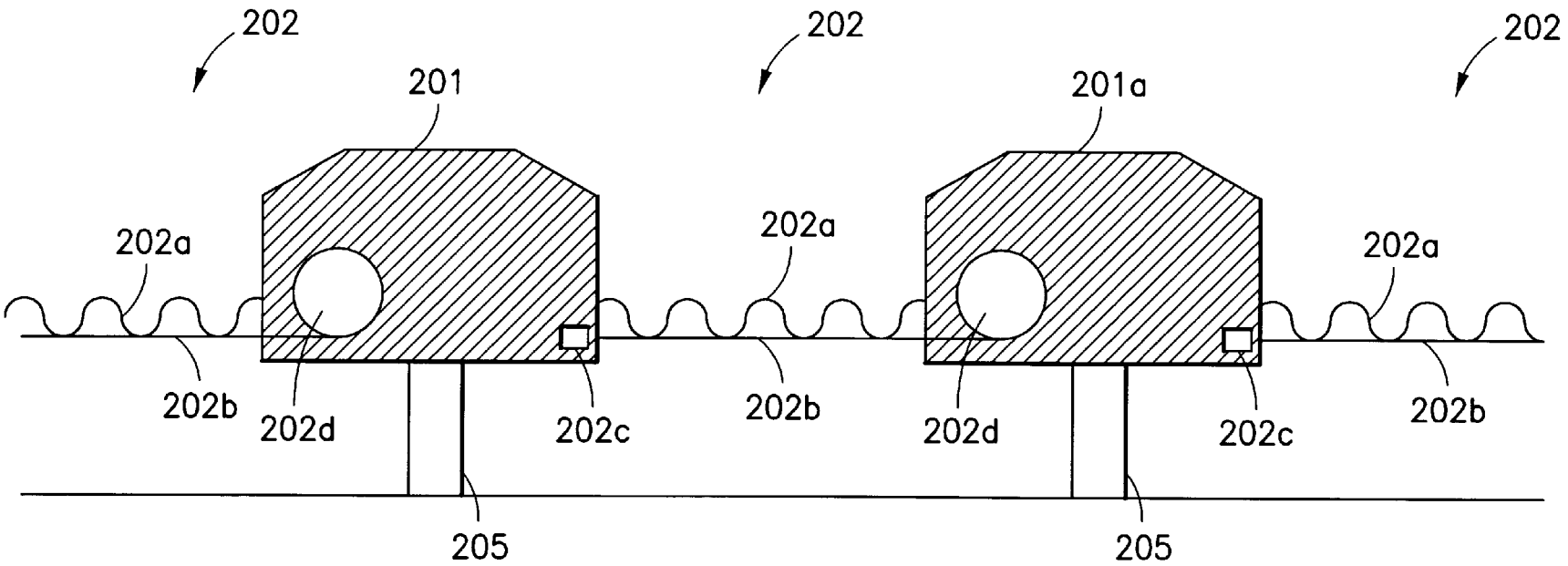
FIG. 30 is a side sectional view of the stretching linking member in the second embodiment according to the present invention, in the low-speed zone.
Figure 31:
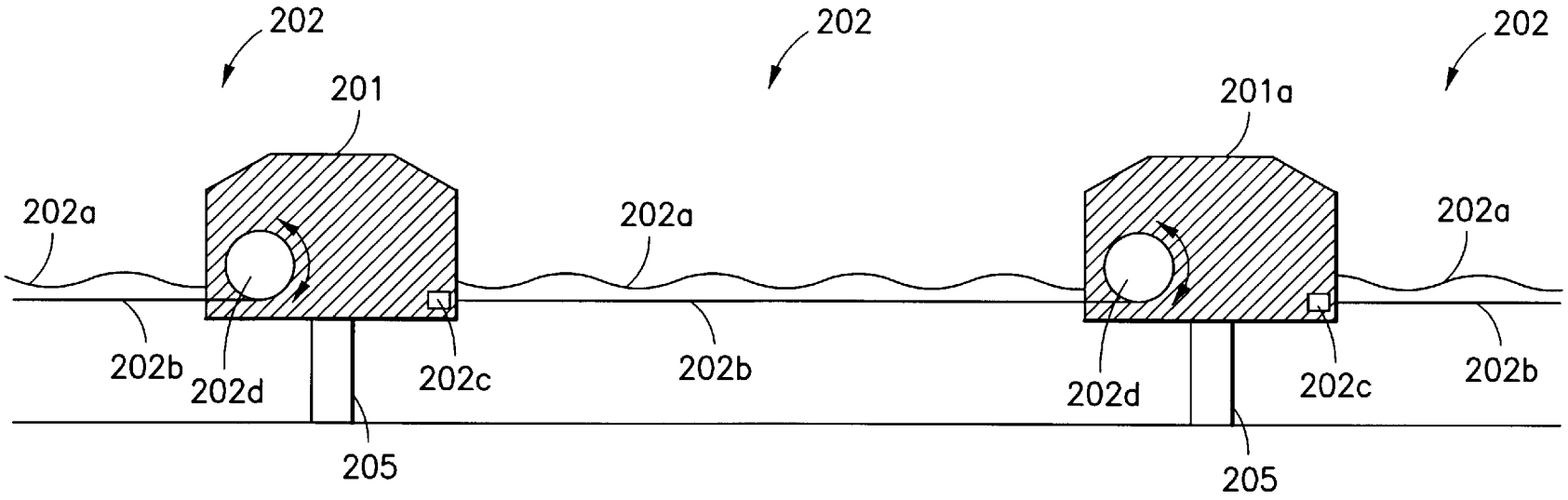
FIG. 31 is a side sectional view of the stretching linking member in the second embodiment according to the present invention, in the high-speed zone.

FIG. 30 and FIG. 31 are side sectional view illustrating a second embodiment of the stretching linking member according to the present embodiment, the form being shown illustrating an arrangement wherein accordion bellows-like formation 202*a* and flat spiral spring 202*b* has been used for covering the slit 204 between the aforementioned plurality of handrail pieces 201, FIG. 30 illustrating the state in which the handrails 201 are in close proximity due to a state of being in the low-speed zone and thus compressing the accordion bellows 202*a* and flat spiral spring 202*b,* and FIG. 31 illustrating the state in which the handrails 201 are distanced due to a state of being in the high-speed zone, and thus expanding the accordion bellows 202*a* and flat spiral spring 202*b.* One end of the flat spiral spring 202*b* is retained to the handrail 201, and the other end is in a wound state.

Accordingly, there is constantly tension operating due to the flat spiral spring 202*b,* thus preventing sagging of the accordion bellows 202*a* and maintaining a level state.

Figure 32:
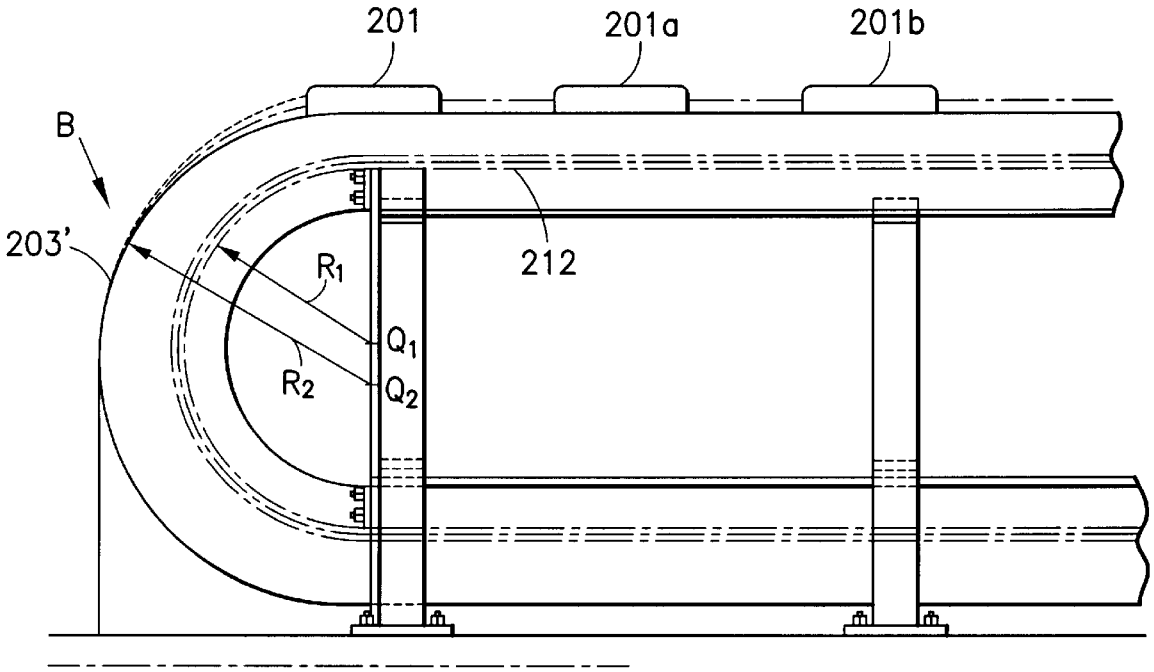
FIG. 32 is a side view of rotating portion of the handrail device of the variable-speed passenger conveyer according to the present invention at the boarding and disembarking ends.

FIG. 32 is a side view of the rotating portion at the boarding and disembarking ends of the handrail device for the variable-speed passenger conveyer according to the present invention, illustrating the state in which the upper plane of the handrail piece 201 is embedded from the surface of the cover 203' to the inside thereof at the position B of the rotating portion. The rotating curve of the driving belt 212 is set so as to be that with a radius $R_1$ centered around $\mathbf{0}_1$, but the curve of the cover 203' is set so as to be that with a radius $R_2$ centered around $\mathbf{0}_2$. Accordingly, the handrail piece 201 apparently seems to be embedded within the cover 203'.

According to this configuration, passengers continuously holding onto the handrail 201 can safely release the handrail 201. Also, baggage and the like can be prevented from getting caught on the device.

The center of the cover 203' is not restricted to a position below the center $\mathbf{0}_1$; this may be at a certain position to the left, just as long as the state of embedding is formed.

Figure 33:
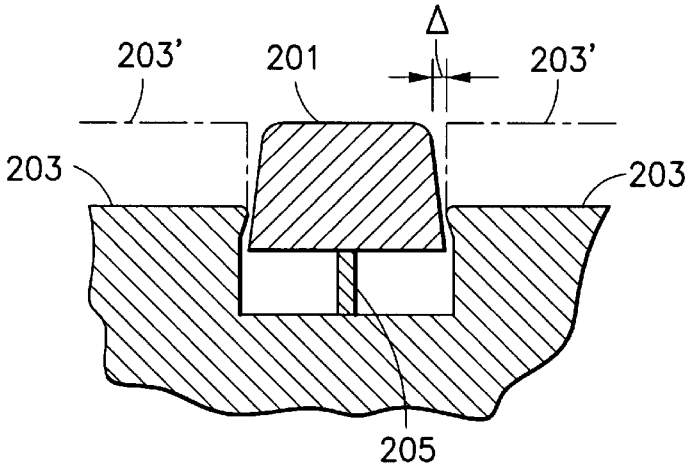
FIG. 33 is a cross-sectional view of rotating portion of the handrail device of the variable-speed passenger conveyer according to the present invention at the boarding and disembarking ends, viewed in the direction of driving.

FIG. 33 is a cross-sectional view of the rotating portion of the handrail device of the variable-speed passenger conveyer according to the present invention at the boarding and disembarking ends, viewed in the direction of driving, wherein the handrail piece 1 has a trapezoid cross-sectional form, and wherein the gap Δ between the side of the handrail piece 201 and the side of the cover 203' has a tendency of widening at the position of the cover 203' at the rotating portion in accordance with the embedding due to the gap with the cover 203 in the transporting zone, thus preventing fingers or hair getting caught therein.

As described above, the present invention is simple in construction, and there is no need to re-grasp the handrail in accordance with the change in speed.

Also, the slit in the cover through which the variable-speed handrail pieces pass is securely closed off with the stretching linking member so foreign material falling therein is prevented, and the arrangement is such that the handrail is of a trapezoid cross-sectional form in which the handrail pieces are embedded by covering with the cover at the boarding and disembarking ends, thus preventing fingers or hair getting caught therein at the boarding and disembarking ends.

Description of an embodiment of the second handrail device will be made with reference to the drawings.

Figure 34:
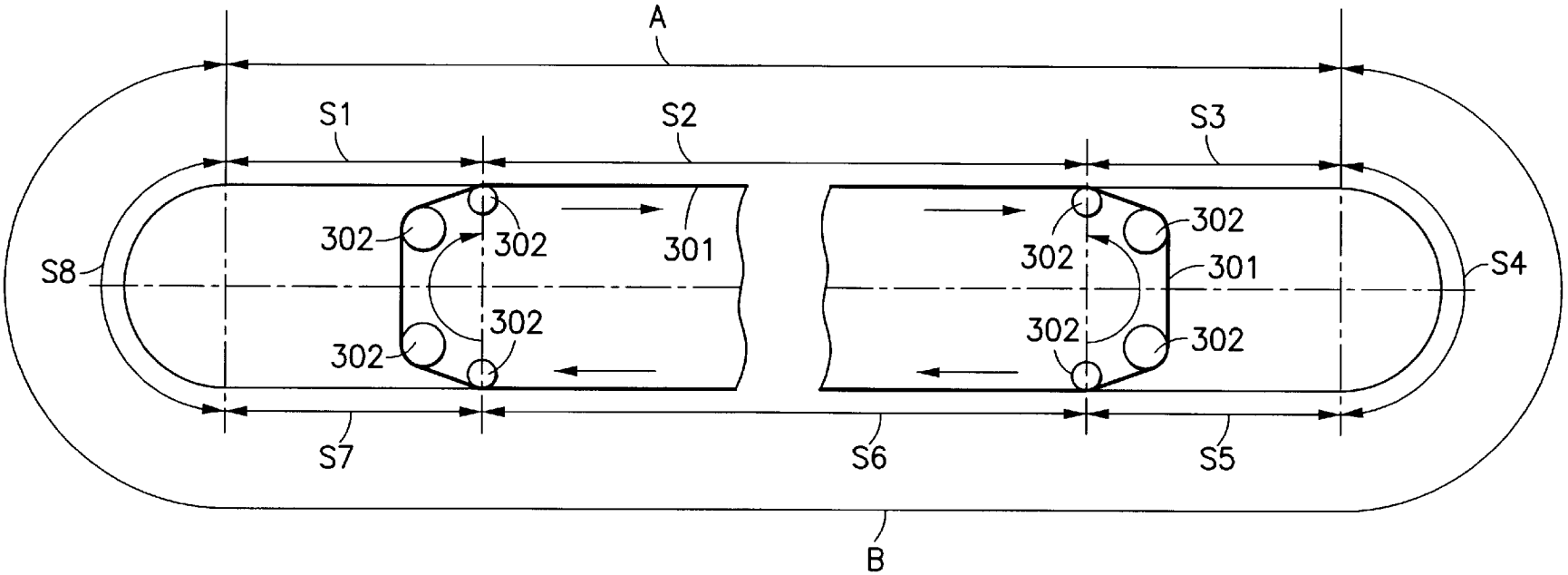
FIG. 34 is a schematic enlarged side view of the railing portion to which are provided the handrail of the variable-speed passenger conveyer according to the present invention.

FIG. 34 is a schematic enlarged side view of the railing portion to which are provided the handrail pieces of the variable-speed passenger conveyer according to the present invention, wherein the transporting line A is comprised of an acceleration zone S1 in which the handrail piece is gradually accelerated from the boarding end, a high-speed zone S2, and a deceleration zone S3 in which the handrail piece is gradually decelerated toward the disembarking end.

The return line B is comprised of an inversion portion S4 at which the handrail is inverted, an acceleration zone S5, a high-speed zone S6, a deceleration zone S7 in which the handrail piece is gradually decelerated, and an inversion portion S8 heading toward the boarding end.

A driving chain 301 is provided to the aforementioned high-speed zone S2, and the handrail piece is driven at high speed by sprockets 302. One of the sprockets 302 has the same motor as an not shown sprocket of the lower pallet transporting line, and is driven synchronously with the high speed of the palettes.

Figure 35:
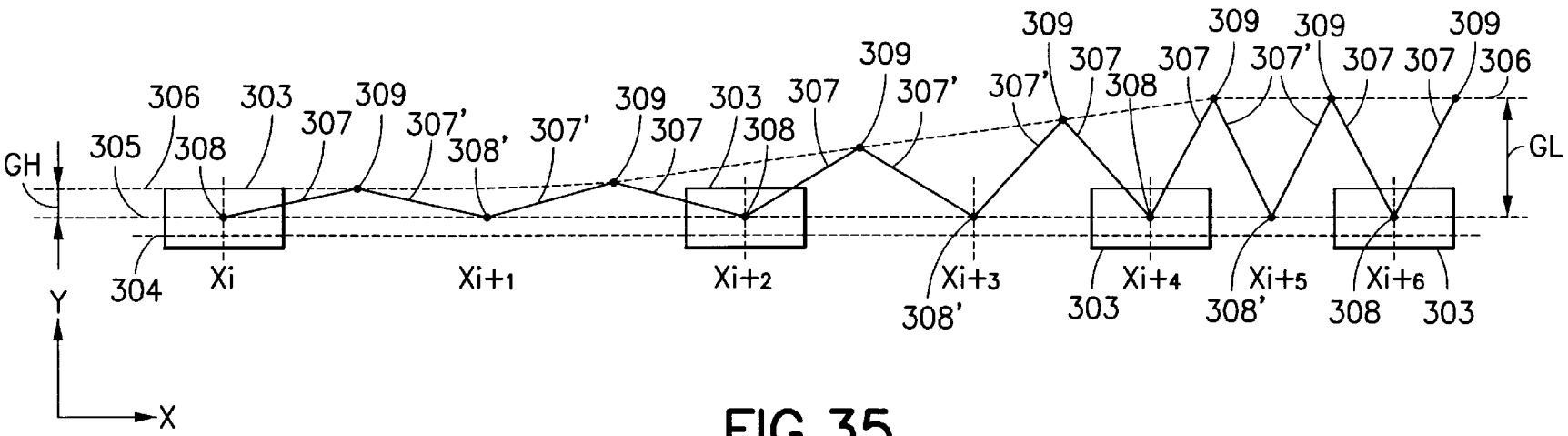
FIG. 35 is a plan view of a guide rail for accelerating the handrail provided to the deceleration zones S3 and S7 according to the present invention.

FIG. 35 is a schematic plan view of a guide rail for decreasing the speed of the handrail pieces provided to the aforementioned deceleration zones S3 and S7 according to the present invention.

In FIG. 35, 303 denotes a handrail piece, and 304 is a running rail for guiding the handrail piece 303, with the aforementioned running rail 304 being provided in loop fashion over the entire area of the transporting line A in FIG. 34 and the return line B thereof.

305 denotes a standard guide rail also provided to the aforementioned running rail 304, with the standard guide rail also being provided in loop fashion over the entire area of the transporting line A and the return line B as with the running rail 304.

306 is a side guide rail, the spacing thereof with the standard guide rail changing in the acceleration/deceleration zones S1, S3, S5, and S7, and this spacing being the same at the inversion portions S4 and S8. Incidentally, there are no side guide rails 306 provided to the high-speed zones S2 and S6.

307 is a link, and these links are formed in V-shaped arrangements between the standard guide rail 305 and the side guide rail 306 in a continuous manner over the entire range of the transporting line and the return line in a loop.

Provided to the aforementioned link 307 to the side toward the standard guide rail 305 is a standard guide roller 308 engaged with the handrail piece 303, and provided to the side guide rail 306 is a side guide roller 9, each being guided by the standard guide rail 305 and the side guide rail 306.

Incidentally, it is advantageous to also provide a link 307' and a standard guide roller 308' between the handrail pieces 303 and 303 to form a continuous link system, since the spacing between the standard guide rail 305 and side guide rail 306 can be formed narrow, thereby enabling design with the width of the handrail portion being narrow.

As shown in the Figure, in the deceleration zones S3 and S7, the side guide rail 306 is provided so that the spacing with the standard guide rail 305 gradually increases toward the transporting direction (arrow). Accordingly, the angle formed alternately by the links 307 becomes an acute angle as the spacing between the standard guide rail 305 and the side guide rail 306 increases, the spacing between the handrail pieces 303 and 303 becomes closer, and thus a low-speed state can be created.

Also, in the acceleration zones S1 and S5, the spacing between the side guide rail 306 and the standard guide rail 305 gradually narrows toward the transporting direction, conversely, and the angle formed alternately by the links 307 with the handrail pieces being moved in that state becomes an obtuse angle, the spacing between the handrail pieces 303 and 303 increases, and thus a high-speed state can be created.

Variable-speed passenger conveyers are different from conventional passenger conveyers in that the speed at the boarding and disembarking ends is low, and the speed at the intermediate portion is high. Accordingly, acceleration occurs as a matter of course at the acceleration/deceleration zones at which the speed changes from low speed to high speed, or from high speed to low speed. This acceleration affects the ease of ride of the passengers on the conveyer, and the greater the acceleration is, the greater the discomfort in ride of the passengers is. It is desirable that the acceleration generated at the acceleration/deceleration zones be as small as possible, i.e., that the acceleration in the acceleration/deceleration zones be a constant acceleration. Also, it is desirable that the position relation of the conveyer portion and the handrail portion match, meaning that the handrail portion must have the same acceleration as the conveyer portion.

According to the handrail portion of the variable-speed passenger conveyer according to the present invention, the factor controlling the acceleration is the form of the side guide rail.

Accordingly, analyzing the change in acceleration of the handrail piece upon change of the form of the side guide rail is extremely important in optimal design of the acceleration of the handrail piece.

Let us now consider the speed and acceleration of the handrail piece 303 as to the side guide rail 306.

As shown in FIG. 35, a coordinate system (X, Y) is placed on a plane formed of the standard guide rail 305 and side guide rail 306, with the width factor of the side guide rail 306 as viewed from the standard guide rail 305 (i.e., side guide form function) as G (X).

Considering the link guide system to be a fluid system, the following relational expression, Expression (16) holds:

$$\frac{v_L}{\sqrt{L^2 - G_L^2}} = \frac{v_H}{\sqrt{L^2 - G_H^2}} \tag{16}$$

wherein;

$V_L$, $V_H$: speed of handrail piece 303 in low speed and high speed zones $G_L$, $G_H$: value of side guide shape function G (X) in low speed and high speed zones L: length of link The driving system for the railing shown in FIG. 34 pulls the handrail pieces by means of a chain in the high-speed zones S2 and S6, so the speed $V_H$ of the handrail piece in the high-speed zone is constant. Using the handrail piece speed $V_H$ as a standard, generalizing the aforementioned Expression (16) for application to all zones yields the following Expression (17) which is an approximate expression for the speed V(x) of the handrail piece 303.

$$v(x) = \frac{\sqrt{L^2 - G(x)^2}}{\sqrt{L^2 - G_H^2}} v_H \tag{17}$$

Also, an approximate expression for the acceleration a(x) can be obtained by time-differentiation of Expression (17), yielding the following Expression (18).

$$a(x) = -\frac{v_H^2}{L^2 - G_H^2} G(x) \frac{dG(x)}{dx} \tag{18}$$

In the event that the certain speed change ratio (speed of high-speed zone/speed of low-speed zone) has been obtained using Expression (16), a relational expression can be obtained for the form design variables L, $G_L$, and $G_H$ of the link guide system of the handrail, and an approximate value for the speed and acceleration of the handrail piece can be obtained using Expression (17) and Expression (18).

The speed and acceleration of the handrail piece obtained using Expression (17) and Expression (18) are only approximate values, and it is necessary to obtain the speed and acceleration of the handrail piece using a model which is closer to the actual link guide system of the handrail.

With the X coordinate (roller position) of the standard guide rollers 8 and 8' as $X_i$, the following Expression (19) holds between the i+1-th roller position $X_{1+1}$ and the i-th roller position $X_i$:

$$x_{i+1} = x_i + 2\sqrt{L^2 - G((x_{i+1} + x_i)/2)^2} = x_i + 2\sqrt{L^2 - G_{ij+1}^2} \tag{19}$$

In Expression (19), $G_{ij+1}$ represents $G((X_{i+1}+X_i)/2)$. Time-differentiation of Expression (19) yields the following Expression (20):

$$v_{i+1} = \frac{\sqrt{L^2 - G_{ij+1}^2} - G_{ij+1}\frac{dG_{ij+1}}{dx}}{\sqrt{L^2 - G_{ij+1}^2} + G_{ij+1}\frac{dG_{ij+1}}{dx}} v_i \tag{20}$$

In Expression (20), $V_i$ represents the i-th roller speed. Time-differentiation of Expression (20) yields the following Expression (21):

$$\left(\sqrt{L^2 - G_{ij+1}^2} + G_{ij+1}\frac{dG_{ij+1}}{dx}\right)a_{i+1} = \left(\sqrt{L^2 - G_{ij+1}^2} - G_{ij+1}\frac{dG_{ij+1}}{dx}\right)a_i - \frac{1}{2}(v_{i+1} - v_i)^2 - \left\{\left(\frac{dG_{ij+1}}{dx}\right)^2 + G_{ij+1}\frac{d^2G_{ij+1}}{dx^2}\right\}\frac{1}{2}(v_{i+1} + v_i)^2 \tag{21}$$

In Expression (21), $a_i$ represents the i-th roller speed. Expression (19) is used to asymptotically obtain the roller position $X_i$. Expression (20) and the roller position $X_i$ is used to asymptotically obtain the roller speed $V_i$.

Expression (21), roller position $X_i$, and roller speed $V_i$ are used to asymptotically obtain the roller acceleration $a_i$.

Figure 36:
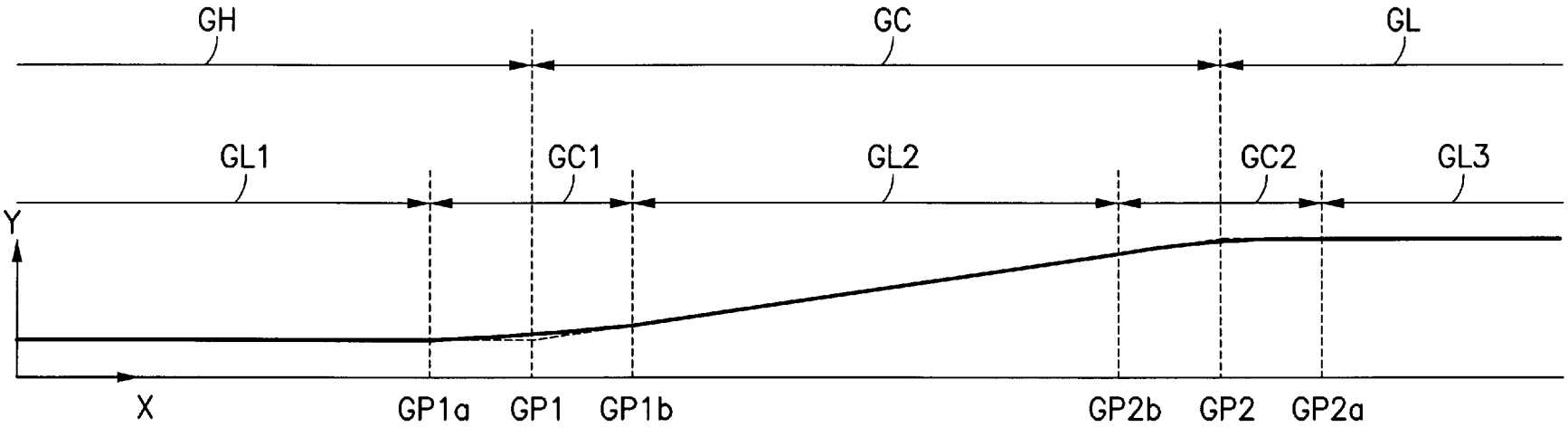
FIG. 36 is an explanatory diagram of a side guide form function relating to the present invention.

Since there is the component $d^2G(X)/dX^2$ in the Expression (21) representing the roller acceleration, the side guide form function G(X) must be a function which has at least a second-order derivative value of the side guide form function G(X), i.e., at least a $C^1$ class continuous function. FIG. 36 shows a $C^1$ class continuous side guide form function. The broken line is the basic design line of the guide comprised of segments, and the solid line is the side guide form function G(X).

The GH area is the high-speed zone of the design line, the GC area is the acceleration/deceleration zone of the design line, and the GL area is the low-speed zone of the design line. Inserting arcs with a certain curvature radius to area boundary points GP1 and GP2 in the basic design line of the guide forms the side guide form function G(X). In the areas GL1, GL2, and GL3, the side guide form function G(X) is a straight line, and in the areas GC1 and GC2 the side guide form function G(X) is an arc with a radius R.

Figure 37:
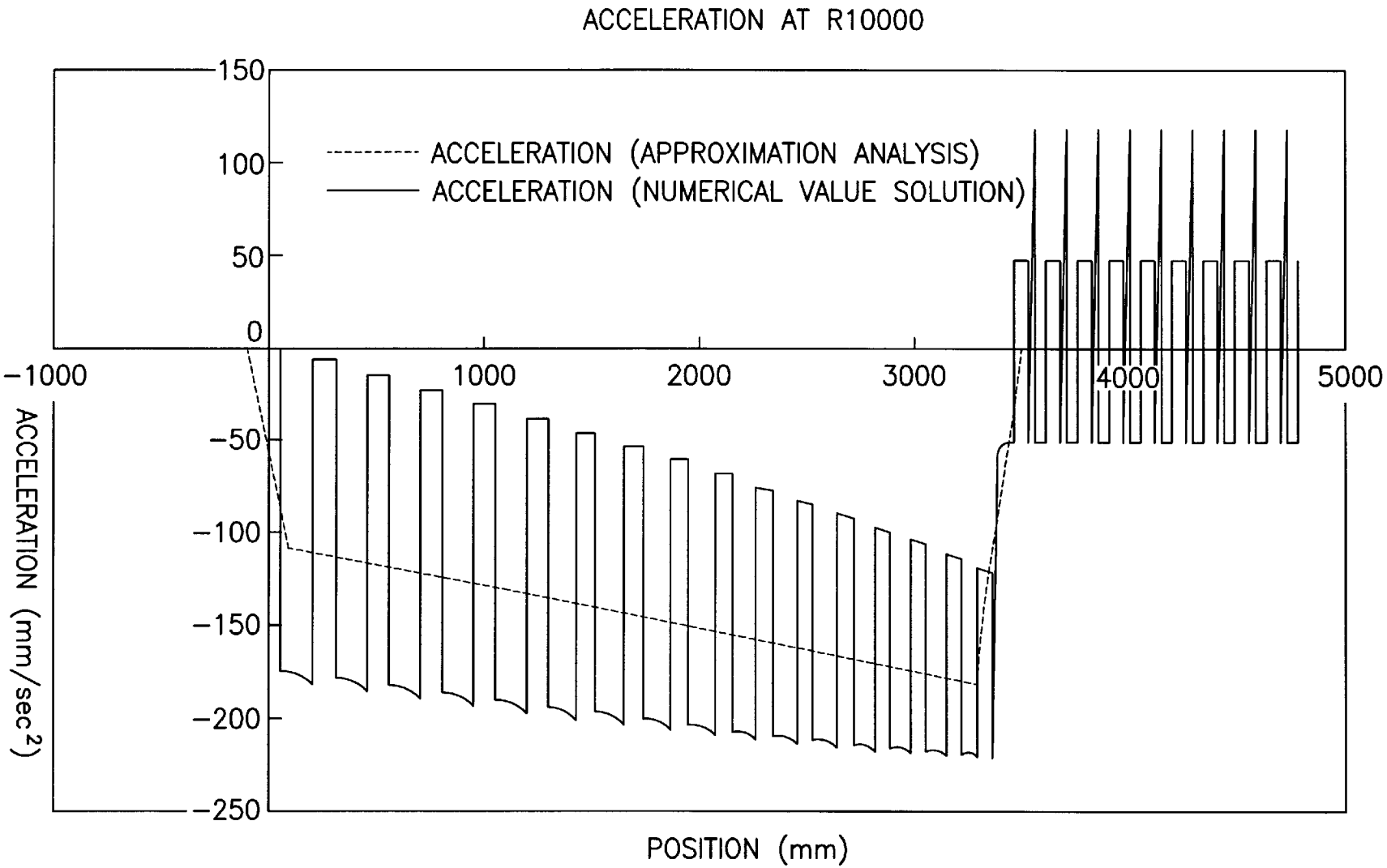
FIG. 37 is a graph of the acceleration of the handrail piece relating to the present invention (R10000)
Figure 38:
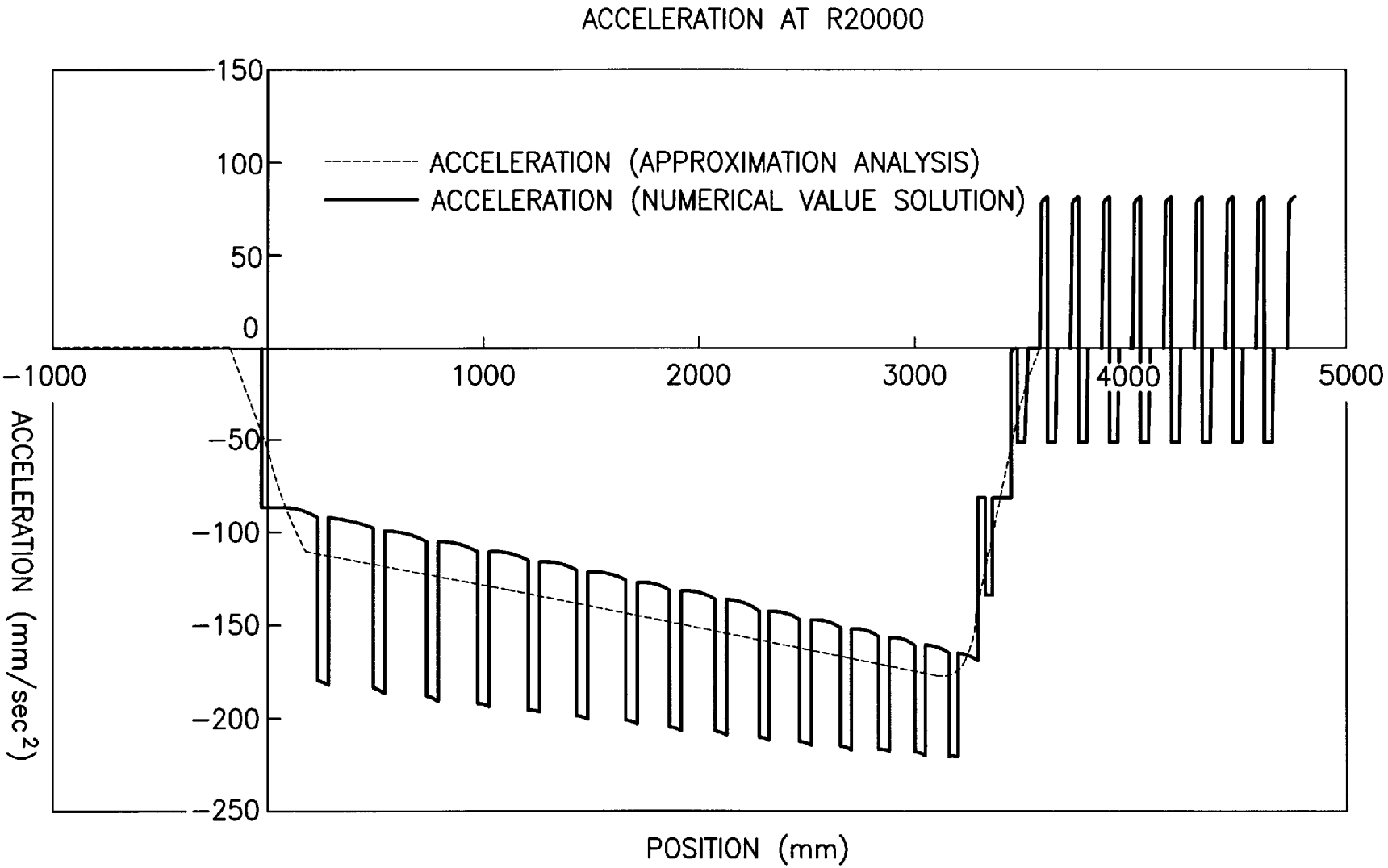
FIG. 38 is a graph of the acceleration of the handrail piece relating to the present invention (R20000)
Figure 39:
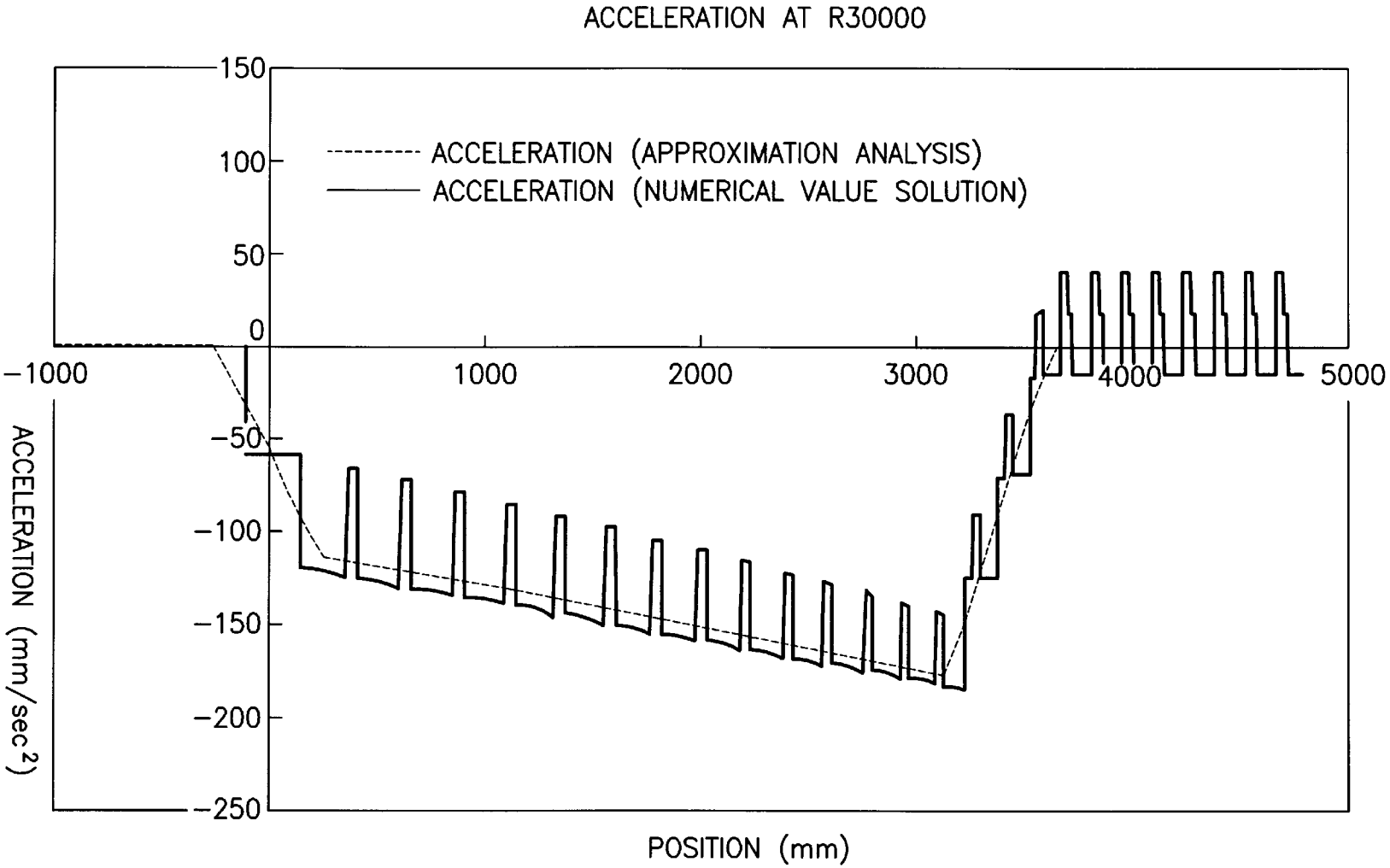
FIG. 39 is a graph of the acceleration of the handrail piece relating to the present invention (R30000)

FIG. 37, FIG. 38, and FIG. 39 represent graphs of the acceleration of the handrail pieces. The speed $V_H$ of the handrail piece in the high-speed zone is 1200 mm/s. The solid line represents the acceleration (numerical value solution) of the handrail piece obtained using Expression (21), and the broken line represents the acceleration (approximation analysis) of the handrail piece obtained using Expression (18).

The dimensions of the guide link system are as follows: length GC of the acceleration/deceleration zone=3400 mm; side guide form function value $G_H$ at the high-speed zone=80 mm; side guide form function value $G_L$ at the low-speed zone=135.1 mm; and link length=153.5 mm. Graphs represent the acceleration of the handrail piece when R is 10000 mm, 20000 mm, and 30000 mm. The numerical value solution vibrates (oscillates) above and below the approximation analysis. The smaller R is, the greater the oscillation of the numerical value solution is. However, the greater R is, the smaller the maximum acceleration of the handrail piece is, but the greater R is the greater the manufacturing cost is, so it is appropriate to set R=20000 mm from both perspectives of the maximum acceleration of the handrail pieces and the manufacturing cost thereof.

Taking into consideration the side guide optimal form function G*(X) at which the greatest acceleration of the handrail piece is minimal, the side guide optimal form function G*(X) is defined as being a side guide form function wherein the acceleration of the handrail piece is constant in the acceleration/deceleration zones. This is represented in the differentiation equation of the following Expression (22), boundary conditions.

$$\frac{da(G*(x))}{dx} = 0 \tag{22}$$

$$G^*(GP1a)=G_L$$
$$G^*(GP2a)=G_H \tag{23}$$

G*(X) which is obtained from the aforementioned Expression (22) and Expression (23) is connected by $C^0$ class continuation at boundary points GP1*a* and GP2*a* with low-speed zone guide and high-speed zone guide, but is not connected by $C^1$ class continuation. This G*(X) cannot solve the numerical value solution of the acceleration of the handrail piece in Expression (21). Also, the offset component of the acceleration of the handrail piece is of a matter reduced, but the oscillating component becomes very great, and consequently, the minimum value of the maximum acceleration of the handrail piece becomes extremely great.

Using a weak format differentiation equation expression instead of a strong format differentiation equation expression such as Expression (22) and Expression (23) for representing the side guide optimal form function G*(X) yields the pan-function minimization problem of the following Expression (24), boundary conditions.

$$\int_{GP1a}^{GP2a}\left(\frac{da(G*(x))}{dx}\right)^2 dx \rightarrow \min \tag{24}$$

$$G^*(GP1a)=G_L$$
$$G^*(GP2a)=G_H$$
$$\frac{d}{dx}G*(GP1a) = 0$$
$$\frac{d}{dx}G*(GP2a) = 0 \tag{25}$$

Substituting Expression (18) into a(x) in Expression (24) yields the following Expression (26):

$$\frac{v_H^4}{4(L^2 - G_H^2)^2}\int_{GP1a}^{GP2a}\left(\frac{d^2G*(x)^2}{dx^2}\right)^2 dx \rightarrow \min \tag{26}$$

Expression (26) is a definitive expression the same as a third order spline function, and thus Expression (27) holds, and G*(X) can be obtained:

$$G*(x)^2 = c_1 + c_2x + \sum_{i=1}^{N} d_i|x - x^{(i)}|^3 \tag{27}$$
$$\sum_{i=1}^{N} d_i = 0$$
$$\sum_{i=1}^{N} d_ix^{(i)} = 0$$

In Expression (27), the right side of the first expression represents a third order spline function, $x^{(i)}$ represents the X coordinate of the control point of the side guide optimal form function, and N represents the number of control points. Since the number of expression for boundary conditions in Expression (25) is four, four control points is sufficient, but in order to further minimize the maximum acceleration of the handrail the number of control points N will be increased to six, and the conditions of the following Expression (28) added to obtain a third order spline function.

$$\frac{d^2}{dx^2}G*(GP1b)^2=0 \qquad (28)$$

$$\frac{d^2}{dx^2}G*(GP2b)^2=0$$

Also, the values of the control points are as shown in the following Expression (29):

$$\{x^{(1)}x^{(2)}x^{(3)}x^{(4)}x^{(5)}x^{(6)}\}=\{GP1a\ GP1\ GP1b\ GP2b\ GP2\ GP2a\} \qquad (29)$$

Figure 40:
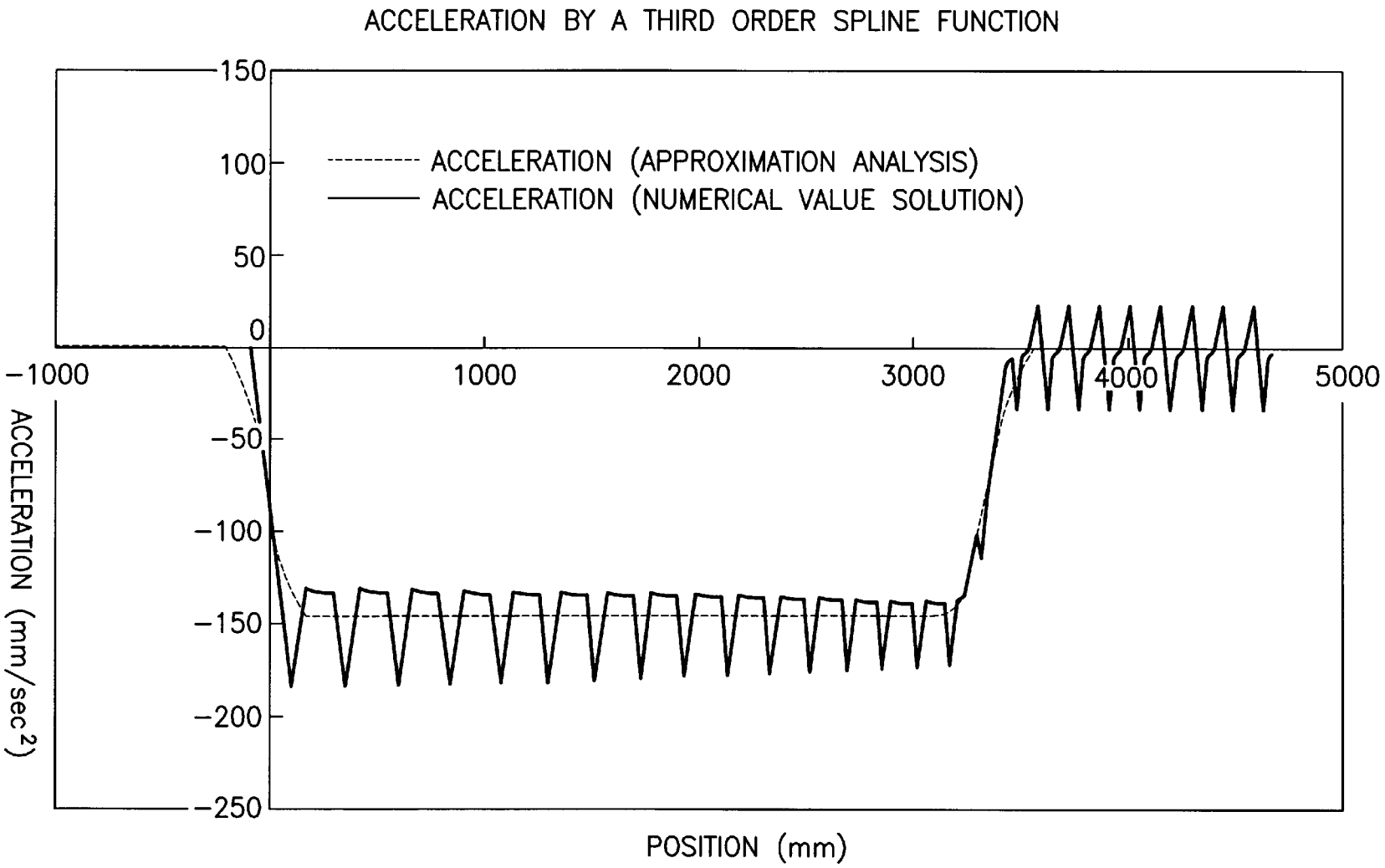
FIG. 40 is a graph representing the acceleration of the handrail piece relating to the present invention (third power spline function)

FIG. 40 is a graph representing the acceleration of the handrail pieces. The speed $V_H$ of the handrail piece in the high-speed zone is 1200 mm/s.

The solid line represents the acceleration (numerical value solution) of the handrail piece obtained using Expression (21), and the broken line represents the acceleration (approximation analysis) of the handrail piece obtained using Expression (18).

The dimensions of the guide link system are as follows: GPIa=−200; GPI=0, GPIb=200, GP2*b*=3200; GP2=3400;GP2*a*=3600; side guide form function value $G_L$ at the low-speed zone=135.1 mm; and link length L=153.5 mm.

The approximation analysis is constant in the intermediate range of the acceleration/deceleration zones. The numerical value solution vibrates. (oscillates) above and below the approximation analysis. Based on the dimensions of the guide form, the one that corresponds with the acceleration graph of the handrail piece in FIG. 40 is the acceleration graph of the handrail piece in FIG. 38 (R=20000), and comparing FIG. 40 and FIG. 38, it can be understood that the acceleration of the handrail piece in FIG. 40 is smaller.

Figure 41:
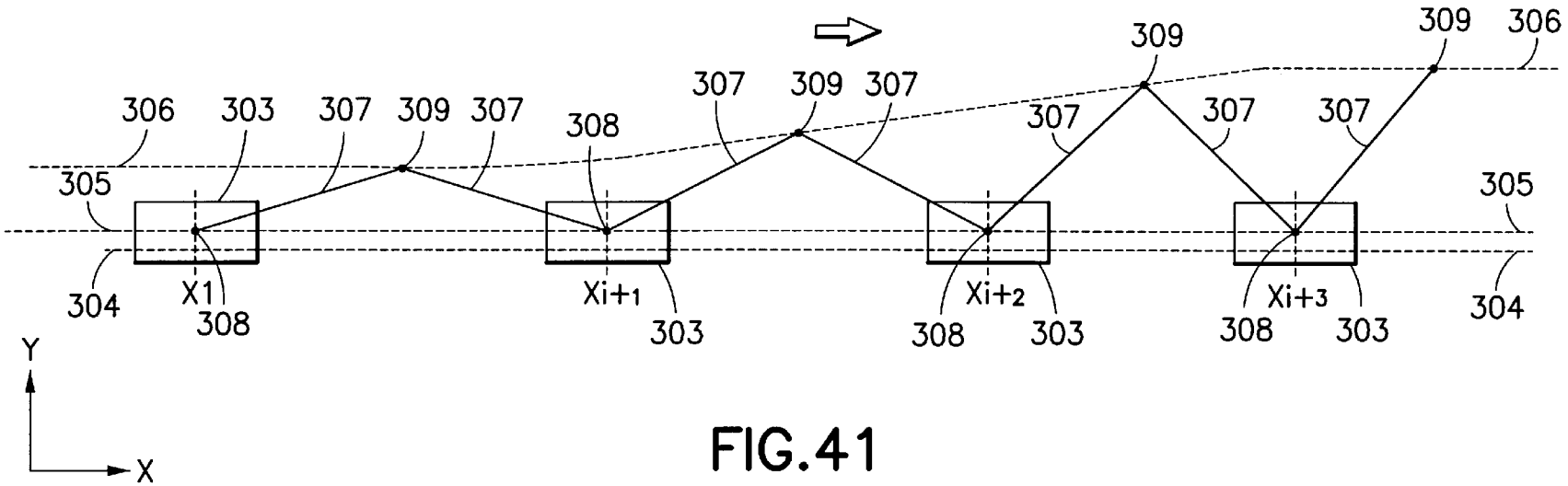
FIG. 41 is a plan view of a first embodiment of the link according to the present invention.

FIG. 41 is a schematic plan view of another embodiment of the aforementioned link 307 according to the present invention.

The link 307 is linked from the standard guide rail 305 (the side toward the handrail piece 303) to the side guide rail 306 and standard guide rail 305 in a V-shape. In this embodiment as well, the width of the handrail is increased somewhat, but acceleration/deceleration of the handrail pieces 303 can be performed. Also, the speed of the hand rail piece 303, approximation analysis of acceleration, numerical value solution, and the side guide rail design method, described in the embodiment shown in FIG. 35, can be used.

Figure 42:
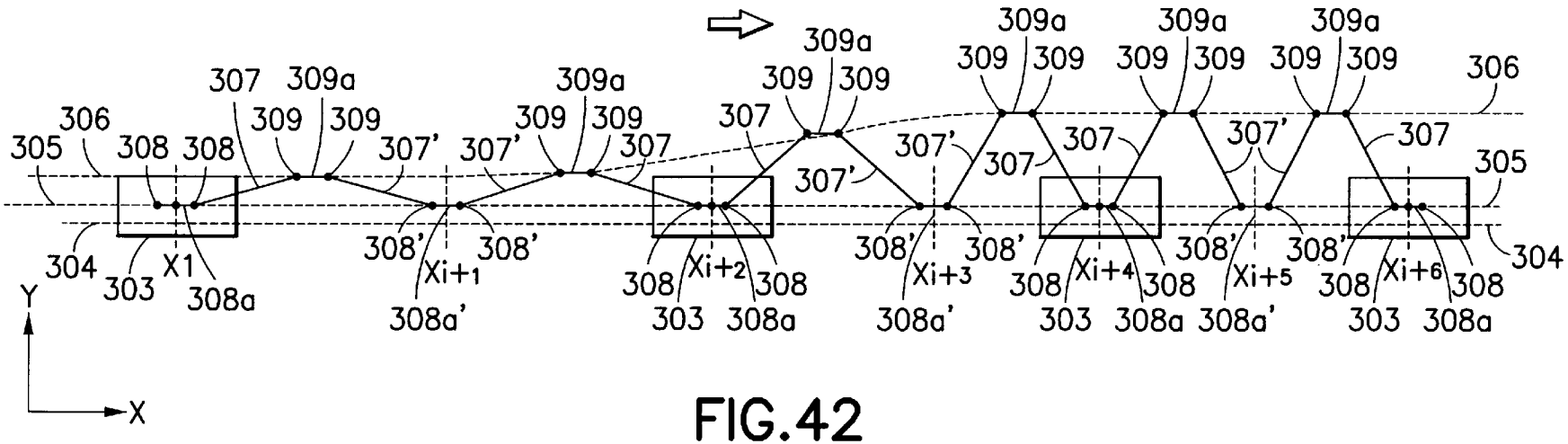
FIG. 42 is a plan view of a second embodiment of the link according to the present invention.

FIG. 42 is a schematic plan view of another embodiment of the aforementioned link 307 according to the present invention.

This is link guide system wherein link members 308*a*, link members 308*a'*, or link members 309*a* are inserted between the links 307 of the embodiment shown in FIG. 35. This construction enables the link guide system to be further flattened.

With the present embodiment, the speed of the handrail piece 303, approximation analysis of acceleration, numerical value solution, and the side guide rail design method, described in the embodiment shown in FIG. 35, are somewhat different.

Considering the link guide system shown in FIG. 42 to be a fluid system, the following relational expression, Expression (30) holds:

$$\frac{v_L}{\sqrt{L^2-G_L^2}+K}=\frac{v_H}{\sqrt{L^2-G_H^2}+K} \qquad (30)$$

In Expression (30), K represents the average length of link members 308*a*, 308*a'*, and 309*a*.

The following Expression (31) is an approximate expression for the speed V(x) of the handrail piece 303.

$$v(x)=\frac{\sqrt{L^2-G(x)^2}+K}{\sqrt{L^2-G_H^2}+K}v_H \qquad (31)$$

An approximate expression for the acceleration a(x) is represented by the following Expression (32).

$$a(x)=-\frac{v_H^2}{\left(\sqrt{L^2-G_H^2}+K\right)^2}\frac{\sqrt{L^2-G(x)^2}+K}{\sqrt{L^2-G(x)^2}}G(x)\frac{dG(x)}{dx} \qquad (32)$$

With the X coordinate (link member position) of the link members 308*a* and 308*a'* as $X_i$, the following Expression (33) holds between the i+1-th link member position $X_{i+1}$ and the i-th link member position $X_i$:

$$\begin{aligned}x_{i+1}&=x_i+2K+2\sqrt{L^2-G((x_{i+1}+x_i)/2)^2}\\&=x_i+2K+2\sqrt{L^2-G_{ij+1}^2}\end{aligned} \qquad (33)$$

Time-differentiation of Expression (33) yields the following Expression (34):

$$v_{i+1}=\frac{\sqrt{L^2-G_{ij+1}^2}-G_{ij+1}\frac{dG_{ij+1}}{dx}}{\sqrt{L^2-G_{ij+1}^2}+G_{ij+1}\frac{dG_{ij+1}}{dx}}v_i \qquad (34)$$

Time-differentiation of Expression (34) yields the following Expression (35):

$$\begin{aligned}&\left(\sqrt{L^2-G_{ij+1}^2}+G_{ij+1}\frac{dG_{ij+1}}{dx}\right)a_{i+1}=\\&\quad\left(\sqrt{L^2-G_{ij+1}^2}-G_{ij+1}\frac{dG_{ij+1}}{dx}\right)a_i-\frac{1}{2}(v_{i+1}-v_i)^2-\\&\quad\left\{\left(\frac{dG_{ij+1}}{dx}\right)^2+G_{ij+1}\frac{d^2G_{ij+1}}{dx^2}\right\}\frac{1}{2}(v_{i+1}+v_i)^2\end{aligned} \qquad (35)$$

Expression (33) is used to asymptotically obtain the link member position $X_i$. Expression (34) is used to asymptotically obtain the link member position $V_i$. Expression (35), link member position $X_i$, and link member speed $V_i$ are used to asymptotically obtain the link member acceleration $a_i$.

The design method for the side guide form function G(X) in the acceleration/deceleration zones is the same as the case of the embodiment in FIG. 35.

With the design method for the side guide optimal form function G*(X), the pan-function minimization problem, boundary conditions, yield the following Expression (36):

$$\int_{GP1a}^{GP2a}\left(\frac{d\,a(G^*(x))}{d\,x}\right)^2 d\,x \rightarrow \min \tag{36}$$

$$G^*(GP1a)=G_L$$
$$G^*(GP2a)=G_H$$
$$\frac{d}{d\,x}G^*(GP1a)=0 \tag{37}$$
$$\frac{d}{d\,x}G^*(GP2a)=0$$

Substituting Expression (32) into a(x) in Expression (36) yields the following Expression (38):

$$\frac{v_H^4}{4\left(\sqrt{L^2-G_H^2}+K\right)^4} \tag{38}$$
$$\int_{GP1a}^{GP2a}\left(\frac{d^2}{d\,x^2}\left(G^*(x)^2+2K\sqrt{L^2-G^*(x)^2}\right)\right)^2 d\,x \rightarrow \min$$

Expression (38) is a definitive expression the same as a third order spline function, and thus the following Expression (29) holds, and G*(X) can be obtained:

$$G^*(x)^2+2K\sqrt{L^2-G^*(x)^2}=c_1+c_2x+\sum_{i=1}^{N}d_i|x-x^{(i)}|^3 \tag{39}$$
$$\sum_{i=1}^{N}d_i=0$$
$$\sum_{i=1}^{N}d_ix^{(i)}=0$$

In Expression (39), the right side of the first expression represents a third order spline function, $x^{(i)}$ represents the X coordinate of the control point of the side guide optimal form function, and N represents the number of control points. Since the number of expression for boundary conditions in Expression (37) is four, four control points is sufficient, but in order to further minimize the maximum acceleration of the handrail the number of control points N will be increased to six, and the conditions of the following Expression (40) added to obtain a third order spline function.

$$\frac{d^2}{d\,x^2}\left(G^*(GP1b)^2+2K\sqrt{L^2-G^*(GP1b)^2}\right)=0 \tag{40}$$
$$\frac{d^2}{d\,x^2}\left(G^*(GP2b)^2+2K\sqrt{L^2-G^*(GP2b)^2}\right)=0$$

Also, the values of the control points are as shown in the following Expression (41):

$$\{x^{(1)}x^{(2)}x^{(3)}x^{(4)}x^{(5)}x^{(6)}\}=\{GP1a\ GP1\ GP1b\ GP2b\ GP2\ GP2a\} \tag{41}$$

Incidentally, The side guide rail 306 described in FIG. 35, FIG. 41, and FIG. 42 does not need to be provided to the high-speed zones S2 and S6.

Figure 43:
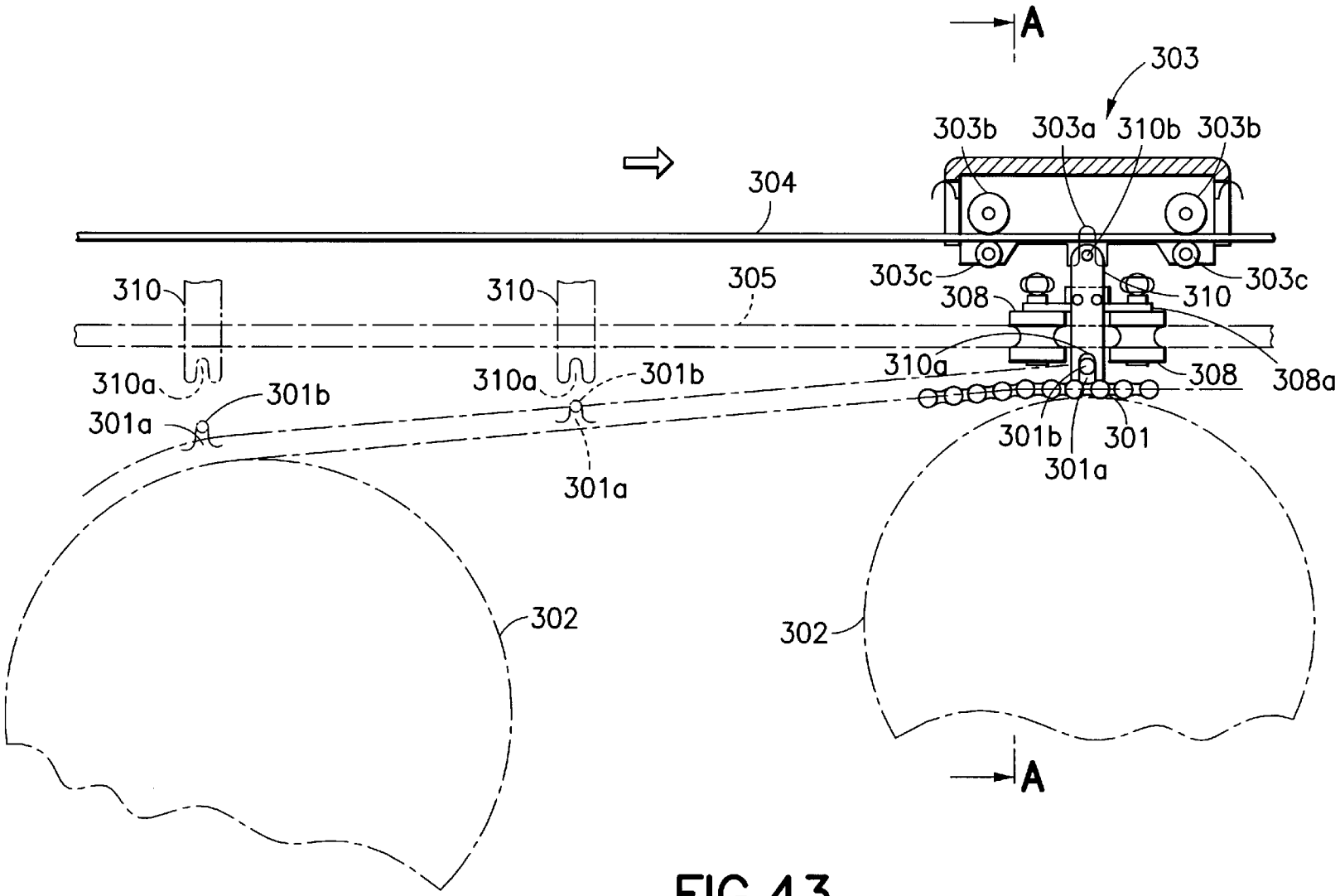
FIG. 43 is a side view illustrating the engagement relation between the driving chain for high-speed driving in the high-speed zone S2 and the handrail piece according to the present invention.

FIG. 43 is a side view illustrating the engagement relation between the driving chain 301 for high-speed driving in the high-speed zone S2 shown in FIG. 34 and the handrail piece 303.

In FIG. 43, 301 denotes a driving chain, and 301*a* is a protrusion provided to the chain 1 at certain intervals. 310 is an engaging metal piece of which the other end engages the handrail piece 303, the recessed portion 310*a* of the engaging metal piece 310 engaging with a roller 301*b* of the aforementioned protrusion 301*a* of the chain 301, being driven by driving of a sprocket 302.

The intermediate portion of the aforementioned engaging metal piece 310 is integrally attached to the link member 308*a* of the standard guide rollers 308 and 308, and the other end is engaged with a metal piece 303*a* of the handrail piece 303 by a roller 310*b* provided thereto.

305 is a standard guide rail, for guiding the aforementioned standard guide rollers 308 and 308. 304 is a running rail for the handrail piece 303, and causes the handrail piece 303 to run by means of running rollers 303*b* and 303*c* which are attached to the handrail piece 303. Incidentally, the high-speed zone S6 in FIG. 34 is also of a similar engaging construction.

Figure 44:
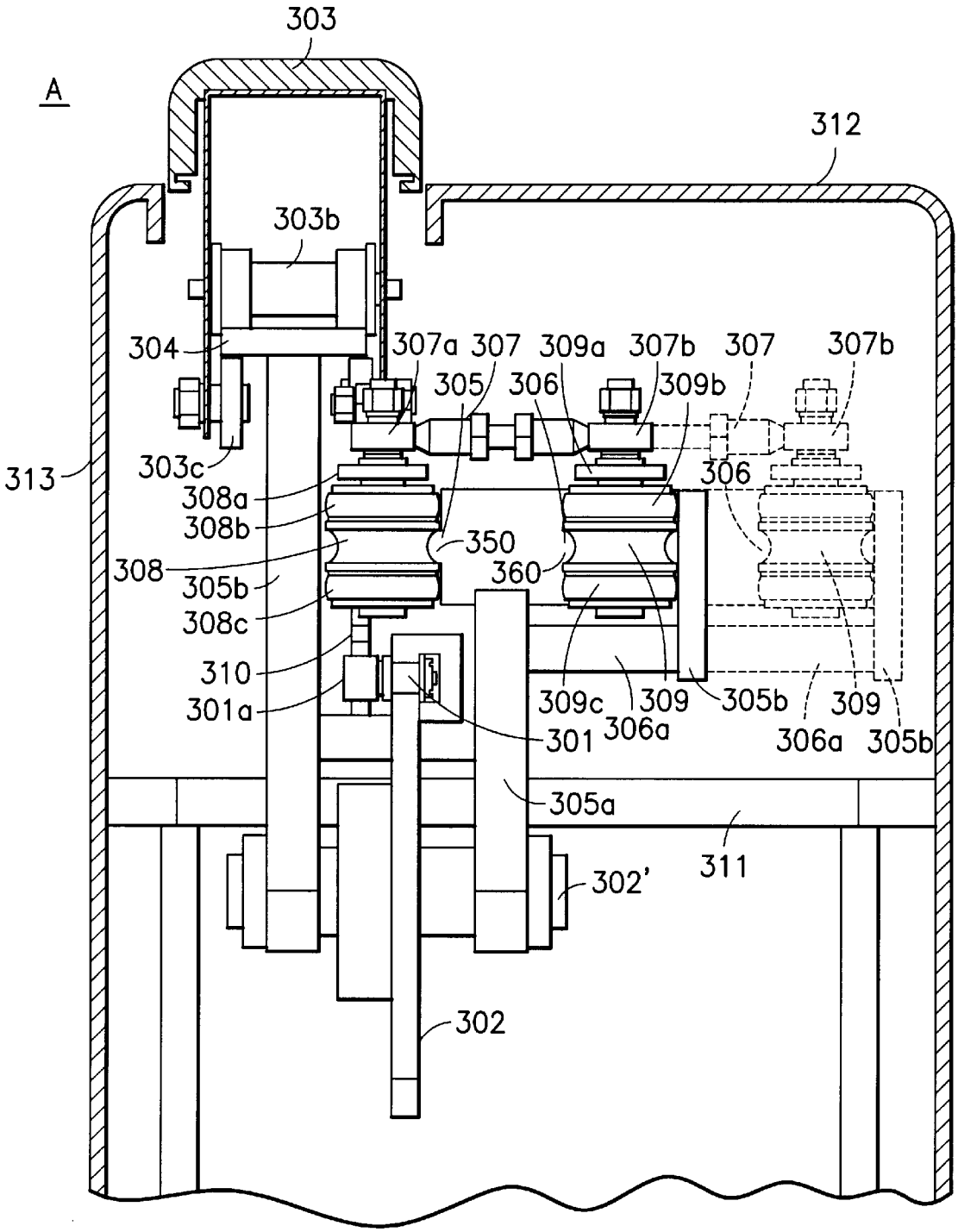
FIG. 44 is a cross sectional view taken along line A—A in FIG. 43.

FIG. 44 is a cross-sectional view taken along line A—A in FIG. 43, and is a cross-sectional view of the handrail device of the variable-speed passenger conveyer according to the present invention.

In FIG. 44, 303 is a handrail piece, 303*b* and 303*c* are running rollers which are supported by the handrail piece 303 and are provided so as to pinch a running rail 304 from above and below, constructed so as to prevent wobbling of the handrail piece 303.

First, the aforementioned handrail piece 303 is provided to the transporting A side toward the passengers, and is situated in an offset manner such that the passengers can easily grasp it.

305 is a standard guide rail, and 306 is a side guide rail (not provided to high-speed zones S2 and S6). Both guide rails 305 and 306 are integrally formed at portions where spacing is narrow, with a rounded protruding portion formed to the side thereof, and both are formed separately at portions where spacing is wide. At the high-speed zones, the driving chain 301 widens the spacing of the handrail pieces 303 and 303 in order to create a high-speed state. Accordingly, the aforementioned side guide rail 306 does not need to be operated, and only receive the side guide roller 309 only for supporting the link 307, so a certain amount of wobble is preferable.

310 is an engaging metal piece, and is engages the handrail piece 303 and is linked with the link member 308*a* of the standard guide rollers 308 and 308, and further engages the protrusions 301*a* of the driving chain 301.

The standard guide roller 308 having an hourglass-shaped portion corresponding with the rounded form of the protruding portion of the side of the aforementioned standard guide rail 305, and is axially borne by the aforementioned link 307 by a spherical bearing 307*a*.

Also, 305*a* is a supporting table for the standard guide rail 305, and 305*b* is a guard member for restricting outside movement of the standard guide roller 308. The upper and lower flanges 308*b* and 308*c* of the standard guide roller 308 roll against the guard member 305*b* and standard guide rail 305.

The side guide roller 309 is axially borne by the other end of the aforementioned link 307 with a spherical bearing 7*b*, and the hourglass portion of the side guide roller 309 fits the rounded protruding portion of to the side of the side guide rail 306 as described above. Axially supporting the link 307, standard guide roller 308, and side guide roller 309 with a spherical bearing is advantageous in that there is no interference between the link 307 and the standard guide rail 305 and side guide rail 306 at the inverted portions S4 and S8.

Also, the side guide rail 306 is comprised of a supporting member 306*a* and guard member 305*b*, and the inner side of the side guide rail 306 and guard member 305*b* roll against the upper and lower flanges 309*a* and 309*b* of the aforementioned side guide roller 309.

The aforementioned supporting member 306*a* serves as an adjusting member for determining the adjustment leeway of the circumference of the links 307 at the acceleration/deceleration zones S5 and S7 of the return line.

Generally, in variable-speed passenger conveyers, it is necessary to provide link systems which use links 307 such as described above for changing speed with means for forming adjustment leeway of the circumference of the links 307.

With the present invention, the sideways width of the supporting member 306*a* provided to the acceleration zone S5 and deceleration zone S7 of the return line is wide, and the distance between the standard guide rail 305 and side guide rail 306 is narrow, thus provided some "play" so as to form adjustment leeway for the circumferencial length of the link 307.

311 is a conveyer frame, and the sprocket 302 for driving the driving chain 301 is axially borne to the aforementioned conveyer frame 311 by a shaft 302'. Incidentally, 312 and 313 are frame covers.

The drawing in broken lines to the right of FIG. 44 is a supposed drawing illustrating the positional relation of the side roller 309 at the point that the side guide rail 306 is widest, i.e., at the point of deceleration.

Figure 45:
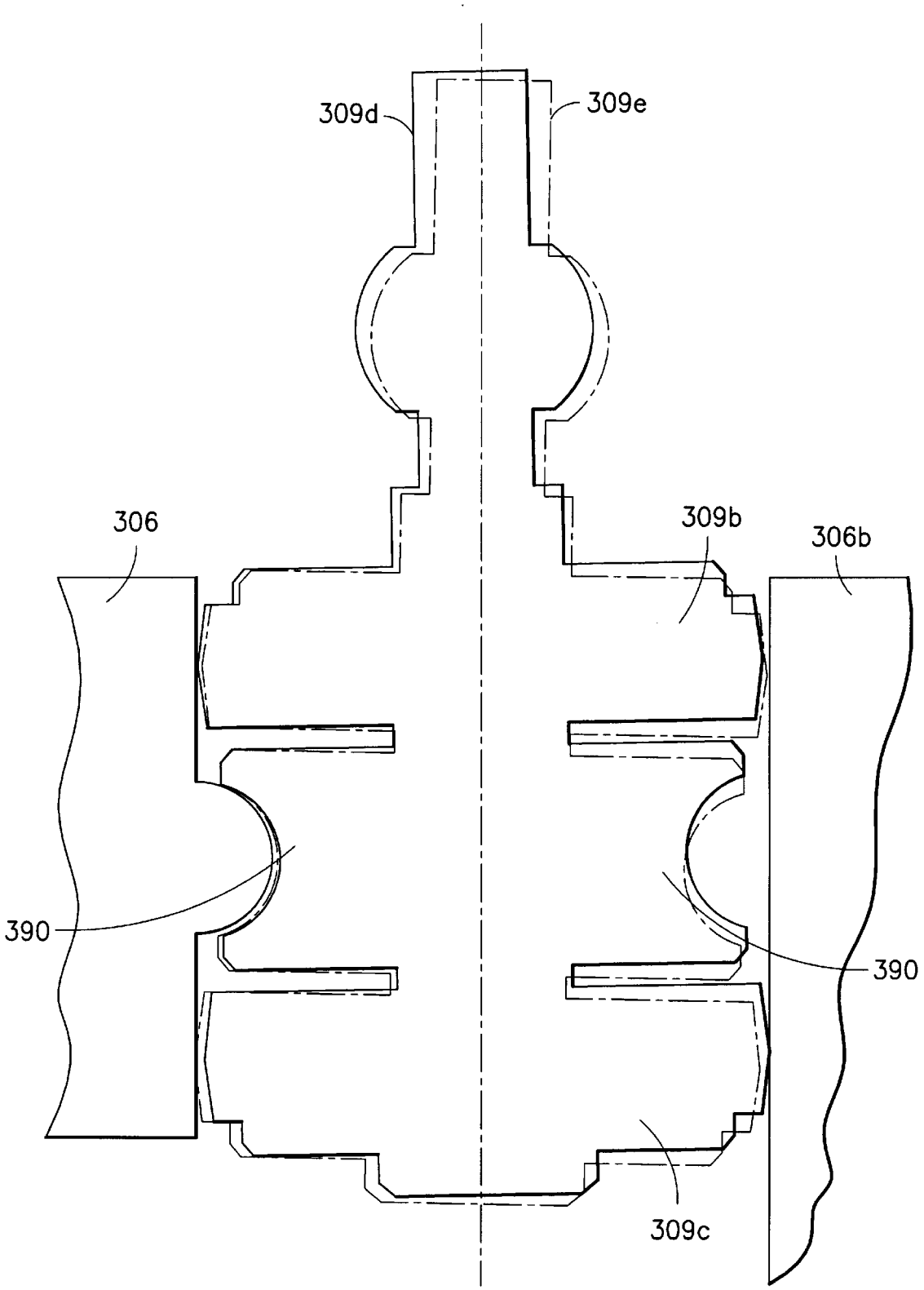
FIG. 45 is an elevation view illustrating the movement of the guide roller according to the present invention.

FIG. 45 is an elevation view illustrating the movement of the side guide roller 309 in the side guide rail 306 and guard member 305*b*.

309*d* and 309*e* are profiles of the side guide roller 309. In order to give a certain amount of clearance between the side guide rail 306 and guard member 305*b*, and the upper flange 309*b* and lower flange 309*c* of the side guide roller 309, internal force of the link 307 acts upon the spherical bearing 307*b*, so the side guide roller 309 tilts as shown by the profiles 309*d* and 309*e* as to the design standard line of the standard guide roller which is indicated by a single-dot broken line as shown in the Figure. This is also true for the standard guide rail 305.

Accordingly, the distance between the handrail pieces 303 and 303 undesirably includes a margin of error as to the certain design value. In order to suppress the inclination of the standard guide roller 308 as much as possible, the height of the guide rail and the guide member is made to be at least the height of the guide roller flange portion. Also, the side form of the upper flange 308*b* and 309*b* and the lower flange 308*c* and 309*c* of the guide rollers 308 and 309 has been made to be a convex curved plane (arc), so as to facilitate ease of rolling upon rolling contact.

The radius of the arc of the hourglass-shaped portion 390 of the standard guide roller has been made to be greater than the radius of the arc of the protrusion 360 of the guide rail 306, in order to provide clearance.

The protrusion 360 of the guide rail 306 is set such that the center line of the guide roller 309 becomes the design standard line at the point that the apex of the concave arc of the guide roller and the apex of the convex arc of the guide rail meet, so that the guide roller tilts with the center thereof as the axis.

The side form of the protrusions of the aforementioned standard guide rail 305 and the side guide rail 306 is by no means limited to a rounded form; rather, this may be a form with straight sides.

Figure 46:
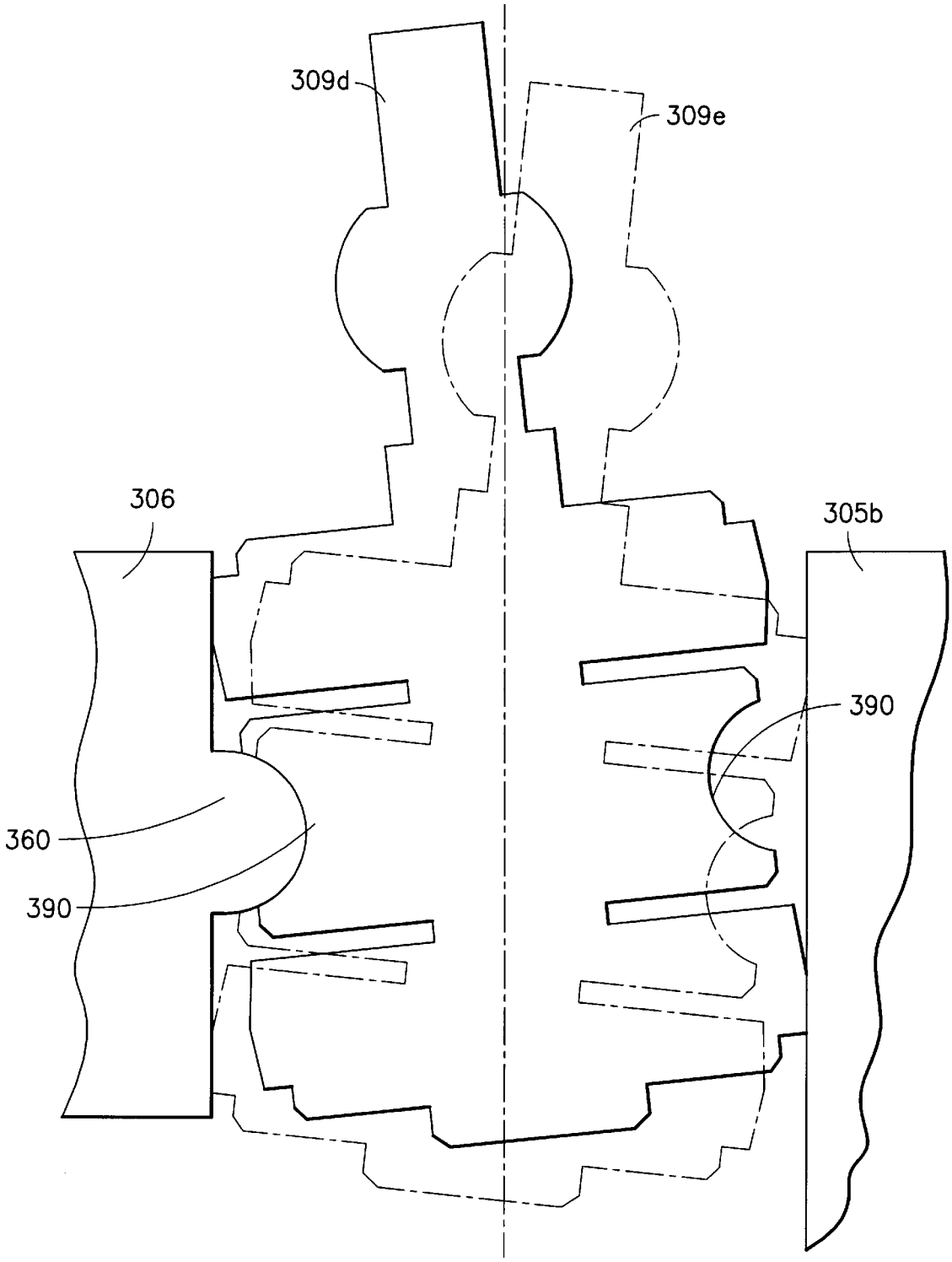
FIG. 46 is an elevation view illustrating another movement of the guide roller according to the present invention.

FIG. 46 is a elevation view illustrating the movement of the side guide roller 309 in the side guide rail 306 and guard member 305*b* in the section with "play".

As shown in FIG. 46, the side guide roller 309 tilts greatly in the side guide rail 306 and guard member 305*b* with the design standard line as the center thereof. This great tilting generates leeway for adjustment of the distance between the handrail pieces 303 and 303. The protrusion 360 of the guide rail is set such that the center line of the guide roller becomes the design standard line at the point that the apex of the concave arc of the hourglass-shaped portion 390 of the guide roller and the apex of the convex arc of the protrusion 360 of the guide rail meet, so that the guide roller tilts with the center thereof as the axis.

In designing the length of the section of play $S_a$, the full circumference margin of error $\Delta L_{12345678}$ of the handrail piece 303 in each of the zones S1, S2, S3, S4, S5, S6, S7, and S8 (converted as the full-circumference margin of error in the high-speed zone) is obtained by using mechanism analysis means such as shown in FIG. 45 to calculate the amount of wobble of the guide roller and obtain the full circumference margin of error from this amount of wobble by using Expression (33). A certain length of section of play $S_a$ is decided upon beforehand, and the leeway of adjustment $\Delta L_a$ of the handrail piece 303 in each of the play zones S5 and S7 (converted as the leeway of adjustment in the high-speed zone) is obtained by using mechanism analysis means such as shown in FIG. 46 to calculate the amount of wobble of the guide roller and obtain the leeway of adjustment from this amount of wobble by using Expression (33). The leeway of adjustment $\Delta L_a$ of the handrail piece 303 is obtained while changing the length of the section of play $S_a$. The full circumference margin of error $\Delta L_{12345678}$ of the handrail piece 303 is multiplied by a safety ratio S to yield the full circumference margin of error $\Delta L$ of the handrail piece 303. If the length of the section of play $S_a$ is such that the following Expression (42) holds, this means that there is sufficient leeway in the play section.

$$\Delta L_a(S_a) \subset \Delta L \tag{42}$$

Also, the minimum section of play $S_a$ in which the Expression (42) holds is the limit for the length of the section with play.

Figure 47:
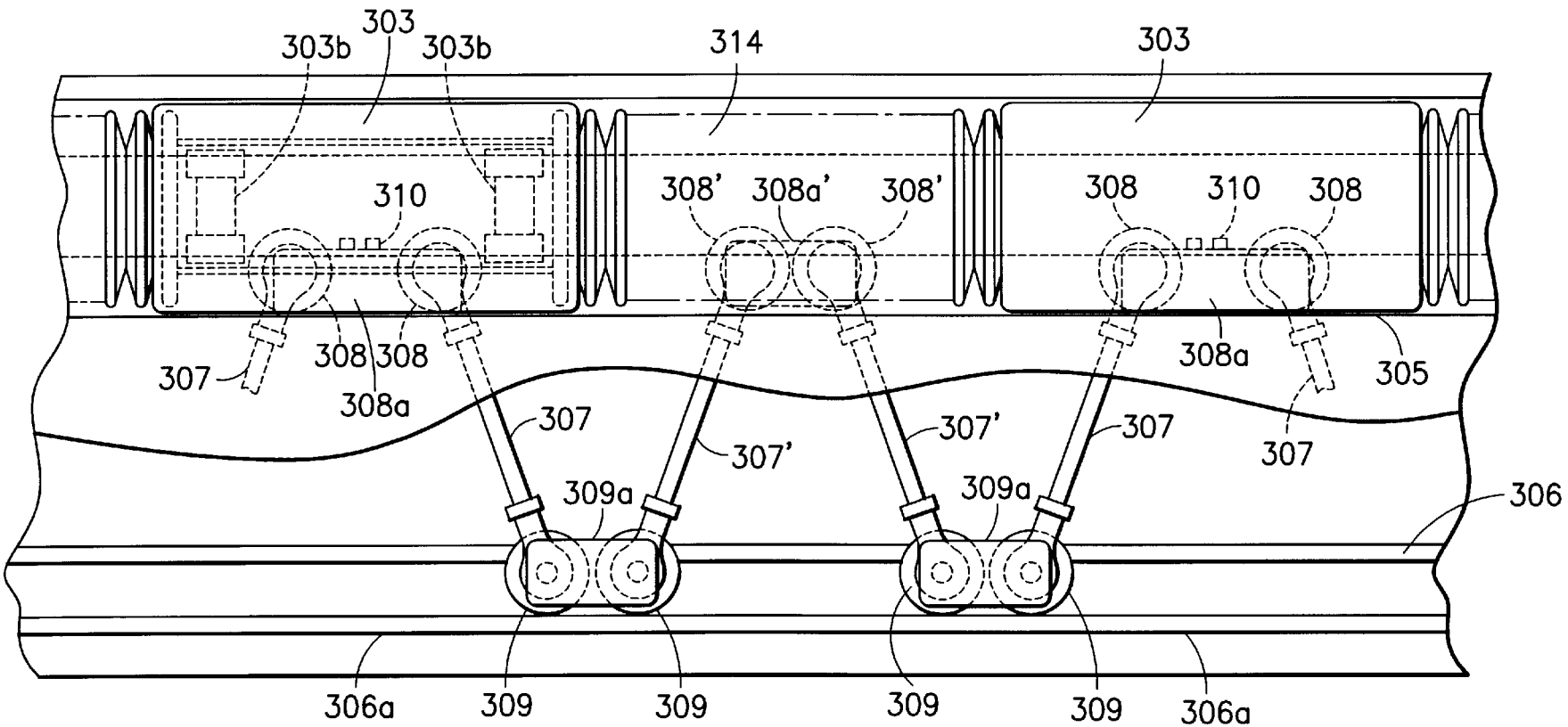
FIG. 47 is a partial cross sectional view of the variable-speed passenger conveyer handrail device according to the present invention.

FIG. 47 is a partial cross sectional plan view of the variable-speed passenger conveyer handrail device according to the present invention.

In FIG. 47, 303 is a handrail piece, and 314 is a handrail cover provided between the handrail pieces 303 and 33, and is formed of a flexible material such as accordion bellows form, capable of withstanding the separation distance of the handrail pieces 303 and 303.

The standard guide rollers 308 and 308 at the end of the links 307 are axially supported by the link member 308*a* and guided by the standard guide rail 305, and the side guide rollers 309 and 309 at the other end of the links 307 are axially supported by the link member 309*a* and guided by the side guide rail 306. Further, the guide rollers 308' and 308' at the handrail cover 314 portion are linked by a similar link member 308*a*'.

Also, the standard guide rollers 308 and 308 and the side guide rollers 309 and 309 are provided in units of two, improving tracing of the standard guide rail 305 and side guide rail 306, and also not doing away with derailing. Also, there is the advantage in that the upper plane of the handrail is maintained flat.

Figure 48:
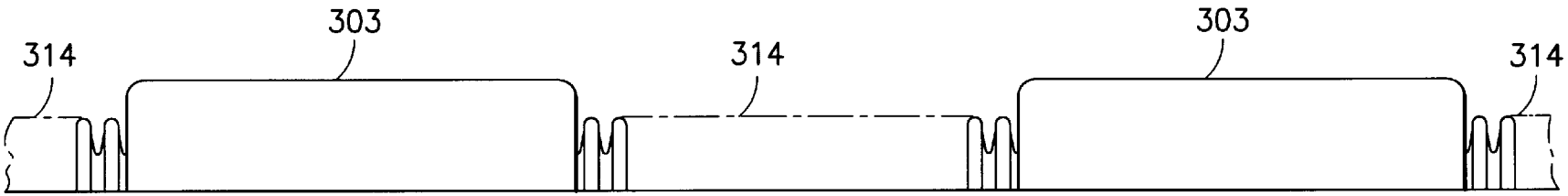
FIG. 48 is a side view of the variable-speed passenger conveyer handrail device according to the present invention as viewed from the railing side.

FIG. 48 is a side view of the variable-speed passenger conveyer handrail device according to the present invention as viewed from the railing side, with an offset provided between the handrail piece 303 and handrail cover 314, so that the passengers can grasp the handrail piece 303 in a sure manner.

The present invention is as described above, and has the following advantages:

(1) The link is formed in a V-shape within a plane, so transmission of force at the inversion portion of the handrail is smooth, and there is no interference between the standard/side guide rollers and the handrail and link.

(2) The standard/side guide rails are formed as smooth curves, so the acceleration of the handrail pieces is suppressed to a low level, and discomfort when holding the handrail piece can be relieved.

(3) A high-speed state is created in the high-speed zone only by the opening operation of the claw spacing of the driving chain, so there is no griding of links and the like and smooth movement speed of the handrail piece can be obtained.

(4) Adjustment of the circumferential length of the link (length in the direction of transportation) is performed along the return line, so adjustment of the link is easy when installing, and automatic adjustment is performed during operation.

(5) Supporting structures such as the link linkage portion, guide rollers, and the like are supported by the guide rail via engaging metal pieces from the handrail piece, so the structure is sure.

What is claimed is:

1. A variable-speed passenger conveyer which changes a transporting speed between a boarding end and a disembarking end by changing the transporting speed of palettes which transport passengers, said conveyer comprising:

a pair of guide rails provided in loop fashion with respect to a transporting line so that a width spacing is gradually reduced from the boarding end to a beginning of a high-speed zone and gradually increased from an end of the high-speed zone to the disembarking end;

a chain which engages the palettes at said high-speed zone and which drives at a high speed;

palettes having engaging metal pieces for engaging said chain and having a spline shaft for sliding said guide roller in a right-angle direction with respect to the transporting direction;

a pair of slide blocks engaging the spline shaft of said palettes and moving in a right-angle direction with respect to the transporting direction;

a guide roller attached to said pair of slide blocks and guided by said pair of guide rails; and a plurality of link members linking in a planar rhombic form, two pairs of slide blocks adjacent in the transporting direction, and intermediate joints positioned on a center line of said pair of guide rails.

2. The conveyer as defined by claim 1, wherein said pair of guide rails enable the width spacing to be gradually and smoothly reduced from the boarding end to the beginning of the high-speed zone and gradually and smoothly increased from the end of the high-speed zone to the disembarking end.

3. The conveyer as defined by claim 1, further comprising:

comb teeth provided to the side portion of one of adjacent palettes so that one end thereof is rotatable, in order to bridge with the other palette;

guide arms formed integrally with a base of said comb teeth portion at a certain angle and provided with a roller on the tip thereof; and a guide rail which restricts the roller at the tip of said guide arms at an inversion portion of the transporting line.

4. The conveyer as defined by claim 3, further comprising stoppers with which the roller at the tip of the guide arm is engaged at the inversion portion of the transporting line.

5. The conveyer as defined by claim 1, wherein a width of the two walls of the guide rails restricting movement of the guide rollers in the right-angle direction with respect to the transporting direction is formed so as to be wider in an acceleration zone wherein transition is made from the low-speed zone to the high-speed zone in the return line and in a deceleration zone wherein transition is made from the high-speed zone to the low-speed zone therein, than the width at other areas.

6. A handrail device for a variable-speed passenger conveyer comprising:

a plurality of variable-speed handrail pieces positioned in a transporting direction, a cross-sectional form thereof being a trapezoid;

a stretching linking member which links said plurality of variable-speed handrail pieces and closes the slit of the cover through which a shaft of the handrail pieces passes; and a cover having a radius and a center differing from a center of an inverse radius of the handrail pieces, so that an upper plane of the handrail pieces is embedded within a cover plane at a rotating portion of a transporting path.

7. The handrail device as defined by claim 6, wherein said stretching linking member comprises accordion bellows.

8. The handrail device as defined by claim 6, wherein said stretching linking member comprises accordion bellows and a flat spiral spring.

9. A handrail device for a variable-speed passenger conveyor, comprising:

a running rail having a passenger transporting line and a return line formed in a loop;

a plurality of handrail pieces which move following said running rail;

a standard guide rail formed in a loop in the same manner as said running rail;

a side guide rail provided along said standard guide rail, of which a spacing with said standard guide rail changes within a plane, which crosses vertically with a normal line on said standard guide rail, at acceleration/deceleration zones;

a plurality of links interposed between said standard guide rail and said side guide rail in a transporting direction within a plane in continuous V-formations, so as to rotatably link with a respective shaft of a plurality of guide rollers and a plurality of side guide rollers; and a driving chain having protrusions for engaging metal pieces of said plurality of handrail pieces so as to drive the handrail pieces, said driving chain being provided to a high-speed zone of the passenger transporting line and a high-speed zone of the return line;

wherein outline forms of the standard guide roller and the side guide roller are formed of smooth convex flange-shaped portions and concave hourglass-shaped portions;

wherein a side wall of said standard guide rail and said side guide rail where the guide rollers engage has a protrusion, the protrusion fitting with the hourglass-shaped portion of the guide rollers and having a curvature smaller than that of the hourglass-shaped portion of said guide rollers, and arranged such that a center line of the guide roller corresponds to a designed standard line of the guide roller when an apex of the protrusion and a bottom point of the hourglass-shaped portion of the guide roller meet;

wherein a gap is provided between the flange-shaped portions of the guide roller and both side walls of the guide rail;

and wherein a height of each guide roller is lower than a height of both side walls of said standard guide rail and said side guide rail.

10. The handrail device as defined by claim 9, wherein the spacing between said standard guide rail and said side guide rail changes smoothly within a plane at acceleration/deceleration zones.

11. The handrail device as defined by claim 9, wherein said standard guide rail and said side guide rail are provided to the acceleration zone, deceleration zone, and an inversion portion.

12. A handrail device for a variable-speed passenger conveyor, comprising:

a running rail having a passenger transporting line and a return line formed in a loop;

a plurality of handrail pieces which move following said running rail;

a standard guide rail formed in a loop in the same manner as said running rail;

a side guide rail provided alone said standard guide rail, of which the spacing with said standard guide rail changes within a plane, which crosses vertically with a normal line on said standard guide rail, at acceleration/deceleration zones;

a plurality of links interposed between said standard guide rail and said side guide rail in a transporting direction within a plane in continuous V-formations, so as to rotatably link with a respective shaft of a plurality of guide rollers and a plurality of side guide rollers; and a driving chain having protrusions for engaging metal pieces of said plurality of handrail pieces so as to drive the handrail pieces, said driving chain being provided to a high-speed zone of the passenger transporting line and a high-speed zone of the return line;

wherein the handrail device has a plurality of guide rails and a plurality of guide rollers;

wherein said guide rail has a protrusion, being parallel, and forming a cross-section toward a plane which includes a rotation axis;

wherein the guide roller has an hour-glass shaped rotor and a concave part, fitting within the protrusion; and wherein the concave part of the guide roller has an arc-shape.

13. The handrail device as defined by claim 9, wherein handrail pieces are provided toward an end side of the links and provided to a passenger transporting side.

14. The handrail device as defined by claim 12, wherein the spacing between said standard guide rail and said side guide rail changes smoothly within a plane at acceleration/deceleration zones.

15. The handrail device as defined by claim 12, wherein said standard guide rail and said side guide rail are provided to the acceleration zone, deceleration zone, and an inversion portion.

16. The handrail device as defined by claim 12, wherein handrail pieces are provided toward an end side of the plurality of links and provided to a passenger transporting side.

* * * * *